US006155053A

United States Patent [19]

Hansen et al.

[11] Patent Number: 6,155,053

[45] Date of Patent: Dec. 5, 2000

[54] TECHNIQUE FOR BALANCING REGENERATIVE REQUIREMENTS DUE TO PRESSURE CHANGES IN A KALINA CYCLE POWER GENERATION SYSTEM

[75] Inventors: Paul L. Hansen; Paul D. Kuczma, both of Enfield, Conn.; Jens O. Palsson, Lund, Sweden; Jonathon S. Simon, Pleasant Valley, Conn.

[73] Assignee: ABB Alstom Power Inc., Windsor, Conn.

[21] Appl. No.: 09/231,171

[22] Filed: Jan. 13, 1999

[51] Int. Cl.[7] ..... F01K 25/06

[52] U.S. Cl. ..... 60/649; 60/651; 60/671; 60/673

[58] Field of Search ..... 60/649, 645, 651, 60/671, 673; 165/301, 302

[56] References Cited

U.S. PATENT DOCUMENTS

| | | | |
|---|---|---|---|
| 2,946,570 | 7/1960 | West | 165/302 |
| 3,590,912 | 7/1971 | Elder | 165/302 X |
| 4,489,563 | 12/1984 | Kalina | 60/673 |
| 4,586,340 | 5/1986 | Kalina | 60/649 X |
| 4,732,005 | 3/1988 | Kalina | 60/673 |
| 4,750,543 | 6/1988 | Edelstein | 165/302 X |
| 4,982,568 | 1/1991 | Kalina | 60/649 |
| 5,029,444 | 7/1991 | Kalina | 60/673 |
| 5,095,708 | 3/1992 | Kalina | 60/673 |
| 5,440,882 | 8/1995 | Kalina | 60/641.2 |
| 5,450,821 | 9/1995 | Kalina | 122/1 |
| 5,572,871 | 11/1996 | Kalina | 60/649 |
| 5,588,298 | 12/1996 | Kalina et al. | 60/673 |
| 5,638,673 | 6/1997 | Yabe | 60/649 |

OTHER PUBLICATIONS

Kalina Cycles for Efficient Direct Fired Application,–Alexander I. Kalina, Yakov Lerner, richard I. Pelletier, Exergy, Inc., Lawrence J. Peletz, Jr. ABB CE systems, Combustion engineering, Inc., –7 pgs. (No Date).

Kalina Cycle Looks Good for Combined Cycle Generation–Dr. James C. Corman, Dr. robert W. Bjorge, GE Power Systems, Dr. Alexander Kalina, Exergy, Inc., Jul., 1995–3 pgs.

Power Perspective, The Kalina Cycle–More Electricity From Each BTU of Fuel–1995–3 pgs.

A Gas Turbine–Aqua Ammonia Combined Power Cycle–Irby Hicks, The Thermosorb Company–Mar. 25, 1996–6 pgs.

Understanding the Kalina Cycle Fundamentals–H.A. Mlcak, P.E., ABB Lummus Crest–12 pgs. ( No Date).

Direct–Fired Kalina Cycle: Overview–ABB–1994–13 pgs.

Kalina Cycle System Advancements for Direct Fired Power Generation, Michael J. Davidson, Lawrence J. Peletz, ABB Combustion Engineering,–9 pgs. (No Date).

Kalina Cycles and System for Direct–Fired Power Plants, A.I. Kalina, Exergy, Inc., AES–vol. 25/HTD–vol. 191–7 pgs. (No Date).

*Primary Examiner*—Hoang Nguyen
*Attorney, Agent, or Firm*—Russell W. Warnock

[57] ABSTRACT

A method of operating a power generation system is provided. The system includes a turbine, a regenerative heat exchanger, and a vapor generator. The turbine receives a stream of working fluid and expands the working fluid to produce power. The regenerative heat exchanger has a plurality of condensing heat exchangers which transfer heat from the expanded working fluid to condense the expanded working fluid. The vapor generator vaporizes the condensed portions of working fluid to form the stream of working fluid. In operating the system, a respective portion of the expanded working fluid is directed to each of the condensing heat exchangers, and the amount of condensed working fluid at at least one of the condensing heat exchangers is regulated.

39 Claims, 27 Drawing Sheets

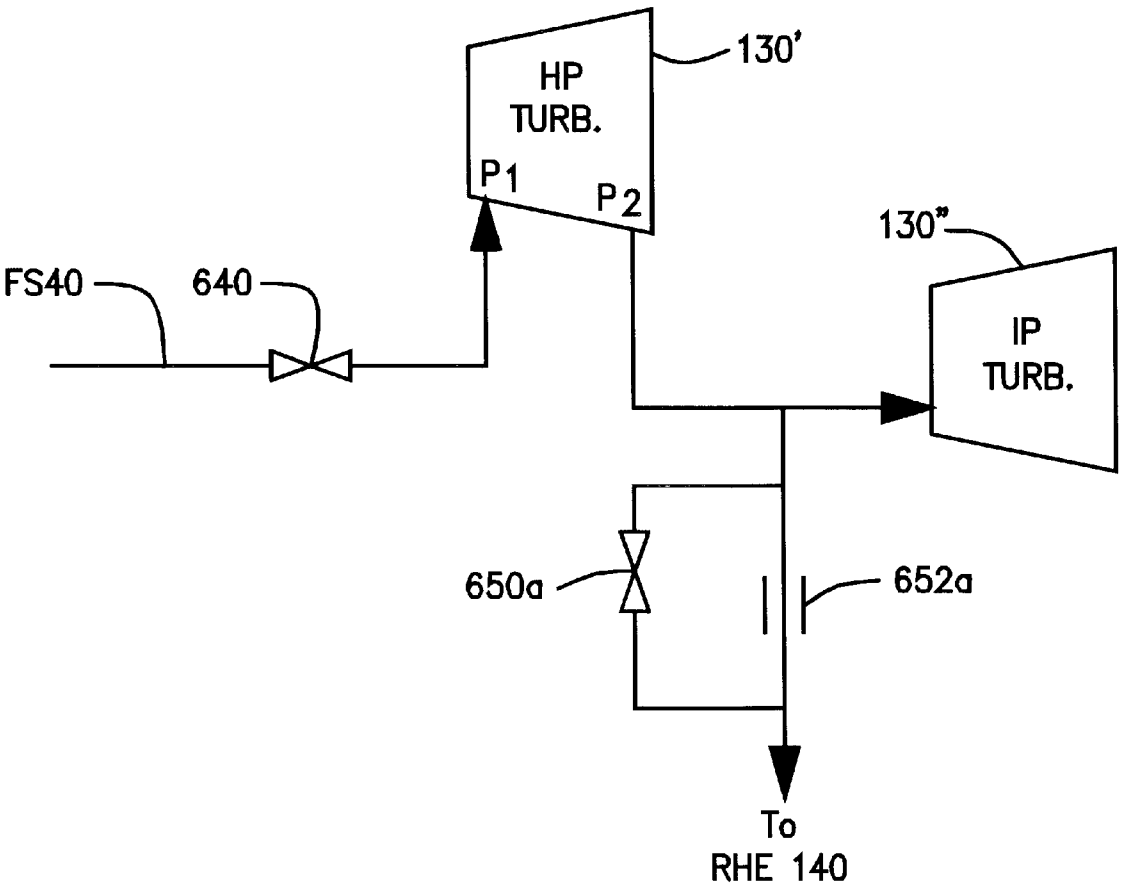
Figure 7c(1)

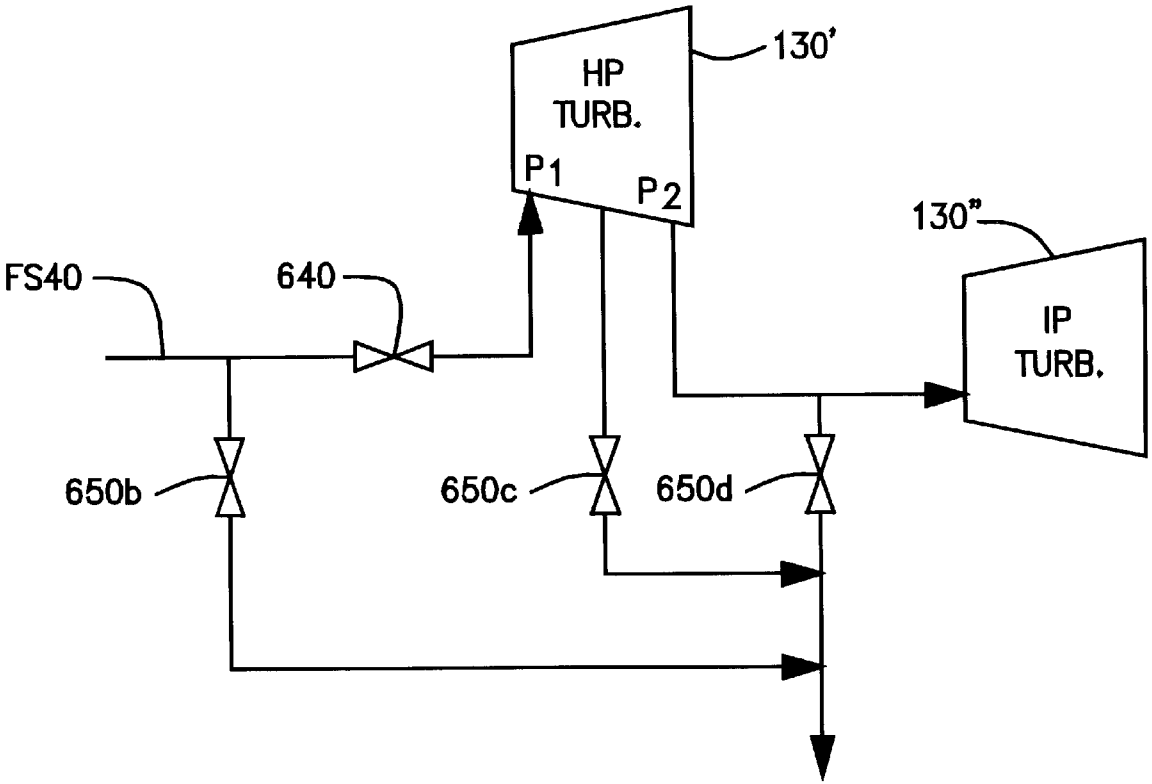
Figure 7c(2)

TECHNIQUE FOR BALANCING REGENERATIVE REQUIREMENTS DUE TO PRESSURE CHANGES IN A KALINA CYCLE POWER GENERATION SYSTEM

CROSS-REFERENCE TO RELATED APPLICATIONS

The present application relates to pending U.S. patent application Ser. No. 09/231,165, filed Jan. 12, 1999, for "TECHNIQUE FOR CONTROLLING REGENERATIVE SYSTEM CONDENSATION LEVEL DUE TO CHANGING CONDITIONS IN A KALINA CYCLE POWER GENERATION SYSTEM"; U.S. patent application Ser. No. 09/231,171, filed Jan. 12, 1999, for "TECHNIQUE FOR BALANCING REGENERATIVE REQUIREMENTS DUE TO PRESSURE CHANGES IN A KALINA CYCLE POWER GENERATION SYSTEM"; U.S. patent application Ser. No. 09/229,364, filed Jan. 12, 1999, for "TECHNIQUE FOR CONTROLLING SUPERHEATED VAPOR REQUIREMENTS DUE TO VARYING CONDITIONS IN A KALINA CYCLE POWER GENERATION SYSTEM"; U.S. patent application Ser. No. 09/231,166, filed Jan. 12, 1999, for "TECHNIQUE FOR MAINTAINING PROPER DRUM LIQUID LEVEL IN A KALINA CYCLE POWER GENERATION SYSTEM"; U.S. patent application Ser. No. 09/229,629, filed Jan. 12, 1999, for "TECHNIQUE FOR CONTROLLING DCSS CONDENSATE LEVELS IN A KALINA CYCLE POWER GENERATION SYSTEM"; U.S. patent application Ser. No. 09/229,630, filed Jan. 12, 1999, for "TECHNIQUE FOR MAINTAINING PROPER FLOW IN PARALLEL HEAT EXCHANGERS IN A KALINA CYCLE POWER GENERATION SYSTEM"; U.S. patent application Ser. No. 09/229,631, filed Jan. 12, 1999; U.S. patent application Ser. No. 09/231,164, filed Jan. 12, 1999, for "WASTE HEAT KALINA CYCLE POWER GENERATION SYSTEM"; U.S. patent application Ser. No. 09/229,366, filed Jan. 12, 1999, for "MATERIAL SELECTION AND CONDITIONING TO AVOID BRITTLENESS CAUSED BY NITRIDING"; U.S. patent application Ser. No. 09/231,168, filed Jan. 12, 1999, for "REFURBISHING CONVENTIONAL POWER PLANTS FOR KALINA CYCLE OPERATION"; U.S. patent application Ser. No. 09/231,170, filed Jan. 12, 1999, for "STARTUP TECHNIQUE USING MULTIMODE OPERATION IN A KALINA CYCLE POWER GENERATION SYSTEM"; U.S. patent application Ser. No. 09/231,163, filed Jan. 12, 1999, for "TECHNIQUE FOR COOLING FURNACE WALLS IN A MULTI-COMPONENT WORKING FLUID POWER GENERATION SYSTEM; U.S. patent application Ser. No. 09/229,632, filed Jan. 12, 1999, for "BLOWDOWN RECOVERY SYSTEM IN A KALINA CYCLE POWER GENERATION SYSTEM"; U.S. patent application Ser. No. 09/229,368, filed Jan. 12, 1999, for "REGENERATIVE SUBSYSTEM CONTROL IN A KALINA CYCLE POWER GENERATION SYSTEM"; U.S. patent application Ser. No. 09/229,363, filed Jan. 12, 1999, for "DISTILLATION AND CONDENSATION SUBSYSTEM (DCSS) CONTROL IN A KALINA CYCLE POWER GENERATION SYSTEM"; U.S. patent application Ser. No. 09/229,365, filed Jan. 12, 1999, for "VAPOR TEMPERATURE CONTROL IN A KALINA CYCLE POWER GENERATION SYSTEM"; U.S. patent application Ser. No. 09/229,367, filed Jan. 12, 1999, for "A HYBRID DUAL CYCLE VAPOR GENERATOR"; U.S. patent application Ser. No. 09/231,169, filed Jan. 12, 1999, for "FLUIDIZED BED FOR KALINA CYCLE POWER GENERATION SYSTEM"; U.S. patent application Ser. No. 09/231,167, filed Jan. 12, 1999, for "TECHNIQUE FOR RECOVERING WASTE HEAT USING A BINARY WORKING FLUID".

FIELD OF THE INVENTION

The present invention is in the field of power generation. In particular, the present invention is related to control of multi-component working fluid vapor generation systems.

BACKGROUND OF THE INVENTION

In recent years, industrial and utility concerns with deregulation and operational costs have strengthened demands for increased power plant efficiency. The Rankine cycle power plant, which typically utilizes water as the working fluid, has been the mainstay for the utility and industrial power industry for the last 150 years. In a Rankine cycle power plant, heat energy is converted into electrical energy by heating a working fluid flowing through tubular walls, commonly referred to as waterwalls, to form a vapor, e.g., turning water into steam. Typically, the vapor will be superheated to form a high pressure vapor, e.g., superheated steam. The high pressure vapor is used to power a turbine/generator to generate electricity.

Conventional Rankine cycle power generation systems can be of various types, including direct-fired, fluidized bed and waste-heat type systems. In direct fired and fluidized bed type systems', combustion process heat is generated by burning fuel to heat the combustion air which in turn heats the working fluid circulating through the system's waterwalls. In direct-fired Rankine cycle power generation systems the fuel, commonly pulverized-coal, gas or oil, is ignited in burners located in the waterwalls. In bubbling fluidized bed Rankine cycle, power generation system pulverized-coal is ignited in a bed located at the base of the boiler to generate combustion process heat. Waste-heat Rankine cycle power generation systems rely on heat generated in another process, e.g., incineration for process heat to vaporize, and if desired superheat, the working fluid. Due to metallurgical limitations, the highest temperature of the superheated steam does not normally exceed 1050° F. (566° C.). However, in some "aggressive" designs, this temperature can be as high as 1100° F. (593° C.).

Over the years, efficiency gains in Rankine cycle power systems have been achieved through technological improvements which have allowed working fluid temperatures and pressures to increase and exhaust gas temperatures and pressures to decrease. An important factor in the efficiency of the heat transfer is the average temperature of the working fluid during the transfer of heat from the heat source. If the temperature of the working fluid is significantly lower than the temperature of the available heat source, the efficiency of the cycle will be significantly reduced. This effect, to some extent, explains the difficulty in achieving further gains in efficiency in conventional, Rankine cycle-based, power plants.

In view of the above, a departure from the Rankine cycle has recently been proposed. The proposed new cycle, commonly referred to as the Kalina cycle, attempts to exploit the additional degree of freedom available when using a binary fluid, more particularly an ammonia/water mixture, as the working fluid. The Kalina cycle is described in the paper entitled: "Kalina Cycle System Advancements for Direct Fired Power Generation", co-authored by Michael J. Davidson and Lawrence J. Peletz, Jr., and published by Combustion Engineering, Inc. of Windsor, Conn.

Efficiency gains are obtained in the Kalina cycle plant by reducing the energy losses during the conversion of heat energy into electrical output.

A simplified conventional direct-fired Kalina cycle power generation system is illustrated in FIG. 1 of the drawings. Kalina cycle power plants are characterized by three basic system elements, the Distillation and Condensation Subsystem (DCSS) 100, the Vapor Subsystem (VSS) 110 which includes the boiler 142, superheater 144 and recuperative heat exchanger (RHE) 140, and the turbine/generator subsystem (TGSS) 130. The DCSS 100 and RHE 140 are sometimes jointly referred to as the Regenerative Subsystem (RSS) 150. The boiler 142 is formed of tubular walls 142*a* and the superheater 144 is of tubular walls and/or banks of fluid tubes 144*a*. A heat source 120 provides process heat 121. A portion 123 of the process heat 121 is used to vaporize the working fluid in the boiler 142. Another portion 122 of the process heat 121 is used to superheat the vaporized working fluid in the superheater 144.

During normal operation of the Kalina cycle power system of FIG. 1, the ammonia/water working fluid is fed to the boiler 142 from the RHE 140 by liquid stream FS 5 and from the DCSS 100 by liquid stream FS 7. The working fluid is vaporized, i.e., boiled, in the tubular walls 142*a* of the boiler 142. The rich working fluid stream FS 20 from the DCSS 100 is also vaporized in the heat exchanger(s) of the RHE 140.

In one implementation, the vaporized working fluid from the boiler 142 along with the vaporized working fluid FS 9 from the RHE 140, is further heated in the tubular walls/fluid tube bank 144*a* of the superheater 144. The superheated vapor as vapor FS 40 from the superheater 144 is directed to, and powers, the TGSS 130 so that electrical power 131 is generated to meet the load requirement. In an alternative implementation, the RHE 140 not only vaporizes but also superheats the rich stream FS 20. In such a case, the superheated vapor flow FS 9' from the RHE 140 is combined with the superheated vapor from the superheater 144 to form vapor flow FS 40 to the TGSS 130.

The expanded working fluid extraction FS 11 egresses from the TGSS 130, e.g., from an intermediate pressure (IP) or a low it pressure (LP) turbine (not shown) within the TGSS 130, and is directed to the DCSS 100. This expanded working fluid is, in part, condensed in the DCSS 100. Working fluid condensed in the DCSS 100, as described above, forms feed fluid FS 7 to the boiler 142. Another key feature of the DCSS 100 is the separation of the working fluid egressing from TGSS 130 into ammonia rich and ammonia lean streams for use by the VSS 110. In this regard, the DCSS 100 separates the expanded working fluid into an ammonia rich working fluid flow FS 20 and an ammonia lean working fluid flow FS 30. Waste heat 101 from the DCSS 100 is dumped to a heat sink, such as a river or pond.

The rich and lean flows FS 20, FS 30, respectively are fed to the RHE 140. Another somewhat less expanded hot working fluid extraction FS 10 egresses from the TGSS 130, e.g., from a high pressure (HP) turbine (not shown) within the TGSS 130, and is directed to the RHE 140. Heat is transferred from the expanded working fluid-extraction FS 10 and the working fluid lean stream FS 30 to the rich working fluid flow FS 20, to thereby vaporize the rich flow FS 20 and condense, at least in part, the expanded working fluid extraction FS 10 and lean working fluid flow FS 30, in the RHE 140. As discussed above, the vaporized rich flow is fed to either the superheater 144, along with vaporized fluid from the boiler 142, or is combined with the superheated working fluid from the superheater 144 and fed directly to the TGSS 130. The condensed expanded working fluid from the RHE 140 forms part of the feed flow, i.e., flow FS 5, to the boiler 142, as has been previously described.

FIG. 2 details a portion of the RHE 140 of VSS 110 of FIG. 1. As shown, the RHE 140 receives ammonia-rich, cold high pressure stream FS 20 from DCSS 100. Stream FS 20 is heated by ammonia-lean hot low pressure stream FS 3010. The stream FS 3010 is formed by combining the somewhat lean hot low pressure extraction stream FS 10 from TGSS 130 with the lean hot low pressure stream FS 30 from DCSS 100, these flows being combined such that stream FS 30 dilutes stream FS 10 resulting in a desired concentration of ammonia in stream FS 3010.

Heat energy 125, is transferred from stream FS 3010 to rich stream FS 20. As discussed above, this causes the transformation of stream FS 20 into a high pressure vapor stream FS 9 or the high pressure superheated vapor stream FS 9', depending on the pressure and concentration of the rich working fluid stream FS 20. This also causes the working fluid stream FS 3010 to be condensed and thereby serve as a liquid feed flow FS 5 to the boiler 142.

As previously indicated, in one implementation the vapor stream FS 9 along with the vapor output from boiler 142 form the vapor input to the superheater 144, and the superheater 144 superheats the vapor input to form superheated vapor stream FS 40 which is used to power TGSS 130. Alternatively, the superheated vapor stream FS 91 along with the superheated vapor output from the superheater 144 form the superheated vapor stream FS 40 to the TGSS 130.

FIG. 3 illustrates exemplary heat transfer curves for heat exchanges occurring in the RHE 140 of FIG. 2. A typical Kalina cycle heat exchange is represented by curves 520 and 530. As shown, the temperature of the liquid binary working fluid FS 20 represented by curve 520 increases as a function of the distance of travel of the working fluid through the heat exchanger of the RHE 140 in a substantially linear manner. That is, the temperature of the working fluid continues to increase even during boiling as the working fluid travels through the heat exchanger of the RHE 140 shown in FIG. 2. At the same time, the temperature of the liquid working fluid FS 3010 represented by curve 530 decreases as a function of the distance of travel of this working fluid through the heat exchanger of the RHE 140 in a substantially linear manner. That is, as heat energy 125 is transferred from working fluid FS 3010 to the working fluid stream FS 20 as both fluid streams flow in opposed directions through the RHE 140 heat exchanger of FIG. 2, the binary working fluid FS 3010 loses heat and the binary working fluid stream FS 20 gains heat at substantially the same rate within the Kalina cycle heat exchangers of the RHE 140.

In contrast, a typical Rankine cycle heat exchange is represented by curve 510. As shown, the temperature of the water or water/steam mixture forming the working fluid represented by curve 510 increases as a function of the distance of travel of the working fluid through a heat exchanger of the type shown in FIG. 2 only after the working fluid has been fully evaporated, i.e., vaporized. The portion 511 of curve 510 represents the temperature of the water or water/steam mixture during boiling. As indicated, the temperature of the working fluid remains substantially constant until the boiling duty has been completed. That is, in a typical Rankine cycle, the temperature of the working fluid does not increase during boiling; rather, as indicated by portion 512 of curve 510, it is only after full vaporization, i.e., full phase transformation, that the temperature of the working fluid in a typical Rankine cycle increases beyond the boiling point temperature of the working fluid, e.g., 212° F./100° C.

As will be noted, the temperature differential between the stream represented by curve 530, which releases the heat energy, and the Rankine cycle stream represented by curve 510, which absorbs the heat energy, continues to increase during phase transformation. The differential becomes greatest just before complete vaporization of the working fluids. In contrast, the temperature differential between the stream releasing heat energy represented by curve 530, and the Kalina cycle stream represented by curve 520, which absorbs the heat energy, remains relatively small, and substantially constant, during phase transformation. This further highlights the enhanced efficiency of Kalina cycle heat exchange in comparison to Rankine cycle heat exchange.

As indicated above, the transformation in the RHE 140 of the liquid or mixed liquid/vapor stream FS 20 to vapor or superheated vapor stream FS 9 or 9' is possible in the Kalina cycle because, the boiling point of rich cold high pressure stream FS 20 is substantially lower than that of lean hot low pressure stream FS 3010. This allows additional boiling, and in some implementation superheating, duty to be performed in the Kalina cycle RHE 140 and therefore outside the boiler 142 and/or superheater 144. Hence, in the Kalina cycle, a greater portion of the process heat 121 can be used for superheating vaporized working fluid in the superheater 144, and less process heat 121 is required for boiling duty in the boiler 142. The net result is increased efficiency of the power generation system when compared to a conventional Ranking cycle type power generation system.

FIG. 4 further depicts the TGSS 130 of FIG. 1. As illustrated, the TGSS 130 in a Kalina cycle power generation system is driven by a high pressure superheated binary fluid vapor stream FS 40. Relatively lean hot low pressure stream extraction FS 10 is directed from, for instance the exhaust of a high pressure (HP) turbine (not shown) within the TGSS 130 to the RHE 140 as shown in FIGS. 1 and 2. A relatively lean cooler, even lower pressure extraction flow FS 11 is directed from, for instance, the exhaust of an intermediate pressure (IP) or low pressure (LP) turbine (not shown) within the TGSS 130 to the DCSS 100 as shown in FIG. 1. As has been discussed to some extent above and will be discussed further below, both extraction flow FS 10 and extraction flow FS 11 retain enough heat to transfer energy to still cooler higher pressure streams in the DCSS 100 and RHE 140.

FIG. 5A further details the Kalina cycle power generation system of FIG. 1 for a once through, i.e., non-recirculating, system configuration. As shown, working fluid streams FS 5 and FS 7 from the RHE 140 and DCSS 100, respectively are combined to form a feed fluid stream FS 57 which is fed to the bottom of the boiler 142. The working fluid 57 flows through the boiler tubes 142*a* where it is exposed to process heat 123. The working fluid is heated and vaporized in the boiler tubes 142*a*, while cooling the boiler walls. Sufficient liquid working fluid must be supplied by feed stream FS 57 to provide an adequate flow to the boiler tubes 142*a* to ensure proper cooling during system operation. Without an adequate flow to the tubes 142*a*, the tubes can become overheated causing a premature failure of the tubes, particularly in the combustion chamber, and requiring system shut-down for repair.

The heated working fluid rises in the boiler tubes 142*a* and the fully vaporized working fluid stream is directed from the boiler tubes 142*a* as stream FS 8 and combined with the vapor stream FS 9 from the RHE 140. The combined vaporized fluid stream FS 89 is directed to the superheater 144, where it is exposed to process heat 122. The resulting high pressure superheated vapor flow FS 40 is directed from the superheater 144 to the TGSS 130.

The TGSS 130, as shown, includes both an HP turbine 130" and an IP turbine 130". The superheated high pressure vapor stream FS 40 is directed to the TGSS 130', first to the HP turbine 130' and then to the IP turbine 130". The vapor flow FS 40 must be sufficient to provide the necessary energy to drive the turbines so that the required power is generated.

The lower pressure hot working fluid exhausted from the HP turbine 130' is split into a lower pressure vapor working fluid stream FS 40' to the IP turbine 130" and an extraction flow FS 40" to the RHE 140. Typically, approximately 50% of the exhaust flow from the HP turbine 130' is spilt off as stream FS 40" to RHE 140, although this may vary. The even lower pressure hot working fluid exhausted from the IP turbine 130" is split into a working fluid stream FS 11 to the DCSS 100 and extraction flow FS 40'" to the RHE 140. It will be understood that the TGSS 130 could also include other turbines, e.g., an LP turbine, to which a portion of the fluid flow from the IP turbine might be first directed before being released from the TGSS 130 to the DCSS 100. The lean hot working fluid extraction streams FS 40" and FS 40'" from the TGSS 130 are combined to form stream FS 10, which is further combined, as previously discussed, with lean hot working fluid stream FS 30 from the DCSS 100 to form a hot working fluid stream FS 3010. Stream FS 3010 is directed on to the RHE 140.

The RHE 140, as previously described receives the hot stream FS 3010 and from the DCSS 100 a rich cold fluid stream FS 20. Heat is transferred from the stream FS 3010 to vaporize stream FS 20. During this process, the stream FS 3010 is condensed to form condensate 3010' which is fed to the boiler 142 as liquid stream FS 5.

FIG. 5B further details the Kalina cycle power generation system of FIG. 1 for a recirculating drum system configuration. The TGSS 130 and RHE 140 of FIG. 5B are substantially identical to those described above with reference to FIG. 5A and therefore will not be further described herein to avoid unnecessary duplication.

As shown, working fluid FS 5 and FS 7 are fed from the RHE 140 and DCSS 100, respectively, and combined to form a feed working fluid stream FS 57 to the drum 142*b* of the boiler 142. The drum 142*b* serves not only as a receptacle for the fed fluid but also as a gravity separator which separates out any non-vaporized component of the working fluid received from the tubular walls 142*a* of the boiler 142. The liquid or mixed liquid/vapor working fluid 57' in the drum 142*b* is forced by gravity through the boiler tubes 142*a* where it is exposed to process heat 123. The working fluid is heated and vaporized, while cooling the boiler walls. Sufficient liquid working fluid 57' must be present in the drum 142*b* to supply an adequate flow to the boiler tubes 142*a* to ensure proper cooling during system operation. Here again, without an adequate flow to the tubes 142*a*, the tubes can become overheated causing a premature failure of the tubes, particularly in the combustion chamber, and requiring system shut-down for repair.

The heated working fluid rises in the boiler tubes 142*a* and the fully vaporized working fluid 57" is separated from any liquid or mixed liquid/vapor working fluid in the drum 142*b*. The separated vaporized working fluid is directed from the drum 142*b* as stream FS 8 and combined with the vapor stream FS 9 from the RHE 140. As discussed above, the combined vaporized fluid stream FS 89 is directed to the superheater 144, where it is exposed to process heat 122. The resulting high pressure superheated vapor flow FS 40 is directed from the superheater 144 to the TGSS 130.

Conventional Kalina cycle power generation systems are designed as constant pressure self-balancing systems. That is, conventional Kalina cycle systems are designed to provide the superheated vapor flow needed by the TGSS 130 to generate the required power to meet the load demand, while at the same time providing the necessary feed fluid flow to the boiler to cool the boiler tubes, without actively controlling the fluid flows within the system. Although Kalina cycle power generation test systems are in operation, no Kalina cycle power generation system is believed to have, as yet, been placed in commercial operation. While Kalina cycle power generation test systems which are in operation may be sufficiently self-balancing over the design load range when operated under the test conditions, certain operational and/or environmental factors which arise in commercially operating power generation systems could potentially cause a dangerous system imbalance in conventional Kalina cycle power generation systems.

More particularly, commercially operating power generation systems occasionally encounter conditions which are unpredictable, and hence outside of the system design specifications. For example, fuel, such as pulverized coal, meeting the design specification fuel grade requirements may be unavailable and therefore a different, perhaps lower grade fuel may need to be used to generate the process heat for at least limited periods of operation. In such cases it may not be possible to generate the requisite amount of process heat with the lower grade fuel. Extremes in the environment conditions, such as in the ambient temperature, humidity and atmospheric pressure may be experienced during certain operating periods, with the result that the temperature and pressure relationship which the system requires are unable to be met. Additionally, unusually large and/or quick swings in load demand and hence the power generation requirements may occur, making it difficult, if not impossible, for a conventional Kalina power generation system to accomplish the necessary self-balancing in the required time frame to avoid insufficient working fluid flows within the system, e.g., insufficient superheated vapor FS 40 being, provided to the TGSS 130 and/or insufficient feed fluid 57 being provided to the boiler tubes 142*a*. Accordingly, problems may arise in the operation of conventional self balancing Kalina cycle power generation systems when subjected to conditions which occasionally occur in the operation of commercially implemented power generation systems.

FIG. 6 illustrates exemplary conventional flow splits and heat transfers within the RHE 140 of FIGS. 5A and 5B. As shown, the RHE 140 includes multiple heat exchangers 140*a*, 140*b*, 140*c*, 140*d* and 140*e* with three separate condensate chambers (as shown in heat (exchangers 140*a*–140*c*). The extraction FS 10 from the TGSS 130 is combined with the lean hot stream FS 30 from the DCSS 100 to form stream FS 3010 as has been previously described. It should be noted that the stream FS 30 is preheated in heat exchanger 140*b* of the RHE 140 to form stream FS 30' before being combined with the flow from the TGSS 130 to form stream FS 3010.

The flow FS 3010 is split into a primary stream FS 3010*a*, and secondary streams FS 3010*b* and FS 3010*c*, each being directed to a respective heat exchanger 140*a*–140*c*.

The stream FS 3010*a* releases heat in the primary heat exchanger 140*a* to vaporize and/or superheat the flow FS 20' and is thereby transformed into the primary condensate 3010*a*′ which will be fed as stream FS 3010*a*′ from the heat exchanger 140*a*. The stream FS 3010*b* releases heat in the secondary heat exchanger 140*b* to heat the flow FS 30 and is thereby transformed into the secondary condensate 3010*b*′ which will be fed as stream FS 3010*b*′ from the heat exchanger 140*b*. The stream FS 3010*c* transfers heat in the secondary heat exchanger 140*c* to heat the flow FS 3010*a*″ and is thereby transformed into the secondary condensate 3010*c*′ which will be fed as stream FS 3010*c*′ from the heat exchanger 140*c*.

Stream FS 20' is formed by preheating the rich cold stream FS 20 from the DCSS 100 in heat exchanger 140d with heat released from the warm lean condensate FS 3010' flowing from the heat exchangers 140*a*–140*c*. FS 3010' is thereby transformed into steam FS 3010". The stream FS 3010" is, in part, directed as stream FS 3010*a*″ through secondary heat exchanger 140*c* thereby being transformed into stream FS 3010*a*'". Another portion of stream FS 3010" is directed as stream FS 3010*b*" to heat exchanger 140*e*, where it receives heat released from a stream FS 810, which may, for example, be another stream from the DCSS 100, and is thereby transformed into stream FS 3010*b*'". The streams FS 3010*a*'" and FS 3010*b*'" are combined to form feed stream FS 5 from the RHE 140 to the boiler 142.

Although the heat balances may be satisfactory under limited operating and environmental conditions with the system operating in a constant pressure mode, under sliding pressure conditions various system anomalies are likely to occur. For example, the heat exchanges in the exchangers 140*a*–140*c* may cause too much or too little heat to be transferred to certain flows and could even result in stream FS 5 being vaporized causing system instability, particularly in the drum type system of FIG. 5B. Turning now to the DCSS, as discussed above, the two primary purposes of the DCSS are to produce the rich and lean streams FS 20 and FS 30 to the RHE 140, as for example shown in FIG. 1, and to reject excess heat which cannot be used by the cycle to a low temperature reservoir or other heat sink. Hence, the DCSS can be viewed as a complex distillation subsystem for producing the rich and lean streams and a condenser for ridding the system of excess heat.

FIG. 5C depicts a more detailed representation of the conventional Kalina cycle power generation system of FIG. 1 for a once through, i.e., non-recirculating, system configuration. The boiler 142, superheater 144, and RHE 140 of FIG. 5C are similar to those described above with reference to FIG. 5A and therefore will not be further described to avoid unnecessary duplication. The TOSS 130 of FIG. 5C is generally similar to the TOSS 130 of FIG. 5A, except for the inclusion of a low-pressure (LP) turbine 130'".

As shown in FIG. 5C, the intermediate pressure hot working fluid exhausted from the IP turbine 130" is split into a working fluid stream FS 40"41 to the LP turbine 130'" and an extraction flow FS 40'" to the RHE 140. The low pressure hot working fluid exhausted from the LP turbine 130'" is exhausted as a hot, relatively dry, vapor working fluid stream FS 11 which is directed to the DCSS 100. The stream FS 11 is relatively rich in ammonia.

FIG. 5C also further details the DCSS 100. It should be noted that the DCSS 100 as shown is still a somewhat simplified depiction, but will be sufficient to those skilled in the art for purposes of this disclosure. As shown the vapor exhaust stream FS 11 is directed through an initial heat exchanger 1510*a* which extracts heat from working fluid steam FS 11, transforming the stream into a somewhat cooler rich vapor stream FS 11' which is directed to a low pressure (LP) condenser 1500*a*. The vapor stream FS 11' transfers heat to a cooling liquid stream FS 101', which is typically a cool water stream from a reservoir, such as a cooling tower river or lake. The vapor working fluid from stream FS 11' is fully condensed in the LP condenser 1500*a*, forming a rich working fluid 20*a* which is directed as a fluid stream FS 20*a* to the heat exchanger 1510*a*.

The liquid working fluid in stream FS 20*a* is partially vaporized in the heat exchanger 1510*a* and this partially vaporized working fluid is transported as stream FS 20*a*' to the separator 1520*a*. The two phase, i.e. liquid/vapor, working fluid is separated in the separator 1520*a* into a lean liquid 30*a* and a rich vapor 30*aa*. The lean liquid is directed as flow FS 30*a*' so as to be combined with the somewhat cooled vapor working fluid FS 11' exhausted from the heat exchanger 1510*a*. By combining the lean liquid flow FS 30*a*' with the still hot rich vapor flow FS 11', the temperature and more importantly the concentration of the working fluid flow FS 3011*a* to the LP condenser 1500*a* is made leaner. More particularly, the concentration of ammonia in the vapor working fluid entering the LP condenser 1500*a* is significantly reduced. Accordingly, the vapor in stream FS 3011*a* can be condensed at a lower pressure than the pressure at which the working fluid in stream FS 11', could be condensed. This in turn reduces the pressure at the outlet of the LP turbine allowing greater work to be performed in the LP turbine.

As shown, the rich vapor 30*aa* is directed from the separator 1520*a* to another of a cascading series of condensers, heat exchangers and separators. It will be recognized that the series of condensers/heat exchangers/separators, although shown as a series of three could in fact be more or perhaps even less in number. In any event, the rich vapor from the separator 1520*a* is directed as a stream FS 30*aa*' to a heat exchanger 1510*b* where it releases heat to a stream FS 20*b* formed of condensate collected in the intermediate pressure (IP) condenser 1500*b*. The somewhat cooled vapor working fluid stream FS 30*aa*" is output from the heat exchanger 1510*b* and combined with a leaner liquid working fluid stream FS 30*b*' from the separator 1520*b* to form a somewhat leaner vapor stream FS 30*ab* which is directed to the IP condenser 1500*b*. Stream FS 30*ab* is condensed by releasing heat to a stream FS 101' from the reservoir to form the condensate 20*b*.

The condensate 20*b* is directed as a liquid stream FS 20*b* to the heat exchanger 1510*b*. The heat released from the vapor stream FS 30*aa*' partially vaporizes the working fluid in stream FS 20*b* in the exchanger 1510*b*. This two phase working fluid is then passed as stream FS 20*b*' to the separator 1520*b* which separates the stream into a rich vapor 30*bb* and lean liquid 30*b*. As discussed above the lean liquid 30*b* is transported as a liquid stream FS 30*b*' so as to be mixed with the rich vapor stream FS 30*aa*' leaving the heat exchanger prior to entering the I0P condenser 1500*b*. The rich vapor 30*bb* is transported as a vapor stream 30*bb*' to the heat exchanger 1510*c*.

In the exemplary configuration shown, the rich vapor stream FS 30*bb*' enters the heat exchanger 1510*c*. The vapor stream FS 30*bb*', releases heat to the lean condensate stream FS 20*c* from the high pressure (HP) condenser 1500*c* in the heat exchanger 1510*c*. The somewhat cooled vapor stream FS 30*bb*' is combined, downstream of the heat exchanger 1510*c* but upstream of the HP condenser 1500*c* with a lean liquid stream FS 30*c*' from the separator 1520*c* to form a somewhat leaner vapor working fluid stream FS 30*bc*".

The combined stream FS 30*bc*" is directed to the condenser and condensed by cooling reservoir stream FS 101' to form the condensate 20*c*. The condensate 20*c* is a rich liquid working fluid which forms the rich liquid stream FS 20 to the RHE 140. The condensate 20*c* also is directed as a stream FS 20*c* to the heat exchanger, where it is partially vaporized by the heat released from stream FS 30*bb*' before forming the two phase working fluid stream FS 20*c*' to the separator 1520*c*. The separator separates the two-phase working fluid into a rich vapor 30*cc* and lean liquid 30*c*. A stream FS 30*cc*" of lean liquid 30*c* and a rich vapor stream FS 30*cc*' from the separator 1520*c* are provided to a further heat exchanger/separator 1530 to form the lean hot vapor stream FS 30 which is provided by the DCSS 100 to the RHE 140. The operation of the heat exchanger/separator 1230 is well understood by those skilled in the art and is therefore not further detailed herein.

As mentioned above, conventional Kalina cycle power generation systems are designed as constant pressure self-balancing systems, and hence lack active control of the fluid flows within the system. However, as also previously noted, while this may be satisfactory under test conditions, in a commercial operating environment power generation systems occasionally encounter conditions which are outside of the system design specifications. Such conditions are likely to make it difficult if not impossible for conventional Kalina power generation systems to accomplish the necessary self balancing in the required time frame to avoid operational problems. For example under certain conditions, the conventional self balancing Kalina cycle power generation system could produce insufficient condensate at HP condenser 1500*c* to satisfy the demands for rich working fluid stream FS 20 without completely draining the condenser.

OBJECTIVES OF THE INVENTION

Accordingly, it is an object of the present inventions to provide a multi-component working fluid vapor generation system, such as a Kalina cycle power generation system, capable of proper operation under conditions which vary from normal operating conditions.

It is a further object of the present invention to provide a multi-component working fluid vapor generation system, such as a Kalina cycle power generation system, capable of proper operation under varying load demands.

It is another object of the present invention to provide a multi-component working fluid vapor generation system, such as a Kalina cycle power generation system, capable of proper operation in a sliding pressure mode.

It is a still further object of the invention to provide a multi-component working fluid vapor generation system, such as a Kalina cycle power generation system, which is environmentally safe to operate.

Additional objects, advantages, novel features of the present invention will become apparent to those skilled in the art from this disclosure, including the following detailed description, as well as by practice of the invention. While the invention is described below with reference to a preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY OF INVENTION

In accordance with the present invention a power generation system includes a turbine which receives a first working fluid and expands the first working fluid to produce power. The first working fluid is typically a superheated vapor and is preferably a multi-component working fluid, such as an ammonia-water working fluid of a Kalina cycle power generation system.

A heat exchanger, which could form part of the RHE of a Kalina cycle power generation system, receives the expanded first working fluid and a second working fluid. The expanded first working fluid is beneficially a hot working fluid of relatively low concentration of the low temperature boiling component, e.g., ammonia in a Kalina cycle, of a multicomponent working fluid. That is, the expanded first working fluid is beneficially a hot lean working fluid. The second working fluid is preferably a cold working fluid of relatively high concentration of the low temperature boiling component of the multicomponent working fluid and could, for example, be received from a DCSS of a Kalina cycle power generation system. That is, the second working fluid is preferably a cold rich working fluid.

The heat exchanger transfers heat from the expanded first working fluid to the second working fluid, thereby heating the second working fluid, e.g., vaporizing and/or superheating the second working fluid, and condensing the expanded first working fluid. Flow tubes, for example boiler tubular walls or a furnace superheater are provided for receiving the condensed first working fluid, and transferring heat from a heat source to the condensed first working fluid, thereby heating, e.g., vaporizing and superheating, the condensed working fluid to form the first working fluid. The heat source may be a direct fired, fluidized bed or waste heat source. A valve or other flow adjusting device may be used to regulate the rate of flow of the second working fluid to the heat exchanger.

Preferably, a chamber holds the condensed first working fluid and a sensing device, such as a fluid level indicator, identifies the amount of condensed first working fluid in the chamber. In such a case, the valve or other flow adjusting device can be operated to adjust the rate of flow so as to correspond with the identified amount of condensed first working fluid, i.e., provide feedback control.

A control device, such as a system controller or specialized control device, can be used to determine the appropriate flow rate for the second working fluid based upon the identified amount of condensed first working fluid. The control device may, based upon the identified amount of condensed first working fluid, determine that the amount of condensed working fluid in the chamber is increasing or decreasing. This increase or decrease could, for example, be due to a change in the load demand, and hence the system power output requirements, or due to some other change in operating or environmental condition(s). If it is determined that the amount of condensed working fluid is increasing or decreasing, the existing flow rate must be adjusted to a new flow rate in order to avoid flooding or draining the chamber. Accordingly, the control device further determines a rate of change in the amount of condensed working fluid and, based upon the determined rate of change, the flow rate adjustment required to establish a new flow rate so as to avoid flooding or draining the chamber. If desired, the control device can also determine the required new flow rate itself. The valve is operated to adjust the rate of flow to equal the new flow rate.

According to other aspects of the invention, the sensing device may be configured to generate signals to the control device which identify the amount of condensed working fluid in the chamber at different points in time. The control device is configured to process the signals to determine the required flow rate adjustment and, if desired, the new flow rate itself. The control device may also generate a signal, corresponding to the new flow rate, to the valve which in response, operates to adjust the rate of flow to equal the new flow rate.

According to still other aspects of the invention, feed forward control can be provided. For example, a control device of the type previously described could, if desired, be configured to process information corresponding to a power demand to determine the required flow rate adjustment and, if desired, the new flow rate for the second working fluid.

It should be noted that by simply regulating the flow rate of the flow of the second working fluid to the heat exchanger, the amount of first working fluid flowing to the turbine and the amount of condensed first working fluid flowing to the flow tubes is also regulated. Further, it will be recognized that rather than adjusting the cold rich second working fluid flow, a valve could be used to adjust the hot lean working fluid flow from the turbine. However, as will be understood by those skilled in the art, because of the substantial volume and temperature of the flow from the turbine, this would require a significantly larger and much more expensive valve than that required for adjusting the flow of the cold rich stream to the heat exchanger.

In accordance with a further embodiment of the present invention, a drum is provided to initially receive and hold the condensed first working fluid prior to the fluid entering the flow tubes. As in conventional power generation systems, the drum directs the condensed first working fluid to the flow tubes. In this embodiment, a second valve is provided for regulating the rate of flow of the condensed first working fluid to the drum. Another sensing device may be provided to identify the amount of condensed first working fluid in the drum at different points in time. The second valve is operated to adjust the rate of flow to the drum so as to correspond with the identified amount of condensed first working fluid in the drum.

The same or a different control device can be used to determine the required flow rate adjustment and, if desired, the new flow rate for the condensed first working fluid based upon the identified amount of condensed first working fluid in the drum. The second valve can be operated to adjust the rate of flow to the drum to equal the new flow rate. Here again, this other sensing device can be configured to generate a signal to the control device representing the identified amount of condensed first working fluid in the drum. The control device can be configured to process the signal to determine the appropriate adjustment to the existing flow rate or the required new flow rate to avoid flooding or draining the drum. The control device can also generate a signal to the second valve corresponding to the desired flow rate. The second valve operates in response to the signal to adjust the rate of flow of the condensed first working fluid to equal the new flow rate.

Hence, according to the present invention, a power generation system is operable in a first state of substantial equilibrium with the stream of second working fluid being received by the heat exchanger at a first flow rate, and in a second state of substantial equilibrium with the stream of second working fluid being controlled so as to be received at a second flow rate, different than the first flow rate. The flow system preferably operates in the first state of equilibrium with the stream of condensed first working fluid received at the turbine at a third flow rate, the stream of expanded first working fluid received at the heat exchanger at a fourth flow rate and the stream of condensed first working fluid received at the flow tubes or drum at a fifth flow rate, all corresponding to the first flow rate of the second working fluid being received at the heat exchanger. In the second state of equilibrium one or more of the flow rates of the stream of first working fluid, the stream of expanded first working fluid and the stream of condensed first working fluid is received at a changed flow rate corresponding to the second flow rate of the second working fluid.

In a feedback flow control configuration, the system operates, subsequent to system operation in the first state of substantial equilibrium and prior to system operation in the second state of substantial equilibrium, in a state of non-equilibrium. In this latter state, one or more of the stream of first working fluid, the stream of expanded first working fluid, and the stream of condensed first working fluid may be received at a flow rate different than its flow rate during operation in the first state of equilibrium. Accordingly, the flow rate of the second working fluid is adjusted to bring the system to the second state of substantial equilibrium after being in a state of non-equilibrium. That is, the flow rate of the stream of second working fluid is adjusted subsequent to system operation in the first state of substantial equilibrium and prior to system operation in the second state of substantial equilibrium, to increase or decrease the rate of flow to correspond to the rates of flow of the other streams.

In a feedforward control configuration, prior to the system operating in a state of non-equilibrium, the rate of flow of the stream of second working fluid is adjusted to the second flow rate to correspond to a subsequent change in the rates of flow of the other streams. These subsequent changes in the flow rates of one or more of the other streams will ultimately result in the system operating at the second state of substantial equilibrium.

In accordance with another embodiment of the invention, a power generation system includes a turbine for receiving a stream of first working fluid. Preferably the first working fluid is formed of multiple components, such as ammonia and water as used in a Kalina cycle. Typically, the received first working fluid stream is a superheated vapor stream.

The turbine expands the first working fluid to produce power. The expanded first working fluid is beneficially a relatively hot fluid with a low concentration of, i.e., being lean in, a low boiling point component, e.g., ammonia, of a multicomponent working fluid. The expanded first working fluid is exhausted from the turbine to a regenerative heat exchanger.

The regenerative heat exchanger transfers heat from the expanded first working fluid exhausted from the turbine to a stream of second working fluid, which is also preferably formed of the multiple components but is a cold fluid having a high concentration of, i.e., being rich in, the low boiling point component, e.g., ammonia, of the multicomponent fluid. The stream of second working fluid is thereby subjected to an initial heating, which preferably vaporizes and superheats the fluid, while, at the same time, condensing the expanded first working fluid.

The regenerative heat exchanger combines a stream of the condensed first working fluid, typically a low volume steam, with the initially heated stream of second working fluid to cool, e.g., superheat, the fluid. Additional heat is then transferred from the expanded first working fluid to the cooled stream of second working fluid to further heat the cooled stream to form a heated stream of second working fluid. Preferably this later heated stream of second working fluid is heated so that the second working fluid is slightly superheated and fully saturated.

A boiler vaporizes another stream of the condensed first working fluid, typically a high volume steam which forms a substantial portion of the boiler feed stream. A superheater superheats the vaporized stream of first working fluid and the later heated stream of second working fluid to form the stream of first working fluid received by the turbine.

The system also preferably includes a first valve for adjusting the rate of flow of the stream of second working-fluid to the regenerative heat exchanger, and a second valve for adjusting the rate of flow of the stream of condensed first working fluid which is combined with the initially heated stream of second working fluid. A control device of the type previously described is also advantageously provided for generating a signal to the first valve, responsive to which the first valve operates to adjust the rate of flow of the second working fluid stream and thereby regulate the availability of the condensed first working fluid.

If so desired, the controller may also generate a signal to a second valve, responsive to which the second valve operates to adjust the rate of flow of the condensed first working fluid which is combined with the initially heated second working fluid and thereby regulate a state of the heated stream of second working fluid. This later control can be used to provide precise regulation of the temperature and pressure of the heated second working fluid which is directed to the superheater, and to thereby ensure that, for example, this fluid is in the desired state, e.g., slightly superheated and fully saturated. From a heat flow balance standpoint, the flow rates of the stream of second working fluid to the regenerative heat exchanger and of stream of condensed first working fluid to be combined with the initially heated steam of second working fluid are interrelated. Accordingly, the respective flow rates are typically and advantageously set to correspond with each other.

In accordance with still other aspects of the invention, a sensing device, preferably a temperature and pressure sensor, is provided to generate a signal representing the current state of the heated second working fluid being directed from the regenerative heat exchanger to the superheater. The control device can be configured to control adjustments to the rate of flow of the first stream of condensed first working fluid to regulate the state of the heated stream of second working fluid, e.g., to change the current state to a desired state, based upon signals received from the sensing device.

Another sensing device, such as a level indicator, can also be provided to generate a signal representing the current amount of condensed first working fluid. The control device can be further configured to control adjustments to the rate of flow of the stream of second first working fluid to regulate the availability of the condensed first working fluid, e.g., change the amount of condensed working fluid in a condensation chamber, based upon signals received from this later sensing device.

In a further embodiment of the invention, the power generation system includes a plurality of condensing heat exchangers. Each exchanger typically has a condensing heat exchange element for transferring heat, and a condensate collection chamber. Each condensing heat exchanger receives working fluid, most commonly a portion of the expanded working fluid from a turbine. The working fluid is preferably formed of multiple components, such as ammonia and water as used in a Kalina cycle. The exchanger transfers heat from, and thereby condenses, the received expanded working fluid.

A mechanism is provided to regulate the availability of condensed working fluid, e.g., the amount of condensed working fluid collected in the condensate collection chamber, at one or more of the condensing heat exchangers. Preferably, the availability of condensed working fluid is regulated by regulating the concentration of a component, for example a lower boiling point component, in the working fluid received by one or more of the condensing heat exchangers.

The available condensed working fluid may be directed to a vapor generator. For example, the vapor generator could be a furnace having a boiler and/or superheater, such as a conventional furnace in a Kalina cycle power generation system. The condensed working fluid is evaporated in the vapor generator to form a stream of vaporized working fluid to the turbine.

In one configuration, the control mechanism includes one or more valves. Flow paths, typically fluid tubes, direct a respective portion of the expanded working fluid to each of the condensing heat exchangers. Each of the valves is associated with a respective one of the condensing heat exchangers and operates to adjust the flow of the condensed working fluid from its associated exchanger, typically from the condensing chamber.

Beneficially, each of the valves individually adjusts the rate of flow of the condensed working fluid from its associated exchanger. By adjusting the rate of flow of the condensed working fluid from each of the heat exchangers, the availability of the condensed working fluid at each of the heat exchangers can be regulated. In certain implementations it may be advantageous to associate valves with all but one of the condensing heat exchangers, while in other cases, it may be preferably to have valves associated with all the condensing heat exchangers.

In accordance with yet other aspects of the invention, one or more sensors are also provided to detect the amount of condensed working fluid in an associated condensing heat exchanger and to generate signals representing the detected amount. A controller receives the signal or corresponding information and generates a signal corresponding to the detected amount. Each valve operates to adjust the flow in accordance with the signal corresponding to the detected amount of condensed working fluid in its associated condensing heat exchanger. Hence, the operation of each valve controls the amount of condensed working fluid collected in the chamber associated with its associated condensing heat exchange elements.

In yet another configuration of the invention, each of one or more flow paths, directs a flow of the working fluid to a respective one of the condensing heat exchangers. The control mechanism includes one or more valves, each associated with a respective one of the flow paths. Each valve is operable to adjust the flow of the working fluid directed by its associated flow path and thereby regulate the working fluid received by each of the condensing heat exchangers.

Beneficially, the working fluid received by each of the condensing heat exchangers is formed of two or more streams of working fluid, at least one having a different concentration of a component, e.g., a lower boiling point component, of the working fluid than the others. Each of the flow paths directs the flow of the different concentration stream to its associated condensing heat exchanger. Each valve operates to adjust the rate of flow of the stream directed by its associated flow path to regulate the concentration of the applicable component in the working fluid received by the associated condensing heat exchanger.

A controller may be provided to receive information corresponding to a pressure change within the system. The controller generates a signal to each of the valves, responsive to which each valve operates to adjust the flow of the working fluid directed by its associated flow path.

In yet another embodiment of the invention the level of liquid within a drum of a multi-component working fluid vapor generator is controlled by having at least one sensor generating signals representing the current pressure and temperature within the drum. A processing device, such as the processor within a system or local controller will typically receive these signals via an input port, and process the recovered signals to generate signals corresponding to a working fluid flow adjustment amount.

The generated signals are transmitted, via an output port, to a valve, e.g., a motorized valve, which operates responsive to the transmitted signals to adjust the rate of flow of working fluid to the drum inlet by the adjustment amount. Preferably, the valve adjustment is automatically performed responsive to the transmitted signals.

Preferably, the processing device determines the density of working fluid within the drum based upon the received current temperature and pressure information, and generates a corresponding signal. The processing device also beneficially determines a delta-pressure, i.e., a pressure differences between the current pressure and a prior pressure and generates a corresponding signal. The prior pressure will typically be the most recent previously sensed pressure available to the processing device. The processing device may then process these signals to determine the current level of liquid within the drum based upon the delta-pressure and the density.

In accordance with other aspects of the invention, the processing device compares the current level of liquid with a value, for example a prior liquid level, a predetermined set point or a set point computed on the basis of operational or environmental consideration(s). The processing device can, thereby identify an amount of level adjustment required and generate a signal representative thereof. The processing device then processes this signal to determine the working fluid flow adjustment amount.

In accordance with a further embodiment of the invention, a power generation system includes a turbine, condensing elements, a regenerative heat exchanger, a vapor generator, and one or more mechanisms to regulate the flow of condensed portions of multicomponent working fluid.

The turbine expands a vapor multicomponent working fluid to produce power. The multicomponent working fluid has a higher boiling temperature component, such as water, and a lower boiling temperature component, such as ammonia. The multicomponent working fluid could, for example, be an ammonia and water mixture as conventionally used in a Kalina cycle.

The condensing elements preferably include high pressure, intermediate pressure and low pressure condensers and could form part of the DCSS of a Kalina cycle power generation system. Each condensing element condenses a respective portion of the expanded multicomponent working fluid. One of the condensed portions of multicomponent working fluid, typically that condensed by a low pressure condensing element, is a lean multicomponent working fluid having a relatively low concentration of the lower boiling temperature component, e.g., ammonia, of the multicomponent working fluid, such as the lean hot stream formed in the DCSS of a Kalina cycle power generation system.

The regenerative heat exchanger transfers heat from the lean multicomponent working fluid to a rich multicomponent working fluid having a relatively high concentration of the lower boiling temperature component of the multicomponent working fluid to thereby cool the lean hot multicomponent working fluid. The vapor generator, which could be a boiler and/or superheater, vaporizes the cooled multicomponent working fluid to form the vapor multicomponent working fluid which is fed to the turbine.

The one or more mechanisms, e.g., valves, regulate the flow, typically the rate of flow, of the condensed portions of multicomponent working fluid from the condensing elements, other than the condensed portion of multicomponent working fluid forming the lean multicomponent working fluid. In a typical valve arrangement, each valve is operable, automatically or manually, to regulate the flow of a respective condensed portion of multicomponent working fluid, other than the condensed portion forming the lean multicomponent working fluid.

Preferably, the mechanisms regulate all the flows of the condensed portions of multicomponent working fluid, other than the flow of the condensed portion of multicomponent working fluid forming the lean multicomponent working fluid. The mechanisms regulate the flow so as to regulate the amount of the condensed portion of multicomponent working fluid available to form the lean multicomponent working fluid.

Beneficially, one or more detectors are provided. Each detector detects the amount of a respective one of the condensed portions of multicomponent working fluid. Each of the mechanisms regulates the flow of one of the condensed portions of multicomponent working fluid, other than the condensed portion forming the lean multicomponent working fluid, based upon the detected amount of a condensed portion of multicomponent working fluid.

In accordance with aspects of the invention, the detector detects the amount of the condensed portion of multicomponent working fluid forming the lean multicomponent working fluid. A mechanism then regulates the flow of another condensed portion of multicomponent working fluid based upon the detected amount of the condensed portion forming the lean multicomponent working fluid.

In accordance with other aspects of the invention, one or more controllers are provided. For example, a single system controller or multiple local controllers could be utilized. The controller(s) receive information representing the amount of each of the respective condensed portions of multicomponent working fluid. This information may or may not include information representing the amount of the condensed portion of multicomponent working fluid which will form the lean multicomponent working fluid. The controller(s) generate signals, corresponding to the received information, which are transmitted to the valve(s). For example, signals may be generated and transmitted to each valve which regulates the flow of the respective condensed portion of multicomponent working fluid to which the received information relates. The valves are preferably motorized and each valve operates to regulate the flow of a respective condensed portion of Multicomponent working fluid based upon the generated signals which are transmitted to that valve.

Alternatively, signals may be generated and transmitted to each valve which regulates the flow of a respective condensed portion of multicomponent working fluid to which the received information does not relate. For example, the information may represent the amount of the condensed portion of multicomponent working fluid available to form the lean multicomponent working fluid and the controller may generate a corresponding signal that is transmitted to the valve which regulates another portion of multicomponent working fluid. Hence, the valve or other regulating mechanism operates to regulate the flow of a condensed portion of multicomponent working fluid in accordance with signals corresponding to the amount of another condensed portion of multicomponent working fluid.

In accordance with still other aspects of the invention, multiple detectors are provided. Each detects the amount of a respective one of the condensed portions of multicomponent working fluid. For example, one detector might detect the amount of the condensed portion of multicomponent working fluid forming the lean multicomponent working fluid and another detector might detect the amount of another condensed portion of multicomponent working fluid. A controller(s) receives information representing the amounts detected by the detectors. In a first mode of operation, the controller(s) generates signals which are transmitted to a valve based upon the information received from one of the detectors, while in a second mode of operation, the controller(s) generates signals to the same valve based upon the information received from another of the detectors. The valve operates to regulate the flow of a condensed portion of multicomponent working fluid in accordance with the first signals in the first mode of operation and the second signals in the second mode of operation.

According to still other aspects of the invention, each of the condensing elements may each include a heat exchanger for receiving and condensing vaporized multicomponent working fluid, a chamber for collecting the condensed multicomponent working fluid, and another heat exchanger to revaporize the condensed multicomponent working fluid. The multicomponent working fluid condensed by one of the condensing elements, preferably a high pressure condensing element, forms a condensed lean multicomponent working fluid having a predetermined relatively low concentration of the lower boiling temperature component of the multicomponent working fluid. This condensed lean working fluid could, for example, form the lean hot stream provided to the RHE of a Kalina cycle system.

Respective flow tubes direct the flow of revaporized multicomponent working fluid from the condensing element at which it is vaporized to a respective one of the other of the plurality of condensing elements. Hence, a cascading series of, condensing elements is provided. Each of a plurality of valves is associated with a respective one of the condensing elements. None of the valves, however, is associated with the condensing element which condenses the lean multicomponent working fluid. Each valve is operable to regulate the flow of the condensed multicomponent working fluid from the chamber to the revaporizing heat exchanger of its associated condensing element.

By appropriate operation of the valves the amount of the multicomponent working fluid collected in the chamber of the condenser element in which the lean multicomponent working fluid is condensed can also be regulated. Thus, by regulating the flow of condensed working fluid from certain condensing elements, the amount of lean multicomponent working fluid which is condensed in another element can also be regulated, thereby regulating the amount of the lean multicomponent working fluid available, for example, to the RHE of a Kalina cycle system.

In a typical operation, a lower pressure condensing element condenses a first portion of the expanded multicomponent working fluid from the turbine. A downstream, higher pressure element condenses a second portion, e.g., a revaporized portion of the condensed first portion of expanded multicomponent working fluid, to form the lean hot multicomponent working fluid. The flow of the condensed first portion of expanded multicomponent working fluid from the lower pressure condensing element is regulated, e.g., based upon the amount of the condensed first portion or the condensed second portion of expanded multicomponent working fluid, to adjust the amount of the second portion of expanded multicomponent working fluid condensed in the higher pressure condensing element. In a typical configuration having a cascading series of condensing elements, the flow of the other portions of expanded multicomponent working fluid from the other condensing elements is also regulated to adjust the amount of the second portion of expanded multicomponent working fluid.

As will be recognized by those skilled in the art, parallel heat exchanges can be utilized in a regenerative heat exchanger, such as the RHE of a Kalina cycle system, or a distiller/condenser, such as the DCSS of a Kalina cycle system. However, pressure imbalances in parallel heat exchangers may occur due, for example, to operating condition anomalies, as are well understood in the art. Such pressure imbalances can lead to the working fluid output from the parallel heat exchangers failing to meet the required specification. In yet another embodiment of the invention, such pressure imbalances are reduced if not eliminated altogether.

Conventionally, parallel heat exchangers have a first flow path, typically formed of one or more flow tubes, which splits a relatively cold multicomponent working fluid flow, normally a liquid or liquid/vapor working fluid, into a first flow and a second flow. One heat exchanger vaporizes at least a portion of the first fluid flow and another heat exchanger vaporizes at least a portion of the second flow, by simultaneously directing the flows so as to absorb heat from respective hot fluid flows. Another flow path combines the vaporized first and second flows.

To address pressure imbalances which may occur, multiple valves are provided. The valves are operable to adjust the first and second flows, e.g., the flow rates, to substantially equalize the pressure of the vaporized first and second flows leaving the respective heat exchangers. Advantageously, one valve is opened to increase one of the flows while the other valve is concurrently closed to decrease the other flow. The valves are preferably motorized and capable of being quickly adjusted to regulate the first and second flows.

According to other aspects of the invention, multiple sensors are provided to detect the rate of the first flow and the rate of the second flow. The valves are then operated to adjust the first flow based upon its detected rate and to adjust the second flow based upon its detected rate. A local or central controller may also be provided for receiving, via input ports, flow signals representing the detected rates of the first and second flows and to transmit, via output ports, control signals to the first valve corresponding to the received signals representing the first flow rate and control signals to the second valve corresponding to the received signals representing the second flow rate. The valves automatically adjust the flows based upon the transmitted signals. The controller will generally include a processor which processes signals from the sensors to generate the transmitted signals. The transmitted signals preferably represent the amount of adjustment required to the current flows which the processor determines will result in the vaporized first and second flows having a substantially equal pressure.

In accordance with still another embodiment of the invention, the temperature of superheated vapor is controlled. The system includes a turbine, distiller/condenser, boiler and superheater. The turbine expands the superheated multicomponent working fluid, such as the ammonia/water working fluid of a Kalina cycle, received from the superheater to produce power. The distiller/condenser transforms the expanded working fluid into a first concentration working fluid, having a first concentration of one of the multiple components, e.g., ammonia, and a second concentration working fluid, having a different concentration of the component. Preferably, the first concentration working fluid is relatively lean in the component and the second concentration working fluid is relatively rich in the component. The boiler vaporizes a feed multicomponent working fluid and the superheater further heats the vaporized working fluid to form the superheated working fluid.

A sensor detects the temperature of the vaporized working fluid prior to entering the superheater. Respective flow paths, typically formed of flow tubes, direct the first and the second concentration working fluids from the distiller/condenser. Another flow path concurrently receives the first and second concentration working fluids from the respective flow paths such that the first and second concentration working fluids are combined to form a third concentration working fluid which may have the same concentration of the component as, or a different concentration of the component than, the feed working fluid. A sprayer is provided to spray the third concentration working fluid into the vaporized working fluid upstream of the superheater to adjust the temperature of the vaporized working fluid. In this way, the temperature of the superheated working fluid is regulated thereby avoiding damage to the turbine.

Preferably, valves are provided to regulate the flows of the first and second concentration working fluids directed by the respective flow paths. The valves are operable to regulate the flows to obtain the desired concentration of the component in the third concentration working fluid.

A local or central controller may be provided to process signals representing the detected temperature of the vaporized working fluid which are generated by the sensor. The controller processes these signals to generate signals which correspond to an adjustment amount in the flow of the first concentration working fluid and other signals which correspond to an adjustment amount in the flow of the second concentration working fluid. Each valve operates in accordance with respective generated signals to regulate the flows of the first and second concentration working fluids.

In yet another embodiment of the invention, a power generator working fluid recovery subsystem is provided for capturing discharged working fluid which includes a hazardous component. The system includes a container, which could be a tank or vessel of virtually any type, which holds a liquid, e.g., water, in which the hazardous component, e.g., ammonia, is soluble. The container receives discharged working fluid directed from vents, valves, drains etc. by one or more discharge lines, which will typically be flow tubes. A sensor is beneficially provided to detect the concentration of the hazardous component in the mixture. Using the subsystem, working fluid which includes a hazardous component and is discharged from a power generating system can be captured and disposed of in an environmentally sound manner.

According to other aspects of the invention, a control device, which could be a local or system controller, determines if the detected concentration exceeds a threshold concentration. If so a liquid supply, typically a flow tube connected to a valved fresh liquid supply directs liquid to the mixture within the container. This may be done as the container is being fully or partially emptied of the high concentration mixture, or without emptying the container so as to simply dilute the high concentration mixture. Beneficially, an outlet flow line is also provided to direct the mixture from the container if the threshold is exceeded. A second container is preferably provided to receive the mixture directed by the outlet flow line.

In accordance with still other aspects of the invention, a vent provides an outlet for vapor, which is non-soluble in the liquid, from the container. It may be desirable or necessary to provide a second sensor to detect the hazardous component in a vapor state within the container. In such a case, it will be advantageous to provide a sprayer for applying a spray, preferably in the form of a mist, of the liquid to which the vapor component will attach itself so it can be combined with the mixture.

In accordance with another embodiment of the invention, a Kalina cycle power generation system, includes a turbine which expands a vaporized binary working fluid to produce power. A regenerative heat exchanger transforms the expanded binary working fluid into a feed binary working fluid. A vapor generator vaporizes the feed binary working fluid. One or more valves are operated to adjust the binary working fluid flow within the regenerative heat exchanger. The valves provide an active regulation of the flow within the regenerative heat exchanger.

Beneficially, a controller controls operation of the valve (s) to regulate the binary working fluid flow and thereby balance the flow of the expanded binary working fluid from the turbine with the flow of the feed working fluid from the regenerative heat exchanger. The controller, if desired, can control the flow within the regenerative heat exchanger so as to correspond with variations in system operating conditions, e.g., changes in load, pressure, etc.

According to other aspects of the invention, the regenerative heat exchanger receives and vaporizes heat absorbing binary working fluid. The controller operates to direct operation of the valve(s) to adjust the binary working fluid flow such that the vaporized heat absorbing binary working fluid is in a pure vapor state. If the vapor generator includes a drum, the controller can also be configured to direct operation of the valve(s) to adjust the binary working fluid flow based upon a temperature within the drum.

In accordance with another embodiment of the invention, a Kalina cycle power generation system, includes a turbine configured to expand a vaporized binary working fluid to produce power. Multiple heat exchanging condensers are provided. The condensers are typically part of a distiller/condenser which is commonly referred to as a distillation and condensation subsystem (DCSS). The condensers transform a first portion of expanded binary working fluid into first and second concentration binary working fluids, each having a different concentration of a component, e.g., ammonia, of the binary working fluid. A regenerative heat exchanger transforms the first concentration binary working fluid into a vaporized binary working fluid and the first portion of expanded binary working fluid and into a feed binary working fluid. A vapor generator vaporizes the feed binary working fluid. One or more valves are provided to adjust the binary working fluid flow in the multiple heat exchangers.

Preferably, a controller directs the operation of the valve (s) to maintain a predetermined or predefined relationship between some or all of the multiple heat exchangers. For example, it may be desirable to maintain a predetermined relationship between the level of condensation in or the amount of the first portion of the expanded working fluid directed to respective ones of the multiple heat exchangers. The controller beneficially directs the operation of the valve(s) to maintain the desired relationship between all but one of the multiple heat exchangers. The controller may direct the operation of the valve(s) in first and second modes to respectively maintain the desired relationship between the multiple heat exchangers during variations in operating conditions occurring at a relatively fast first rate and at a second slower rate.

According to still another embodiment of the invention, a Kalina cycle power generation system includes a turbine which expands a superheated binary working fluid to produce power. The distiller/condenser transforms a first portion of the expanded binary working fluid into first and second concentration binary working fluids, each having a different concentration of a component, e.g., ammonia, of the binary working fluid.

A regenerative heat exchanger transforms the first concentration binary working fluid into a vaporized binary working fluid and a second portion of expanded binary working fluid and into a feed binary working fluid. A vapor generator vaporizes the feed binary working fluid. A flow inlet directs the second concentration binary working fluid into the vaporized feed fluid to form the superheated binary working fluid. One or more valves are operated to adjust the flow of binary working fluid within the distiller/condenser and thereby regulate the temperature of the superheated binary working fluid.

Preferably, a controller directs the operation of the valve (s) to adjust the binary working fluid flow so as to regulate the temperature of the superheated binary working fluid. In this regard, the controller may direct the operation of the valve(s) to adjust the binary working fluid flow either to match the concentrations of the feed binary working fluid and the second concentration binary working fluid or to ensure that the concentrations of the feed binary working fluid and the second concentration binary working fluid are different.

BRIEF DESCRIPTION OF DRAWINGS

FIG. 7C(1) depicts one configuration for the valve arrangement of FIG. 7C to provide turbine extraction flow control.

FIG. 7C(2) depicts another configuration for the valve arrangement of FIG. 7C to provide turbine extraction flow control.

DETAILED DESCRIPTION OF PREFERRED EMBODIMENT OF THE INVENTION

As has been discussed above and with reference to FIGS. 5A and 5B, in order for a Kalina cycle power generation system to be used in commercial implementations, the system must provide the superheated vapor flow needed by the TGSS 130 to generate the required power to meet the load demand, while at the same time providing the necessary feed fluid flow to the boiler to cool the boiler tubes 142*a*, even during unusual operational and/or environmental conditions which occasionally arise in commercially operating power generation systems.

More particularly, a Kalina cycle power generation system used in a commercial implementation must be operable even when subjected to unanticipated operating conditions such as operation during periods when only out of specification fuel grades are available for generating process heat, when the ambient temperature, humidity and atmospheric pressure are extreme, and/or when unusually large and/or quick swings in load demand occur. That is, the system must be balanced so as to provide sufficient vapor flow FS 40 to the TGSS 130 and sufficient feed fluid 57 to the boiler tubes 142*a* even during abnormal conditions which occasionally are experienced but are difficult to predict and design for in commercially implemented power generation systems.

Thus, in a Kalina cycle power generation system, it is imperative that there be enough superheated working fluid available to provide the amount of working fluid FS 40 needed to drive the TGSS 130 to meet the load requirement and enough liquid or mixed liquid/vapor working fluid available to provide the amount of feed fluid FS 57 needed to cool the boiler tubes 142*a*, so as to provide the proper heat/energy/mass balances, even during abnormal operating conditions, such as those described above.

Figure 7A:
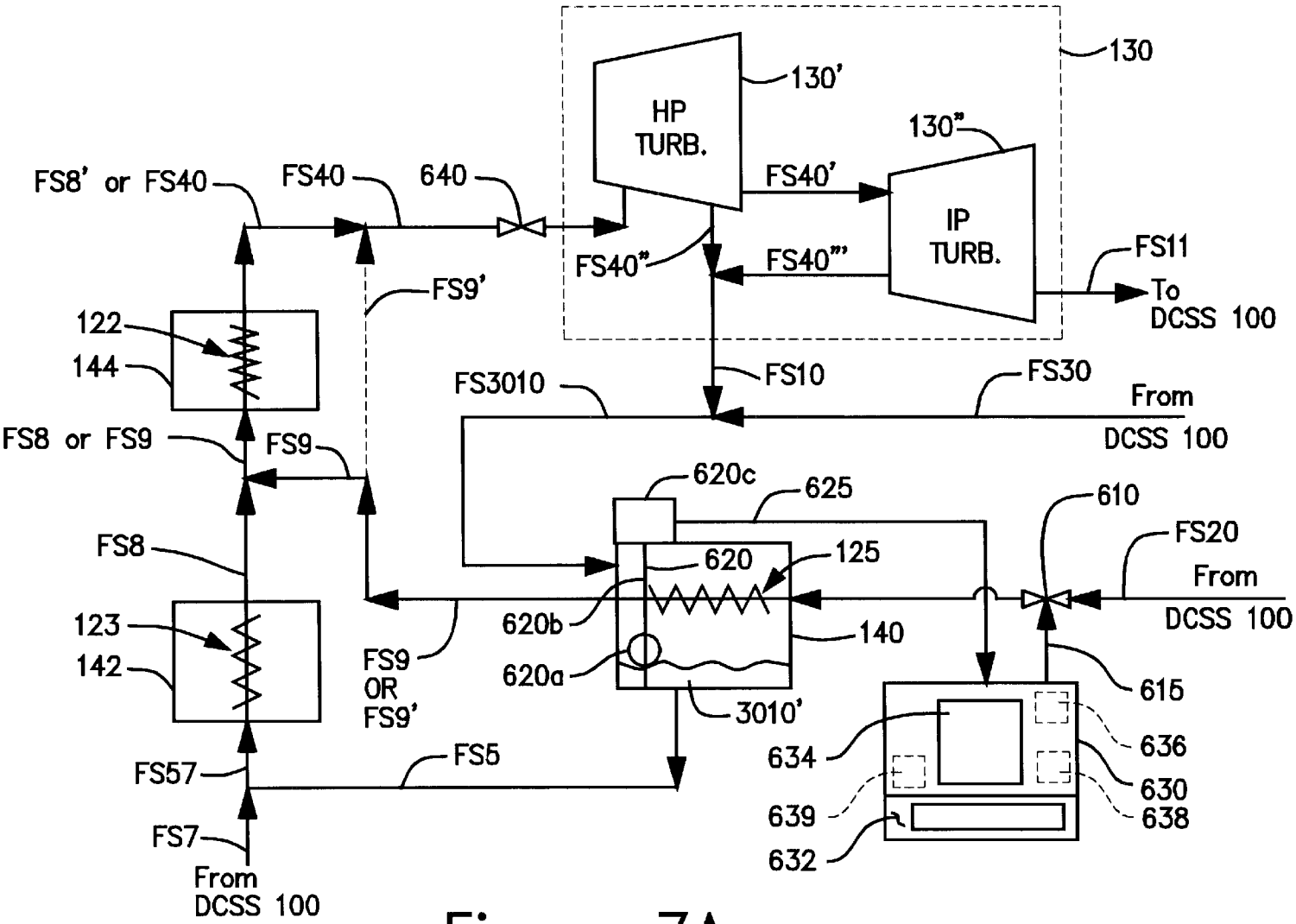
FIG. 7A depicts a Kalina cycle power generation system in a once-through flow configuration in accordance with the present invention.
Figure 7B:
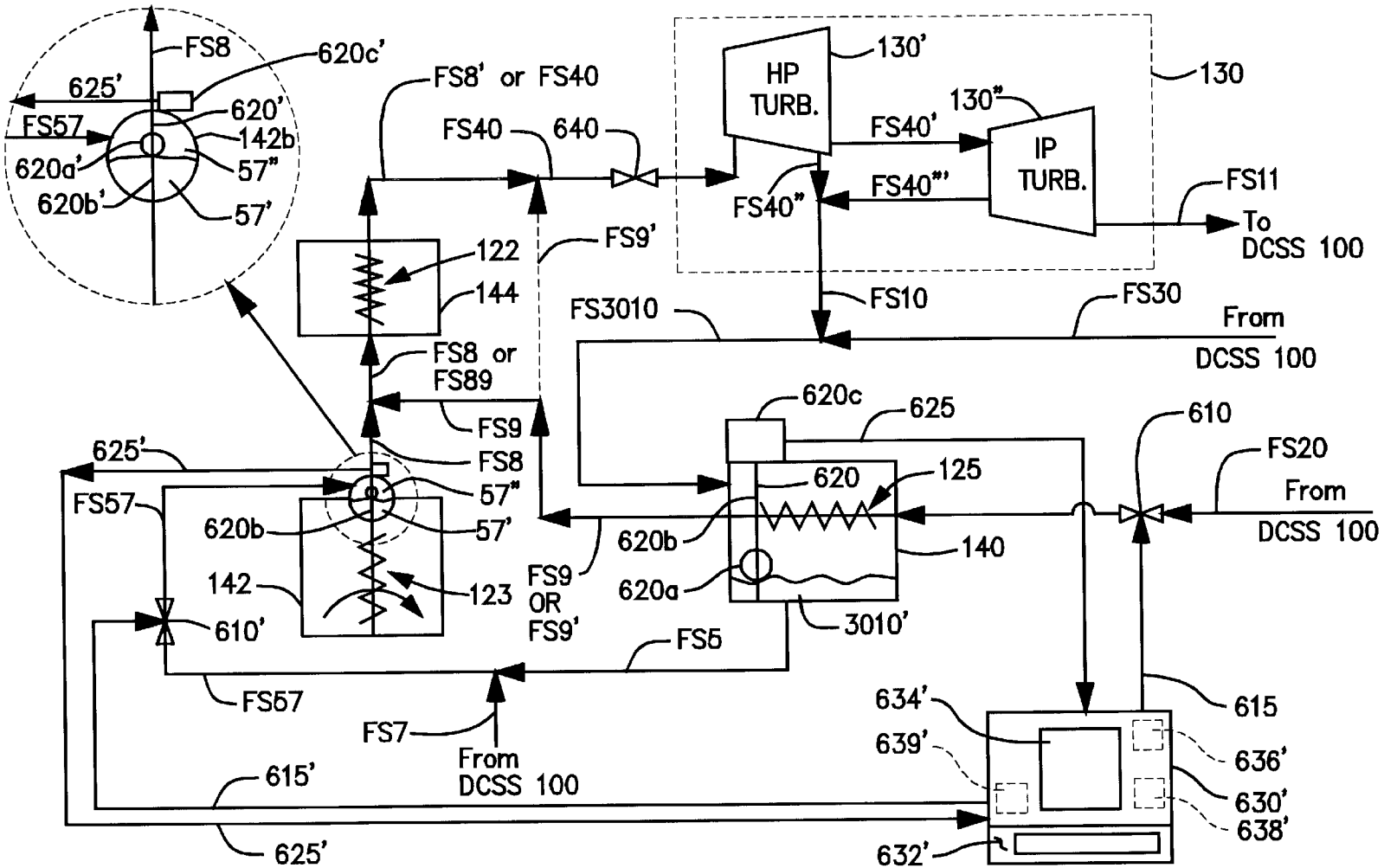
FIG. 7B depicts a Kalina cycle power generation system in a drum type recirculating flow configuration in accordance with the present invention.

In accordance with the present invention, and as shown in FIGS. 7A and 7B which will be described below, a simple way is provided for meeting these requirements, based upon the recognition that the amount of heat sink which is available for condensing the extraction flows FS 40" and FS 40'" and the portion of the extraction flow FS 11, which together form the hot lean flow FS 3010 to the RHE 140, can be used to control the amount of feed fluid 57. More particularly, once the pressure in the condensing chamber of the RHE 140 builds to match the pressure of the turbine extractions, no further hot vapor working fluid stream FS 3010 will flow to the RHE 140. Thus, the extraction flows from the TGSS 130 forming the hot lean working fluid vapor stream FS 3010 are practically limited to only that amount of extraction flow from the TGSS 130 which can be condensed by the cold rich liquid or mixed liquid/vapor working fluid stream FS 20 in the RHE 140. Therefore, the flow amount, e.g., rate of flow, of the cold rich stream FS 20 within the RHE 140 will determine how much lean hot vapor in stream FS 3010 can be condensed. Accordingly, the amount of lean hot vapor flow in stream FS 3010 is set based upon the amount of rich cold liquid or mixed liquid/vapor flow which is available in stream FS 20. The greater the amount of rich cold flow available in stream FS 20, the greater the amount of condensate 3010' and hence boiler feed working fluid available for stream FS 5. Further, it is possible to maintain system balance by simply monitoring and controlling the level of the condensate 3010' in the RHE 140.

Figure 1:
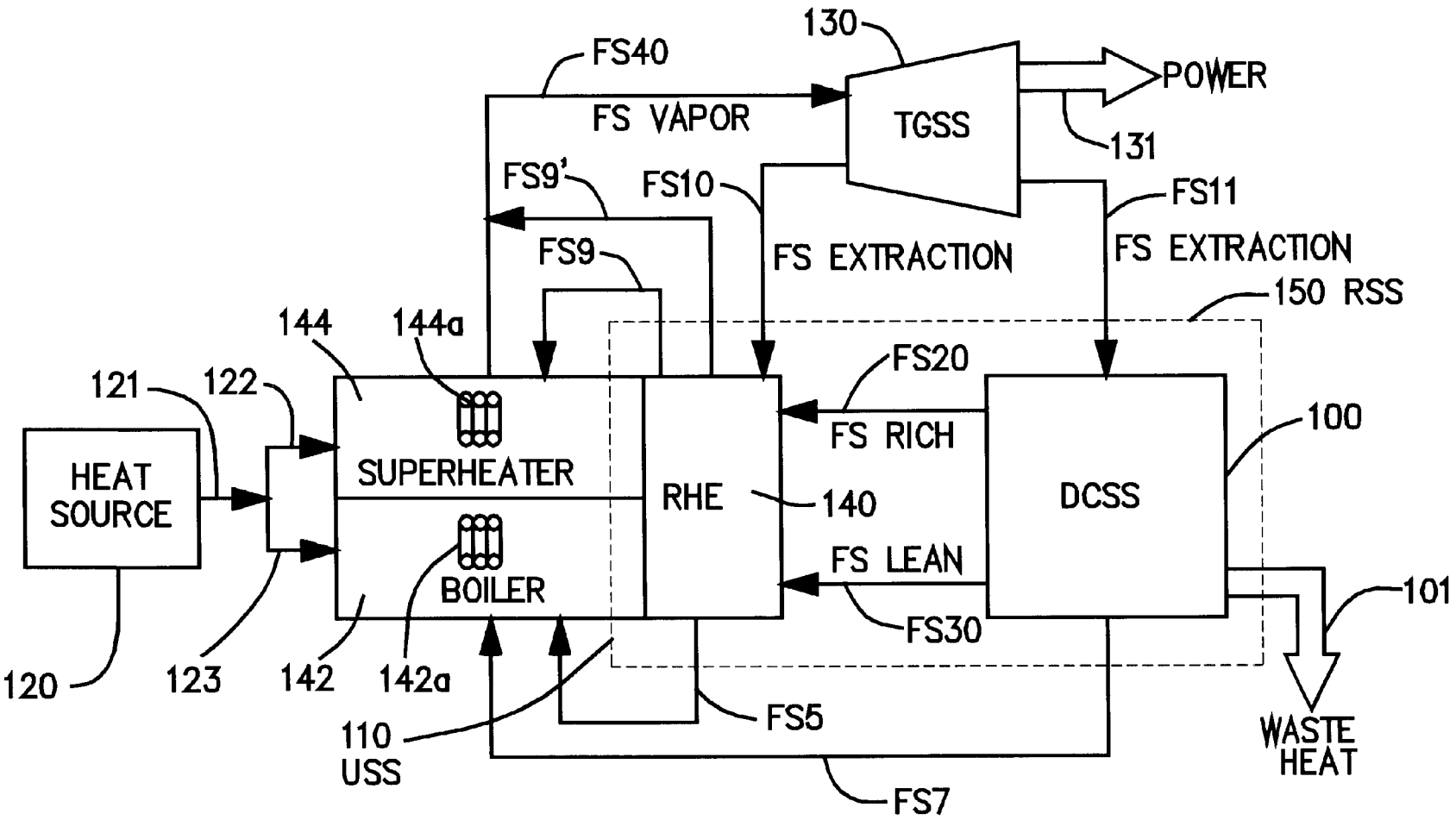
Figure 1 (PRIOR ART)
FIG. 1 depicts a simplified block diagram of a conventional Kalina cycle power generation system.
Figure 2:
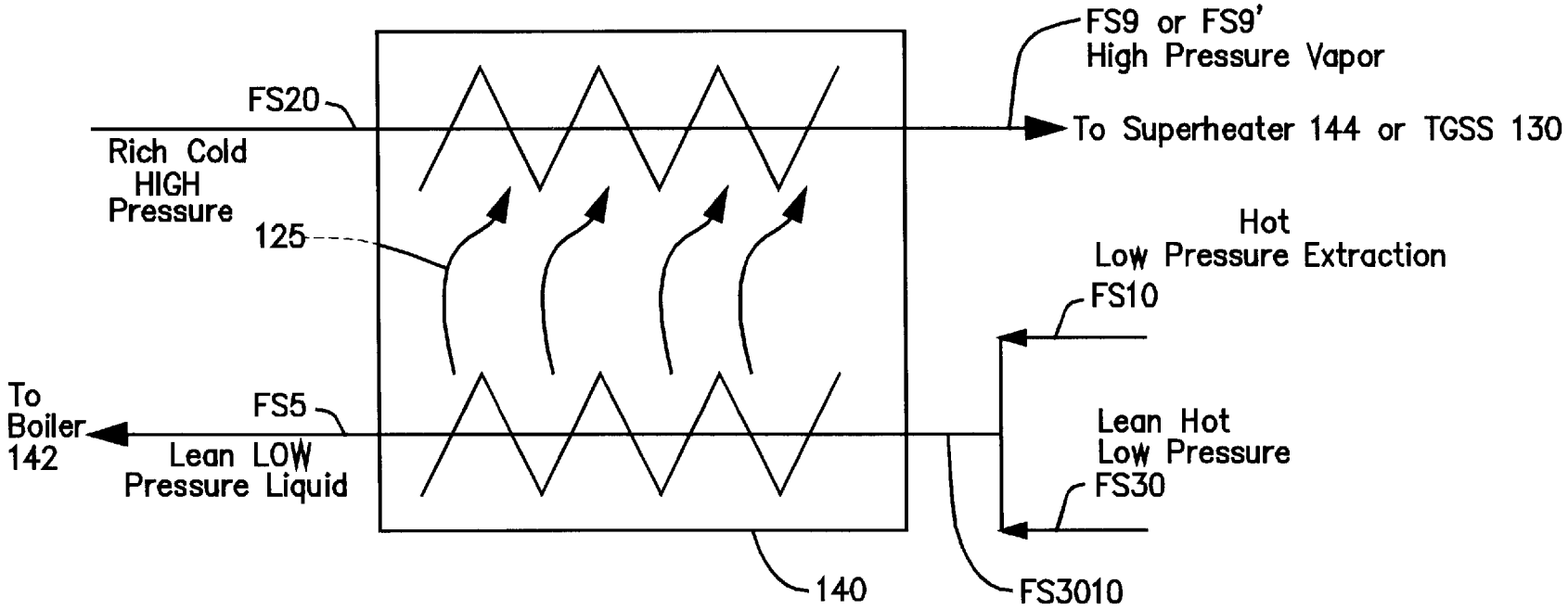
Figure 2 (PRIOR ART)
FIG. 2 particularly details the RHE of the conventional Kalina cycle power generation system of FIG. 1.
Figure 3:
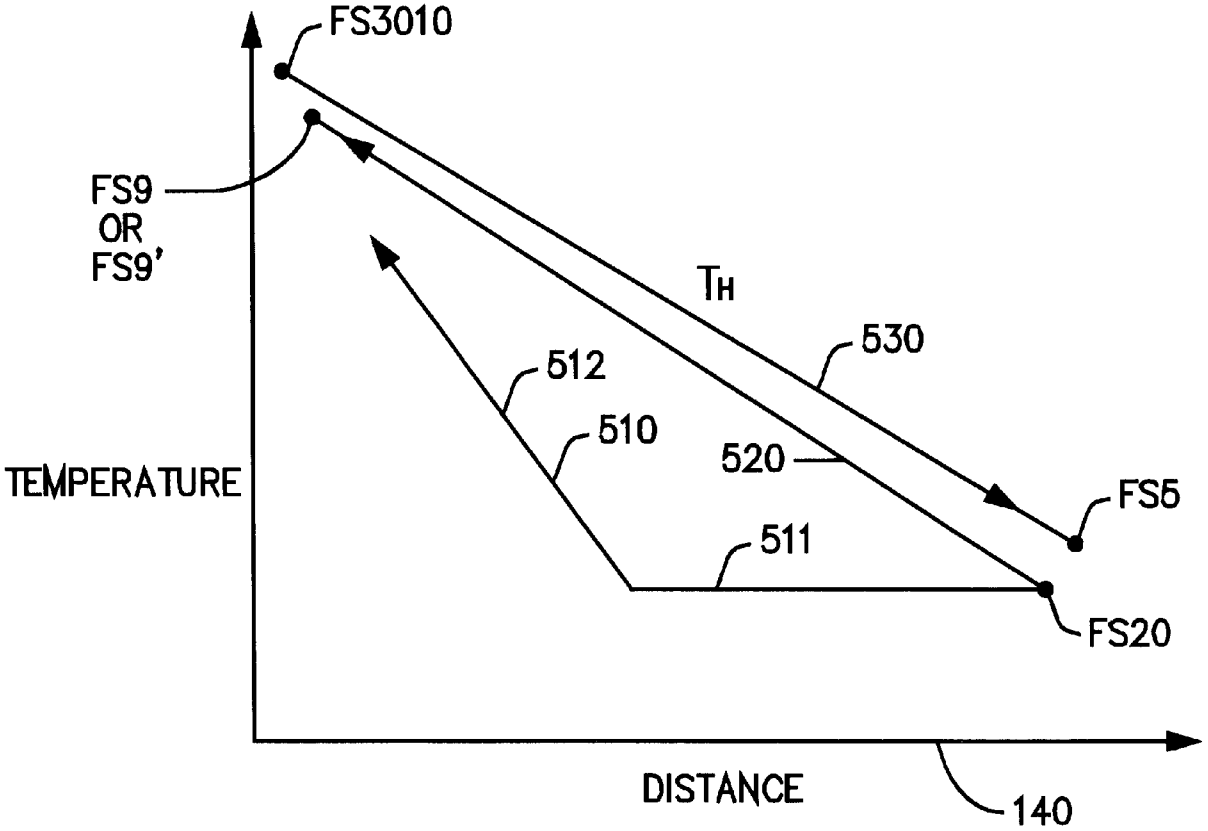
Figure 3 (PRIOR ART)
FIG. 3 illustrates the basic heat exchange between flow streams in the RHE detailed in FIG. 2.
Figure 4:
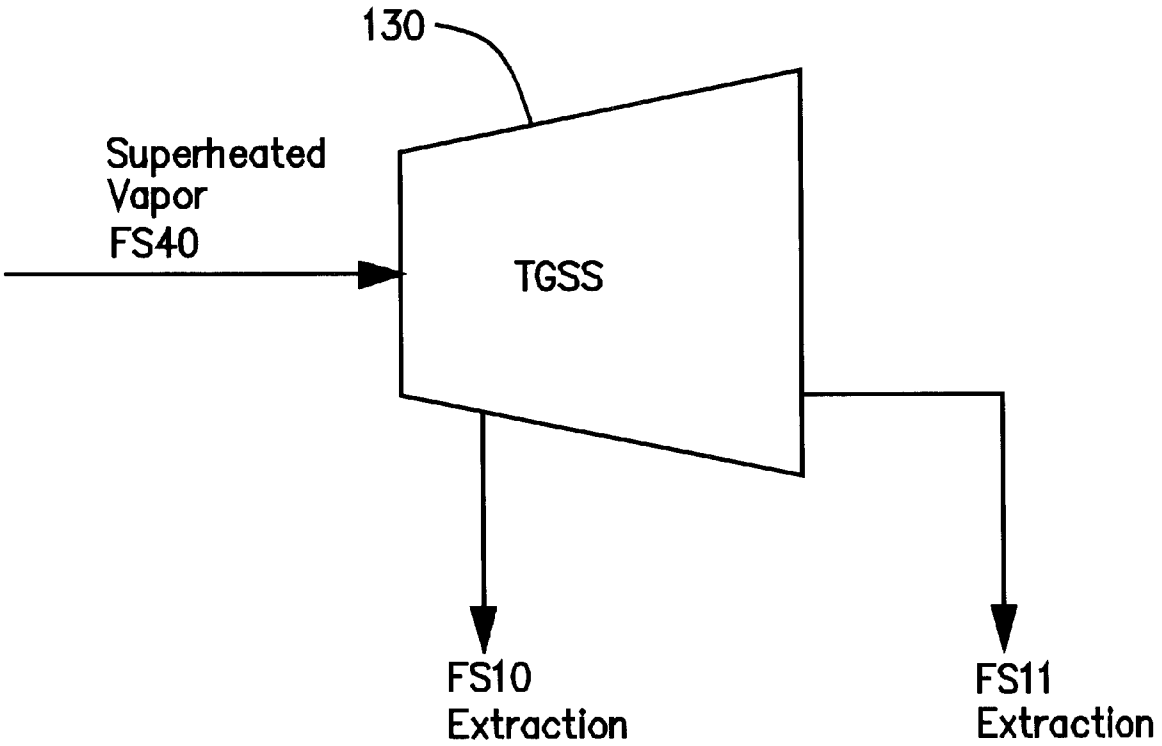
Figure 4 (PRIOR ART)
FIG. 4 partially details the TGSS of the conventional Kalina cycle power generation system of FIG. 1.
Figure 5A:
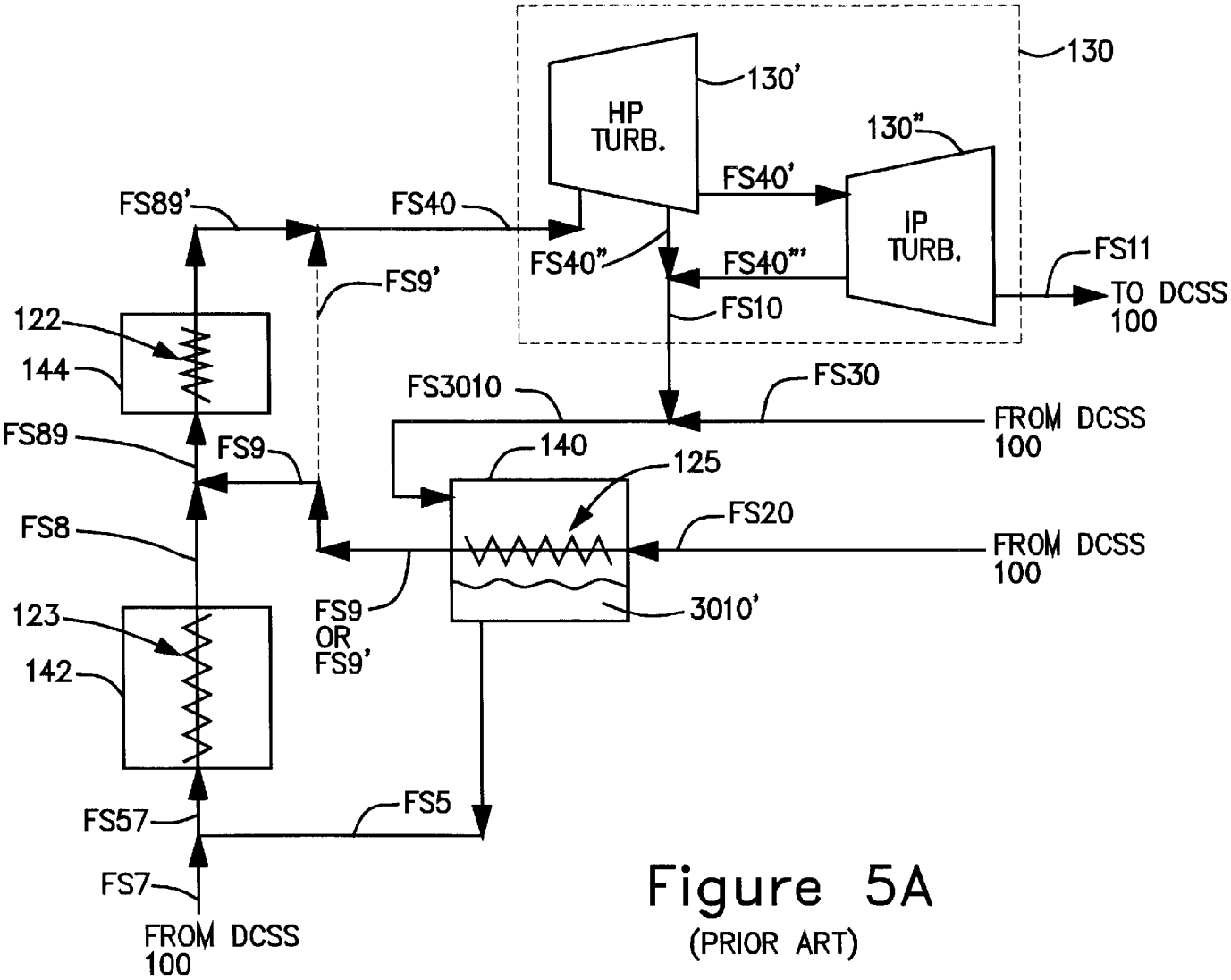
Figure 5A (PRIOR ART)
FIG. 5A is a somewhat more detailed representation of the conventional Kalina cycle power generation system of FIG. 1 depicting a once-through flow configuration.

FIG. 7A depicts a once through type Kalina cycle power generation system similar to that depicted in FIG. 5A, with like components identified by identical reference numerals. Such like components will generally not be further described below to avoid unnecessary duplication. As shown in FIG. 7A, the balance control can be easily accomplished by controlling the flow amount to the RHE 140 of the rich cold stream FS 20 from the DCSS 100 using a motorized, low pressure, low temperature valve 610. More particularly, a fluid level sensor 620 is provided for detecting the level of the condensate 3010' in the condensation chamber of the RHE 140. The sensor 610 can be of virtually any type, as will be well understood in the art. The simplified sensor shown includes a float 620*a*, float guide 620*b* and a signal generator 620*c* for generating a signal representing the float level. The sensor 620 is interconnected by communications line 625 to a controller 630. The signal generator 620*c* transmits the signal over the communications line 625 to the controller 630.

The controller 630 includes a keyboard 632 for receiving user inputted information and a monitor 634 for displaying information to the user. It should be understood that other input devices, e.g., a keypad, mouse, touch screen or other device, and other types of output devices, e.g., a printer, voice synthesizer or other devices, could be substituted if desired for the keyboard and monitor shown in FIG. 7A. The controller 630 also includes stored logic 636, which will typically be in the form of hardware logic or software stored on a medium, and a processor 638 for processing, in accordance with the logic 636, information input by a user via the keyboard 632 or received from the sensor 620 via line 625. The processor 638, in accordance with the logic 636, also generates and directs the transmission of control signals to the valve 610 via communications line 615, responsive to which the motorized valve operates to increase or decrease the amount of flow in working fluid stream FS 20. The logic 636 may include an algorithm or an access instruction to a look-up table having a flow index with preselected flow set points or other data stored on a memory 639 of the controller 630 which can be used to determine the amount of valve adjustment required for flow balancing based upon the transmitted fluid level information.

In operation, the sensor 620 monitors, and generates and transmits signals to the controller 630 representing the current level of the condensed working fluid 3010' in the condensation chamber of the RHE 140. The controller 630 processes the received information in accordance with the logic 636 and determines if a change in the level of condensed working fluid 3010' has occurred. If a change is determined, the controller 630 generates and transmits, in accordance with the logic 636, a signal to the motorized valve 610 to either increase or decrease the amount of flow to the RHE 140 in stream FS 20.

For example, if it is determined by the controller 630 that a drop in the level of the condensed working fluid 3010' in the RHE 140 has occurred, this would indicate that the demand for working fluid to cool the boiler tubes 142*a* is exceeding the current amount of flow available from the stream FS 3010 which can be condensed in the RHE 140, and hence the current amount of available extraction flow from the TGSS 130 which can be condensed. Such a situation might arise if a sudden or large increase in the load, and therefore the demand for power from the TGSS 130, were to occur, or due to abnormal ambient environmental conditions. Based upon such a determination the controller 630, in accordance with the logic 636 generates a signal to the valve 610 causing a further opening of the valve. This will increase the amount of the flow in rich cold liquid or mixed liquid/vapor stream FS 20 from the DCSS 100 to the RHE 140, thereby increasing both the level of the condensate in the RHE 140 and the amount of vapor working fluid flowing in stream FS 9 or superheated vapor working fluid flowing in stream FS 9'.

Thus, in either case, this will ensure that the increased demand for feed fluid to cool the boiler tubes 142*a* can be met and, at the same time, that the increased demand for superheated working fluid in stream FS 40 to the TGSS 130 to satisfy the increased power demand can also be met. Accordingly, by simply monitoring the current level of the condensed working fluid 3010' in the RHE 140, and controlling the quantity of rich working fluid supplied to the RHE 140 by stream FS 20 based upon any detected level changes, equilibrium in the condensing chamber of the RHE 140 can be restored and the required superheated vapor flow can be provided to the TGSS 130, i.e., system balance can be maintained.

As shown, a turbine governing valve 640 is provided for controlling the flow, and hence the pressure, at the inlet of the TGSS 130. In practical terms, the valve 640 sets the load. Accordingly, as demand for power increases, the valve 640 can be opened to increase the rate of flow of superheated working fluid stream FS 40 to, and hence maintain a constant pressure at, the TGSS 130.

In a so called "boiler follow" operation, as the valve 640 is opened, the pressure upstream of the valve will decrease. To balance the pressure, the process heat 121 will be correspondingly increased following the opening of the valve 640, for example by increasing the firing rate in a direct fired furnace to increase the pressure upstream of the turbine inlet. This is commonly referred to as "boiler-follow" operation because the change in boiler operation follows the change in turbine operation. It will of course be recognized that the valve 640 could alternatively be closed to reduce flow to the turbine during periods of reduced power demand and the boiler would be controlled accordingly. In a so called "turbine-follow" operation the sequence would be opposite to that described above for the "boiler-follow" operation. That is, the amount of vapor generated would first be increased by increasing the process heat and then the turbine governor valve 640 would be correspondingly opened to meet the load demand.

It should be noted that "boiler-follow" operation provides a slower system transition which may be beneficial in systems such as Kalina cycle power generation systems, since more time is allowed for the transitions which must occur in the various subsystems and/or components of such systems.

In either "boiler-follow" or "turbine-follow, adjusting the turbine governor valve 640 for the load demand will allow the system to operate in a constant pressure mode even under differing operating and environmental conditions, including changes in the load conditions. However, some energy loss will necessarily be experienced at the valve 640 and accordingly, the present invention includes a further enhancement which allows the elimination of the valve 640 and operation in a so called "sliding pressure mode", as will be described below with reference to FIG. 7B.

Figure 5B:
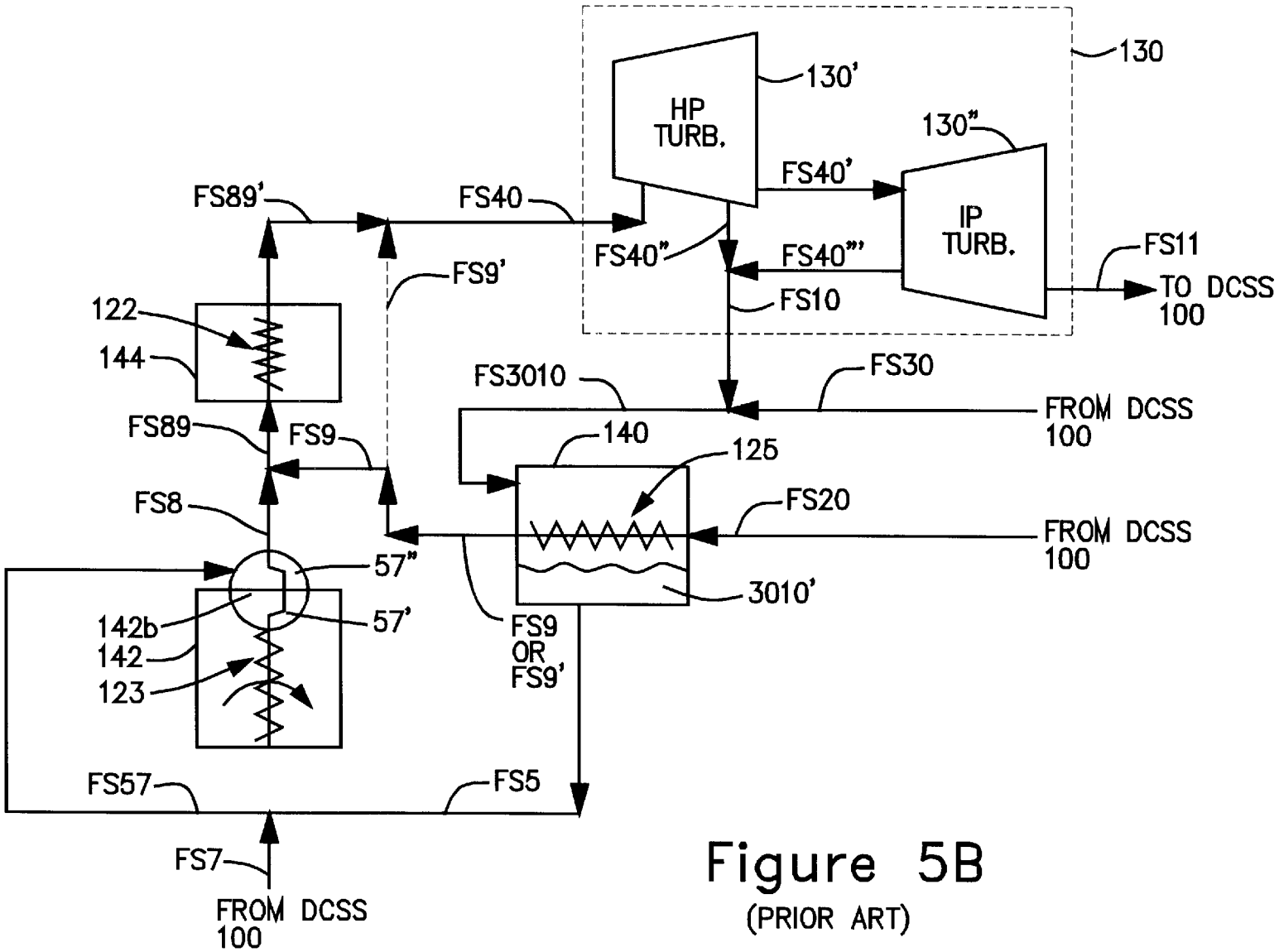
Figure 5B (PRIOR ART)
FIG. 5B is a somewhat more detailed representation of the conventional Kalina cycle power generation system of FIG. 1 depicting a drum type recirculating flow configuration.

FIG. 7B depicts a recirculating drum type Kalina cycle power generation system similar to that depicted in FIG. 5B, with like components identified by identical reference numerals. Additionally, certain components described with reference to FIG. 7A are also included in the system of FIG. 7B and identified with identical reference numerals. The previously described components will, in general, not be further described below to avoid unnecessary duplication.

As shown in FIG. 7B, the balance control can be easily accomplished by controlling the flow amount to the drum 142*b* of the working fluid stream FS 57 from the RHE 140 and DCSS 100 using a motorized, low pressure, low temperature valve 610'. More particularly, a fluid level sensor 620' is provided for detecting the level of the condensate liquid or mixed liquid/vapor working fluid 57' in the drum 142*b* of the boiler 142. The sensor 620' can be of virtually any type, as will be well understood in the art. The simplified sensor shown includes a float 620*a*', float guide 620*b*' and a signal generator 620*c*' for generating a signal representing the current float level. The sensor 620' is interconnected by communications line 625' to a controller 630'. The signal generator 620*c*' transmits the signal over the communications line 625' to the controller 630', which is also interconnected via communications lines 615 and 625 to the sensor 620 and valve 610.

The controller 630' includes a keyboard 632' for receiving user inputted information and a monitor 634' for displaying information to the user. As previously discussed with reference to controller 630 of FIG. 7A, other types of input and output devices could be used if so desired. The controller 630' also includes stored logic 636' which, as discussed above with reference to controller 630 of FIG. 7A, may be hardware logic or software stored on a medium, and a processor 638' for processing, in accordance with the logic

636', information input by a user via the keyboard 632' or received from the sensors 620 and 620' via communications lines 625 and 625', respectively. The processor 638', in accordance with the logic 636', also generates and directs the transmission of control signals to the valves 610 and 610' via communications lines 615 and 615', responsive to which the motorized valves 610 and 610' operate to increase or decrease the amount of flow in fluid streams FS 20 and FS 57. As discussed above, the logic, in this case 636', may include an algorithm or an access instruction to a look-up table having a flow index with preselected flow set points or other data stored on a memory 639' of the controller 630' which can be used to determine the amount of valve adjustment required for flow balancing based upon the transmitted fluid level information.

In operation, the sensor 620' monitors the current level of the working fluid 57', and generates and transmits signals to the controller 630' representing the current level of the working fluid 57' in the drum 142*b*. The sensor 620 performs as described with reference to FIG. 7A. The controller 630' processes the received information in accordance with the logic 636' and determines if a change in the level of the working fluid 3010' and/or 57' has occurred. If a change is determined to have occurred, the controller 630' generates and transmits, in accordance with the logic 636', a signal to the motorized valve(s) 610 and/or 610', as appropriate to either increase or decrease the amount of flow to RHE 140 in stream FS 20 and/or to the drum 142*b* in stream FS 57.

For example, if it is determined by the controller 630' that an increase in the level of the working fluid 57' in the drum 142*b* has occurred, this would indicate that the demand for working fluid to cool the boiler tubes 142*a* is less than the amount that is currently available from the stream FS 57, and hence from the current amount of available condensate in the RHE 140. Such a situation might arise if a sudden or large decrease in the load, and therefore the demand for power from the TGSS 130, were to occur. Based upon such a determination, the controller 630', in accordance with the logic 636', generates a signal to the valve 610' causing a partial closing of the valve. This will decrease the amount of the flow in liquid stream FS 57 from the DCSS 100 and the RHE 140, thereby decreasing both the level of working fluid 57' in the drum 142*b* and the amount of vapor working fluid flowing in stream FS 9 or superheated vapor working fluid flowing in stream FS 9'.

In either case, this will in turn ensure that the decreased demand for feed fluid to cool the boiler tubes 142*a* will not result in flooding the drum. This may, however, result in an increase in the condensed working fluid 3010' in the RHE 140. Hence, if the controller also receives a signal from the sensor 620 indicating that the level of the condensed working fluid 3010' has increased, it will, in accordance with logic 636', generate and transmit a signal to the valve 610 to reduce the flow of rich cold working fluid stream FS 20 to the RHE 140 to thereby avoid flooding of the RHE condensation chamber. Accordingly, by simply monitoring the current level of the working fluid 57' in the drum 142*b* and condensed working fluid 3010' in the RHE 140, and controlling the quantity of working fluid supplied to the drum 142*b* by stream FS 57 and of the rich working fluid supplied to the RHE 140 by stream FS 20 based upon the detected level changes, equilibrium in the drum 142*b* and RHE 140 can be restored and the required superheated vapor flow can be provided to the TGSS 130, i.e., System balance can be maintained.

Other alternative configurations could be used to actively control the flows to ensure both sufficient feed flow to cool the boiler tubes 142*a* and sufficient superheated vapor flow to the TGSS 130 to meet the power demand. For example, the extraction flow FS 10 could be controlled, however this would require a large, high temperature, high pressure valve, recall that the extraction flow FS 40" is typically in the range of fifty percent (50%) of the exhaust from the HP turbine 130'. This is contrasted with the relatively small, low pressure, low temperature valve 610 and/or 610' described above. Using such a large valve would result in a large loss of pressure, and hence loss of energy, through the valve, as compared with the relatively small loss of pressure resulting from the use of valves 610 and/ or 610'.

It should also be understood that although the control of the Kalina cycle power generation systems shown in FIGS. 7A and 7B have been described above as feedback control, i.e., a change in one or more working fluid levels is first determined and then corrective action is taken, the control could be also or alternatively be configured for feedforward control. For example, information relating to a known change in the load, and hence the power demand, can be input either on keyboard 632 or 632', as applicable, or from a remote station via a communications line (not shown) to the controller 630/630'. Using the change in load information the processor 638/638' generates a signal, in accordance with the logic 636/636' to automatically direct the valves 610/610' to open or close, as applicable, to nominally adjust the flow(s) and balance the system for the load change. The logic 636/636' may include an algorithm or an access instruction to a look-up table containing a load index or other data stored on memory 639/639' in the controller 630/630' which can be used to determine the amount of valve adjustment required for nominal flow balancing based upon a known change in load. The sensor(s) 620/620' could then be used to obtain a final, more precise adjustment of the valve(s) using the feedback control process previously described.

Referring to FIGS. 7A and 7B, as discussed above, the main extraction flow stream FS 10 from the TGSS 130 and vapor stream FS 40 to the TGSS must, along with other streams in RHE 140 and DCSS 100, be maintained in thermal balance. Balance is achieved when massflow extracted from the TGSS 130 is just enough to evaporate and, if applicable, superheat the required working fluid in stream FS 9 or FS 9' for a given operating pressure of the vapor stream FS 40, e.g., inlet pressure P1, and a given operating pressure of the extraction stream FS 10, e.g., outlet pressure P2. At part-load conditions turbine exhaust temperatures rise, i.e., the temperatures of the working fluid in streams FS 40', 40" and 40'" and hence stream FS 10 increase, for a given constant turbine inlet temperature, i.e., a constant temperature of vapor stream FS 40, as the load is decreased because the inlet pressure P1 is decreasing. Similarly, the vapor-liquid equilibrium of extraction flow stream FS 10 in the RHE 140 is a function of pressure P2. Therefore, as pressure P2 decreases so does the temperature range where condensation occurs. This may cause duty mismatches in the heat exchanges occurring in the RHE 140s, and a decrease in the amount of heat that can be regenerated. This, for example, could result in mixed liquid/vapor working fluid where only liquid working fluid is desired.

Thus, when the relationship between P1 and P2 changes due to, for example, part-load conditions, either extraction massflow, or pressure must be adjusted to prevent too much heat from being regenerated. System hardware including pumps, heat exchangers, and the like are likely to experience damage or other operational anomalies when operating condition boundaries, e.g., phase and/or temperature, are encountered or exceeded. Additional control therefore may be desirable, particularly for operation at low-load conditions.

Figure 7C:
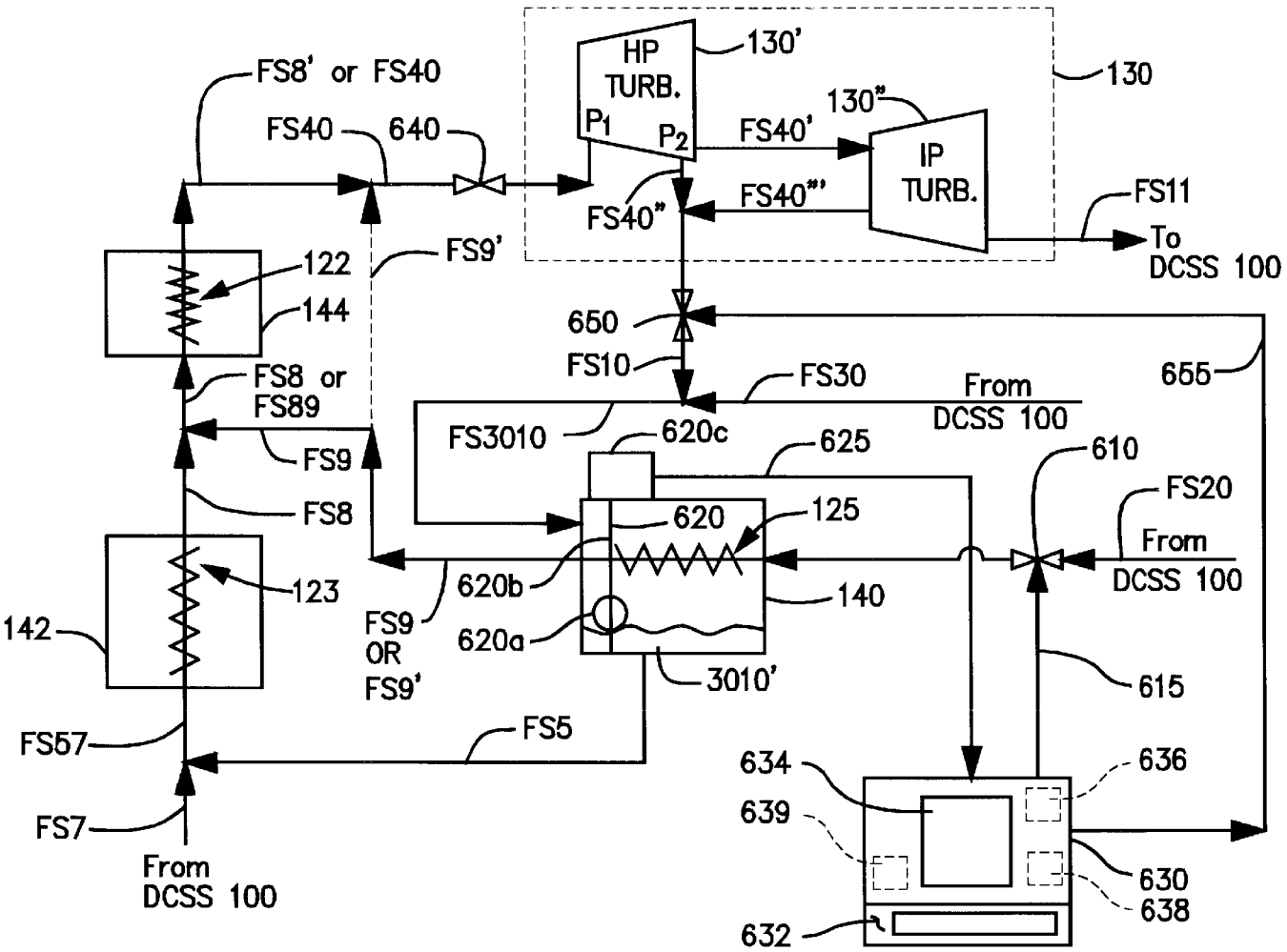
FIG. 7C depicts a Kalina cycle power generation system with turbine extraction flow control in accordance with the present invention.

To control the relationship between pressure P1 and P2, relative extraction massflow from the TGSS 130, i.e., the flow of working fluid extraction stream FS 10 may be regulated as illustrated generally in FIG. 7C using a valve arrangement, generally depicted as valve 650. FIG. 7C is identical to FIG. 7A with the exception of the addition of valve arrangement 650. As will be recognized, the valve arrangement 650 could also be easily implemented in the drum type system of FIG. 7B.

The valve arrangement is controlled by the controller 630 to increase or decrease the rate of flow of the extraction stream FS 10 to the RHE 140 as a function of load changes to obtain optimum balance especially under low load conditions. For example, during reduced loading, the pressure within the condensing heat exchanger of the RHE 140 will be reduced. This will result in the amount of condensate 3010' generated also being reduced. Without valve arrangement 650 to control the flow of the stream FS 10 which is the primary feed to the RHE 140, the only way to increase the condensate production in RHE 140 is to increase the rate of flow of the rich cold stream FS 20 from the DCSS 100. Although this may be sufficient within a normal load range, this may not provide optimum balance under certain conditions, particularly low load conditions. Accordingly, it may be desirable to provide a valve arrangement which allows the pressure in the heat exchange condenser of RHE 140 to be adjusted. In the above example, by increasing the pressure, the amount of condensate produced in the RHE 140 can be increased without increasing the flow from the DCSS 100 and may therefore provide an advantageous way of obtaining optimal balance.

FIG. 7C(1) depicts one configuration of the valve arrangement 650 shown in FIG. 7C. As illustrated, the stream FS 10 from the TGSS 130 is regulated using bypass control valve 650*a*. Control valve 650*a* provides control in the range of about 0 to 30% reduction of the design-point extraction massflow, i.e., the rate of flow of FS 40". To minimize the size requirement for control valve 650*a*, a portion of extraction flow stream FS 40" may be routed through fixed diameter pipe 652*a* configured in parallel with control valve 650. The remainder of extraction flow FS 40" is controlled using control valve 650*a*, responsive to signals from the controller 630.

FIG. 7C(2) depicts another configuration of the valve arrangement 650 shown in FIG. 7C. In this alternative configuration, extraction pressure P2 is raised by a series of control and/or shut-off valves which can be used to provide the extraction from a higher pressure extraction point in the flow. As shown, using valves 650*b*, 650*c* and 650*d*, the extraction point is "backed-up" to adjust effective extraction pressure P2 so that the regenerative sub-system is balanced. Additional outlet ports in the vapor turbine are required, as well as an additional port upstream of the HP turbine inlet.

It is also possible to use a combination of the configurations in a hybrid control system. This may, under certain circumstances provide even more optimal control than the separate use of either of the configurations of FIGS. 7C(1) and 7C(2).

For even higher thermal efficiency, it is desirable to maximize the regenerative evaporation. That is, maximum efficiency will be obtained when the stream FS 9 to the superheater 144 is as close as possible to saturation without being wet, although some slight degree of wetness may be tolerable depending upon the particular implementation. To further increase the thermal efficiency of the system, another control loop can be added as shown in FIG. 8.

Figure 8:
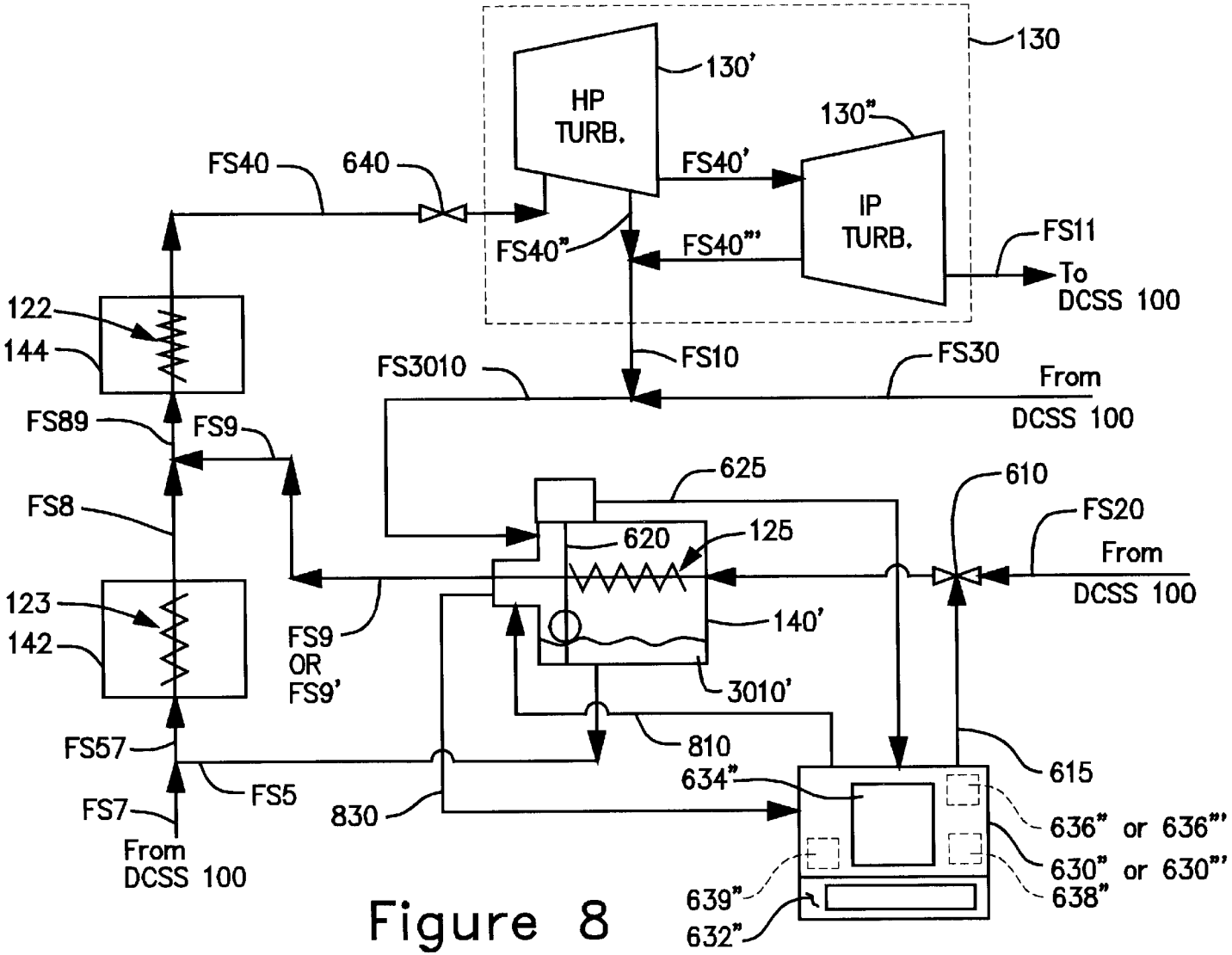
FIG. 8 depicts a Kalina cycle power generation system with more precise regenerative vapor control in accordance with the present invention.

FIG. 8 depicts a system similar to that depicted in FIG. 7A, but with the RHE and controller modified. More particularly, the system of FIG. 8 includes a controller 630"/630'" and RHE 140' which can be utilized to provide even higher thermal efficiency within the system. Although the modifications to the RHE and controller are shown in FIG. 8 and further described below with reference to a once through type system, it will be recognized that these modifications can be easily applied to the drum type system of FIG. 7B to facilitate similar enhancement of the thermal efficiency of the system depicted therein.

Figure 9:
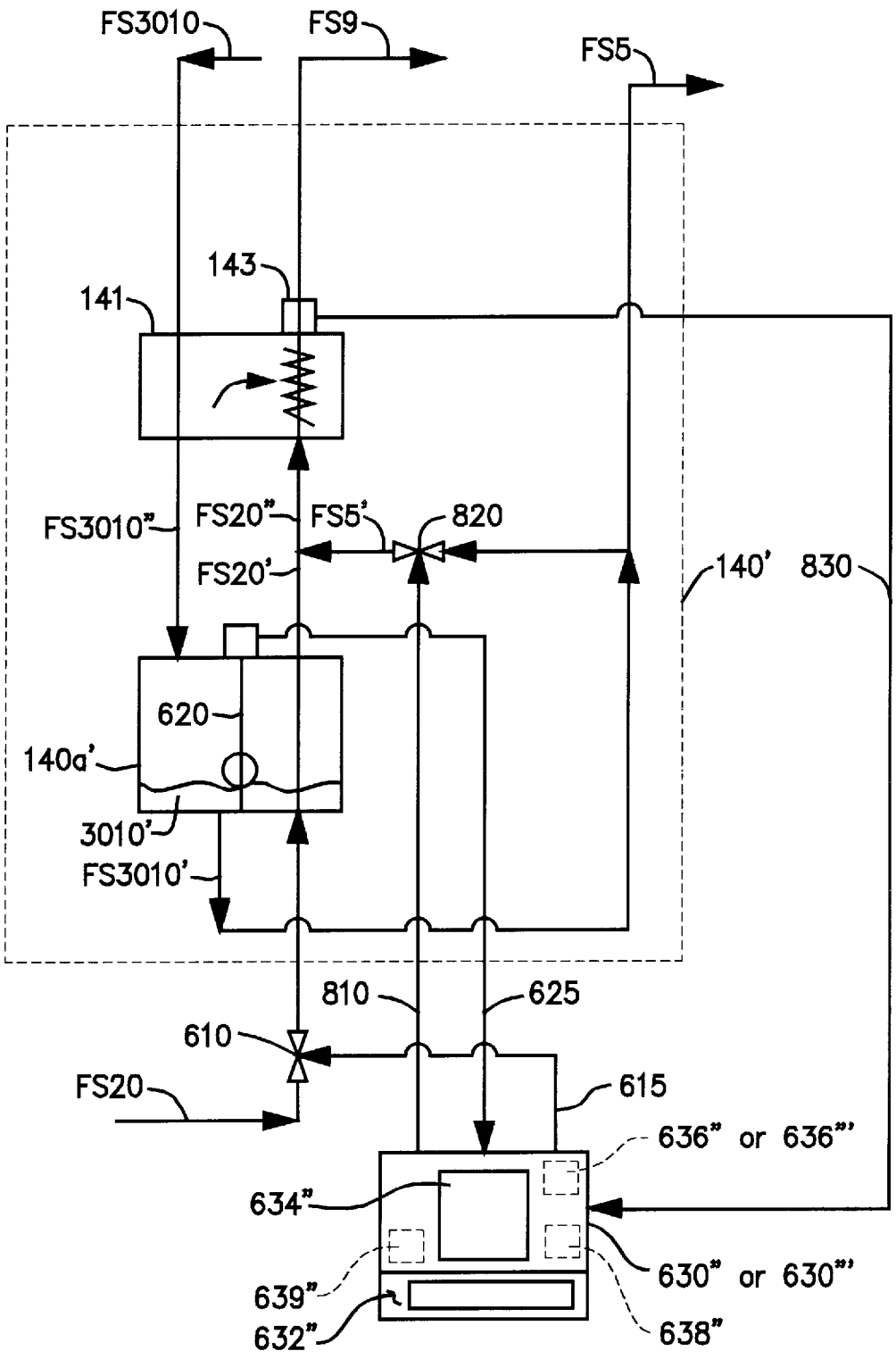
FIG. 9 further details the RHE of the Kalina cycle power generating system of FIG. 8.

FIG. 9 further details the RHE 140' of FIG. 8. As shown in FIG. 9, the RHE 140' includes an additional valve 820 which is controlled by the processor 638" of the controller 630"/630'" in accordance with the logic 636"/636'" based upon pressure and temperature information generated by the sensor 143 and transmitted from the sensor 143 to the controller 630"/630'" via line 830. This information may be stored in memory 639" of the controller. The valve 820 opens or closes in accordance with the signal received over line 810 from the controller 630"/630'" to precisely control the state of the stream FS 9 which is directed from the RHE 140' to the superheater 144.

The RHE 140' receives a cool relatively rich working fluid FS 20 from the DCSS 100. The flow rate of this stream is controlled by the valve 610 in accordance with control signals received via line 615. The control signals are generated by the controller 630"/630'" based upon the condensate level information received by the controller from the level indicator 620 via line 625, as has been described above with reference to FIGS. 7A and 7B. The RHE 140' also receives a hot relatively lean working fluid FS 3010 from the TGSS 130 and DCSS 100. The stream FS 3010 is slightly cooled in heat exchanger 141 to form stream FS 3010". The heat exchanger 140*a*' transfers heat from the hot lean stream FS 3010" to vaporize and superheat the stream FS 20 to form superheated rich vapor stream FS 20'. The hot lean working fluid in stream FS 3010" is condensed in this process. The condensed lean working fluid 3010' is collected in the chamber of the heat exchanger 140*a*' as shown. The condensate 3010' is directed from the heat exchanger 140*a*' as cool liquid stream FS 3010'.

A secondary, relatively small liquid condensate stream FS 5' is tapped off of the primary liquid condensate stream FS 3010'. The flow rate, and hence the volume of the flow, of the stream FS 5' is controlled by the valve 820 in accordance with signals generated by the processor 638" as directed by the logic 636"/636'" based upon the received temperature and pressure information received by the controller 630"/630'" from the sensor 143 via the line 830. The controller 630"/630'" transmits the generated signals to the valve 820 via the line 810, which responsive thereto adjusts, as appropriate, the flow rate corresponding to the received signal.

The tapped stream FS 5' is combined with the stream of superheated rich vapor FS 20' from the heat exchanger 140*a*' of the RHE 140'. The addition of the fluid from liquid stream FS 5', cools and saturates the superheated vapor in stream FS 20'. The transformed working fluid stream FS 20" is directed through a further heat exchanger 141 which transfers heat from the hot lean working fluid stream FS 3010 to further heat the stream FS 20" such that the stream FS 9 output from the RHE 140' to the superheater 144 is preferably fully saturated and just slightly superheated.

As will be recognized by those skilled in the art, the pressure and temperature information provided by the sensor 143 will directly allow the controller 630"/630'" to determine the state of the stream FS 9 leaving the RHE 140'. Accordingly, the controller signals to the valve 820 will automatically cause the valve to open or close as necessary to obtain the desired state of stream FS 9 and preferably ensure that the stream FS 9 is a slightly superheated fully saturated vapor.

Using the dual flow control described above for precise regulation of the vapor state leaving the RHE 140', competing demands are made for condensate 3010'. That is, the condensate formed in the RHE 140' must be sufficient to both provide a sufficient flow FS 5 to the boiler as well as to provide a sufficient flow FS 5' to the stream of vaporized rich working fluid FS 20'. Hence, the control of the valve 610 by the control 630"/630'" must ensure that the flow of the cold rich stream FS 20 from the DCSS 100 is sufficient to condense the required amount of hot lean working fluid from stream FS 3010.

The control of the state of the vapor leaving the RHE 140' using valve 820 will cause the stream FS 3010" entering heat exchanger 142 to be slightly cooler than would otherwise be the case. This will in turn affect the amount of condensation which will be formed in the condensing heat exchanger **140*a*' of FIG. 9 and therefore affect the level of condensate available for streams FS 5 and FS 5'. Hence, there is an interrelationship between the loops controlling the flow of rich cold working fluid in stream FS 20 entering the RHE140' and the state of the vapor stream FS 9** leaving the RHE.

The loops can, if desired, be decoupled by the controller 630" in accordance with logic 636", by separating the time scales. This can be accomplished, for example, by extending the time period over which an adjustment of the valve 820 occurs to be substantially greater than the time period over which a corresponding adjustment of the valve 610 occurs. Because of the nature of the regulation provided by the valve 820, lengthening the adjustment period will not, in general, degrade the performance of the regulation. More particularly, the slow adjustment of the flow rate of stream FS 5' should provide good thermodynamic performance while at the same time avoiding any significant negative impact on the regulation of the flow of the stream FS 20.

Alternatively, a model base multi-variable control could be implemented in the logic 636'" or controller 630'" which would model the interaction between the control loops such that the signals generated by the controller 630'" to the valves 820 and 610 would take into consideration the interrelationship between the respective control loops. Various types of multi-variable controls could be utilized for such purposes, as will be well understood by one skilled in the art. For example, model predictive control or linear quadratic Gaussian control could be utilized.

Figure 10:
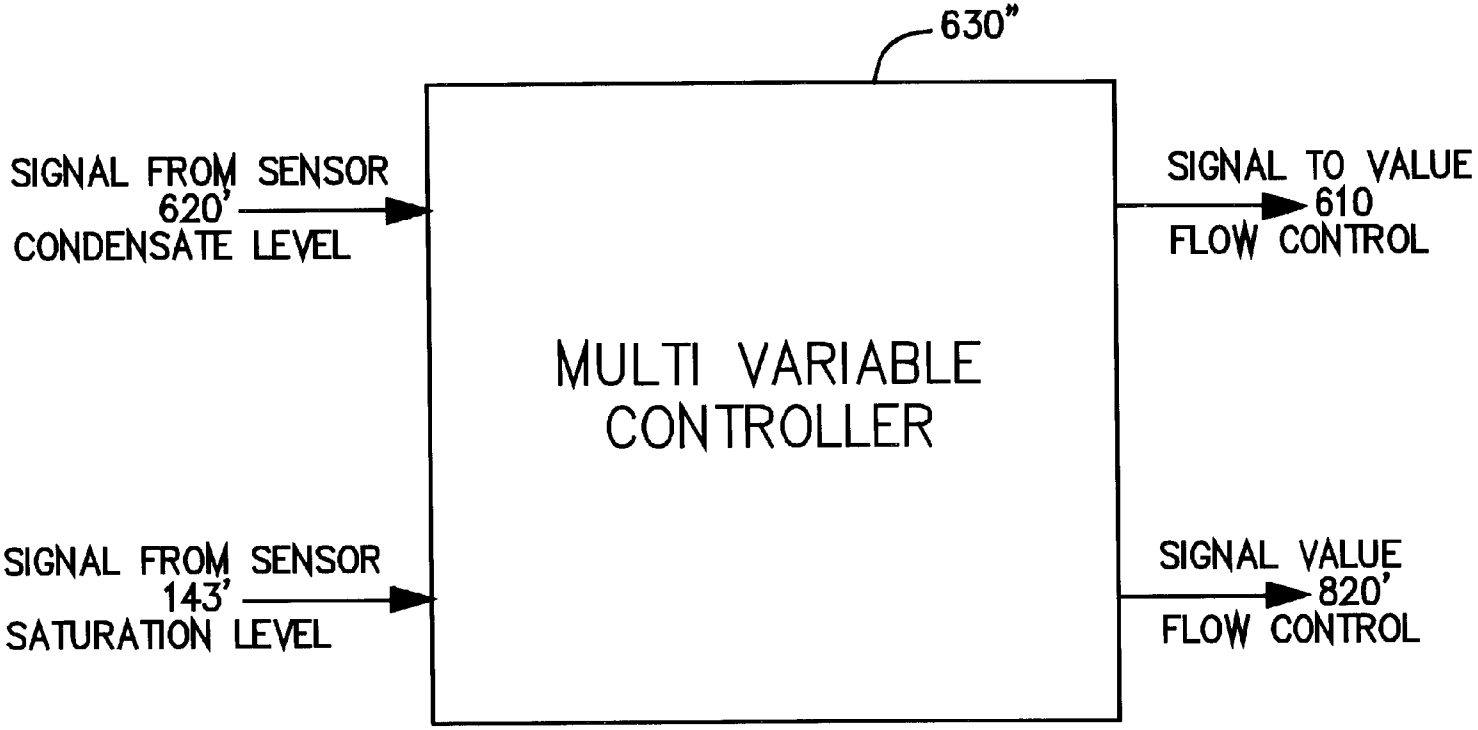
FIG. 10 provides a simplified block diagram of one type of controller which is suitable for use in the Kalina cycle power generation system of FIG. 8.

FIG. 10 is a simplified depiction of the controller 630'" configured for multi-variable control. As indicated, the controller receives signals from sensor 620 representing the condensate level and the RHE and a signal from the sensor 143 representing the state of the vapor leaving the RHE. The processor 636" in accordance with the model incorporated in the logic 636" generates a coordinated signal to the valves 610 and 820 to control the respective flows in a manner which takes into account the interrelationship between the flows. Accordingly, the multi-variable controller 630'" generates signals to the valves 610 and 620 which compensate for the coupling between the control loops.

Figure 11:
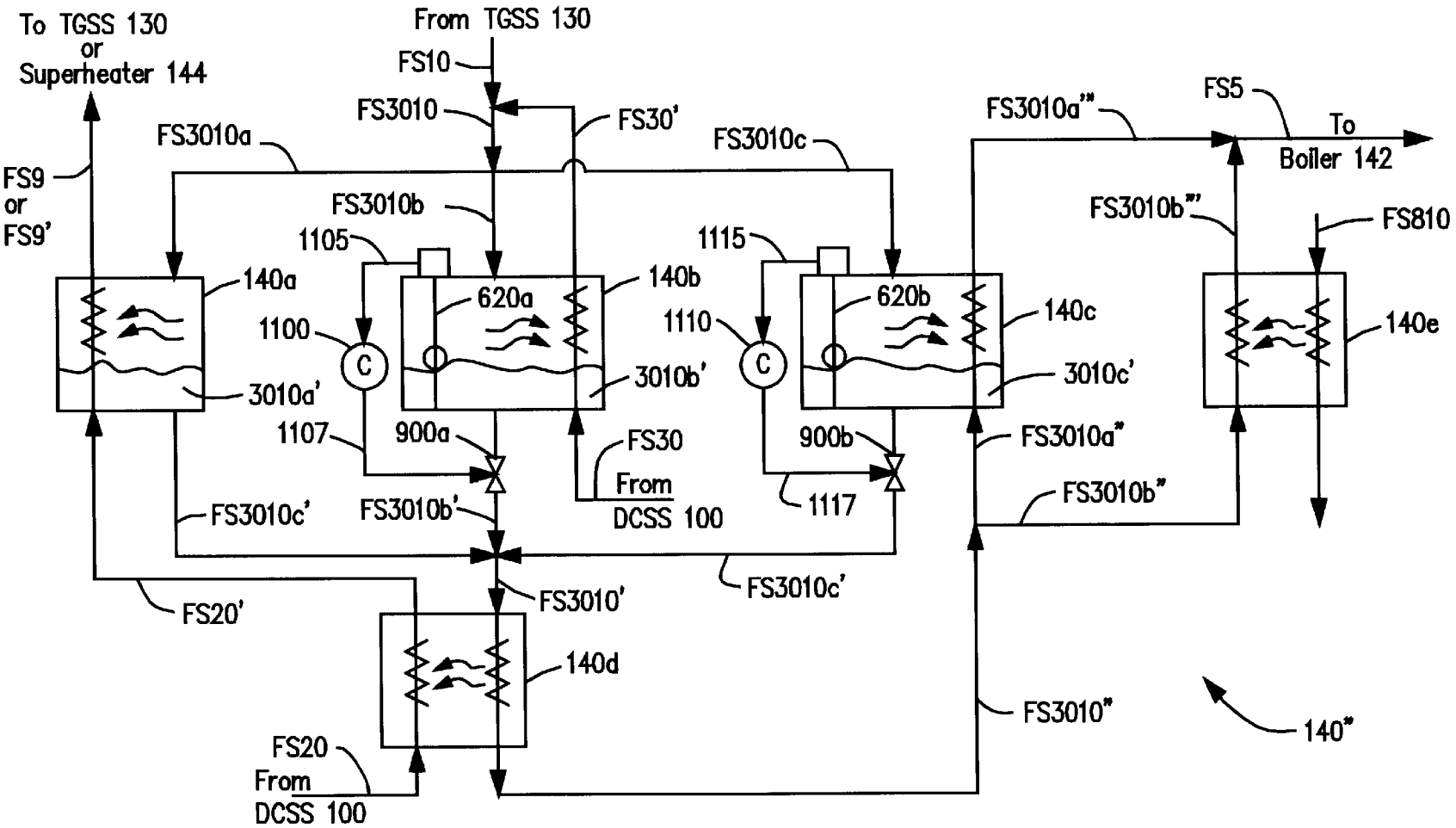
FIG. 11 depicts a configuration of the RHE of the Kalina cycle power generation systems shown in FIGS. 7A and 7B which is particularly suitable for sliding pressure mode operation in accordance with the present invention.

FIG. 11 details certain components of the RHE 140 of FIGS. 7A and 7B. FIG. 11 is similar to FIG. 6 and similar components and flows are identified with identical reference numerals. It should however be noted that the FIG. 11 configuration is specifically for operation in a "sliding pressure model", although it will be recognized that the configuration could also be beneficially used in certain constant pressure system implementations. In a "sliding pressure mode" of operation, the turbine governor valve 640 of FIGS. 7A and 7B could if desired be eliminated. As will be understood, the elimination of the valve 640 will provide a significant system cost benefit.

Figure 6:
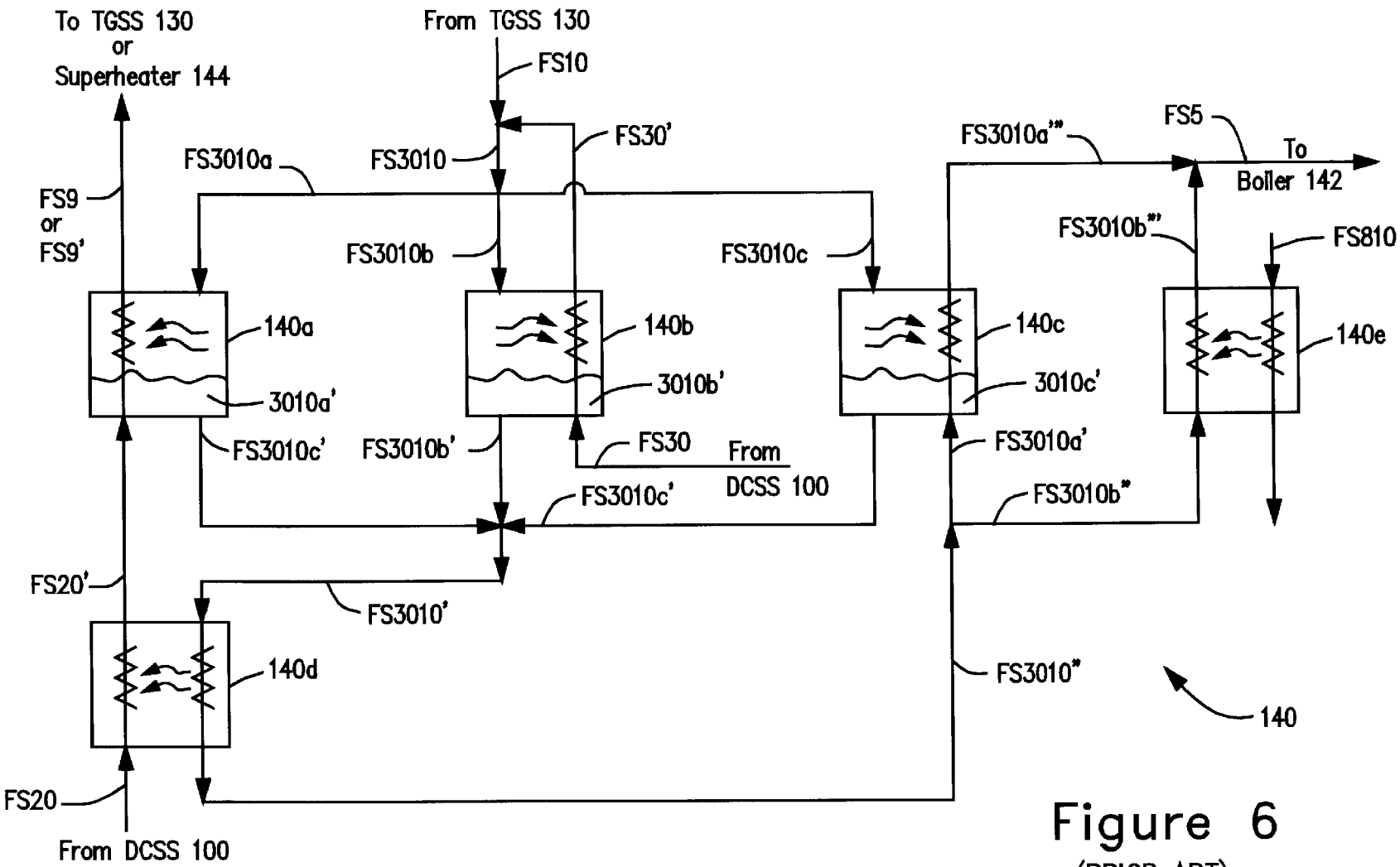
Figure 6 (PRIOR ART)
FIG. 6 details the RHE of the Kalina cycle power generation system of FIGS. 5A and 5B.

To compensate for the pressure changes in "sliding pressure mode" operation, certain changes in the conventional flow splits shown in FIG. 6 may be required to avoid system imbalance. This is because when the pressure in the system changes the thermodynamic properties of the working fluid will change and therefore the transfers of temperature between working fluid flows will also change.

As shown in FIG. 11, the secondary heat exchangers **140*b* and 140*c* are provided with condensate level sensors 620*a* and 620*b* which generate signals representing the current level or amount of condensed working fluid in their respective condensation chambers. The sensors transmit the signals via lines 1105 and 1115 to local controllers 1100 and 1110, respectively. It should be noted that the main system controllers shown in FIGS. 7A and 7B could be configured to perform the functions of local controllers 1100 and 1110 if so desired. The controller, in accordance with its incorporated or programmed logic, generates signals to the valves 900*a* and 900*b* based upon the received signals, in the same way as has been discussed above in connection win the control of the valve 610 of FIGS. 7A and 7B. The signals are transmitted from the controllers 1100 and 1110 to the respective valves 900*a* and 900*b* via lines 1107 and 1117**, respectively.

Responsive to the signals, the valves **900*a* and 900*b* operate to open or close to thereby adjust the respective flows of the streams FS 3010*b*' and FS 3010*c*', as applicable, in accordance with the received signals. The respective adjusted flow rates of the streams of each of the condensate flows, i.e., FS 3010*b*' and FS 3010*c*', compensate for any imbalances caused by changes in the system pressure. More particularly, by adjusting the flows using valves 900*a* and 900*b*, the level of the respective condensate chambers of heat exchangers 140*b* and 140*c* can be varied. This will increase or decrease, as appropriate, the heat transfer area within each exchanger which will in turn change the amount of vapor being condensed. In particular, based upon the adjusted flow rate(s), the stream FS 3010*b* will transfer more or less heat in the secondary heat exchanger 140*b* to the flow FS 30 and thereby create more or less secondary condensate 3010*b*' to be fed as stream FS 3010*b*' from the heat exchanger 140*b*. The stream FS 3010*c* will transfer more or less heat in the secondary heat exchanger 140*c* to the flow FS 3010*a*" and thereby create more or less secondary condensate 3010*c*' to be fed as stream FS 3010*c*' from the heat exchanger 140*c***.

As an alternative to the FIG. 11 control configuration, rather than control the flows of the condensate from the secondary heat exchanges **140*b* and 140*c*, the concentrations of the lean hot flows entering the condensing heat exchangers 140*a*–140*c* can be controlled to obtain proper heat transfer and 10** flow balance over varying operating and environmental conditions, including operation in a "sliding pressure mode".

Figure 12:
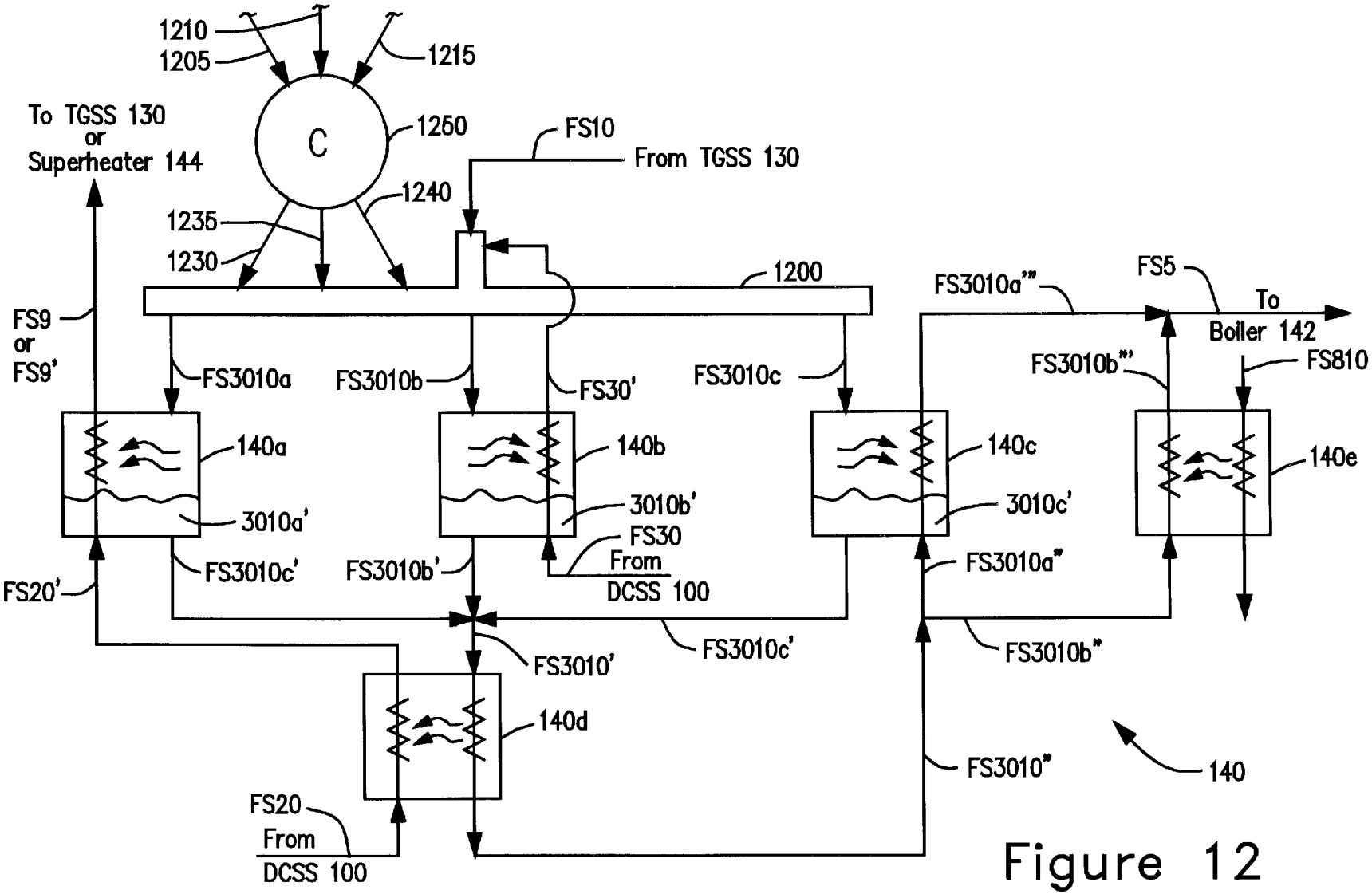
FIG. 12 depicts another configuration of the RHE of the Kalina cycle power generation systems shown in FIGS. 7A and 7B which is particularly suitable for sliding pressure mode operation in accordance with the present invention.

FIG. 12 details certain components of the RHE 140 of FIGS. 7A and 7B and/or the RHE 140' of FIG. 8. FIG. 12 is similar to FIG. 6 and similar components and flows are 15 identified with identical reference numerals. Although the RHE of FIG. 12 is configured specifically for operation in a "sliding pressure mode", it should be understood that the configuration could also be beneficially used in certain constant pressure system implementations. As noted above, in sliding pressure mode", the turbine governor valve 640 of FIGS. 7A and 7B could, if desired, be eliminated to provide a significant system cost benefit.

As shown in FIG. 12, a concentration adjuster 1200 is provided to control the concentrations of the flows FS 3010*a*, 3010*b* and 3010*c* to the heat exchangers 140*a*–140*c*. For example, pressure information may be received from the main system controller or a sensor (not shown) located, for example, at the turbine inlet, or condensate level information of the type described above in the description of FIG. 11 may be received from sensors installed in each of the condensation chambers of heat exchangers 140*a*, 140*b* and 140*c* representing the current level or amount of condensed working fluid in the respective chambers. Signals representing this information are transmitted via one or more of lines 1205, 1210 and 1215 to local controller 1250. It should be noted that the main system controllers shown in FIGS. 7A and 7B could be configured to perform the functions of local controller 1250 if so desired. The controller 1250, in accordance with its incorporated or programmed logic, generates signals to the concentration adjuster 1200 based upon the received signal(s). The signals are transmitted from the controller 1250 to one or more valves, as will be described further below, via one or more of the lines 1230, 1235 and 1240. Responsive to the signals the valves operate to open or close to thereby adjust the concentration of the streams FS 3010*a*, FS 3010*b* and FS 3010*c*, as applicable, in accordance with the received signals.

The respective adjusted flow concentrations of each of the condensate flows FS 3010*a*, FS 3010*b* and FS 3010*c* compensate for any imbalances caused by changes in the system pressure or other varying conditions. More particularly, by adjusting the control valves, the concentration of the respective input streams FS 3010*a*, FS 3010*b* and FS 3010*c* to heat exchangers 140*a*, 140*b* and 140*c*, respectively, can be varied. This will increase or decrease, as appropriate, the heat transfer characteristics of the hot lean stream within each exchanger which will in turn change the amount of vapor being condensed. In particular, based upon the adjusted concentrations, the stream FS 3010*a* will transfer more or less heat in the secondary heat exchanger 140*a* to the flow FS 20' and thereby create more or less primary condensate 3010*a*' to be fed as stream FS 3010*a*' from the heat exchanger 140*a*. The stream FS 3010*b* will transfer more or less heat in the secondary heat exchanger 140*b* to the flow FS 30 and thereby create more or less secondary condensate 3010*b*' to be fed as stream FS 3010*b*' from the heat exchanger 140*b*. Finally, the stream FS 3010*c* will transfer more or less heat in the secondary heat exchanger 140*c* to the flow FS 3010*a*" and thereby create more or less secondary condensate 3010*c*' to be fed as stream FS 3010*c*' from the heat exchanger 140*c*.

Figure 13A:
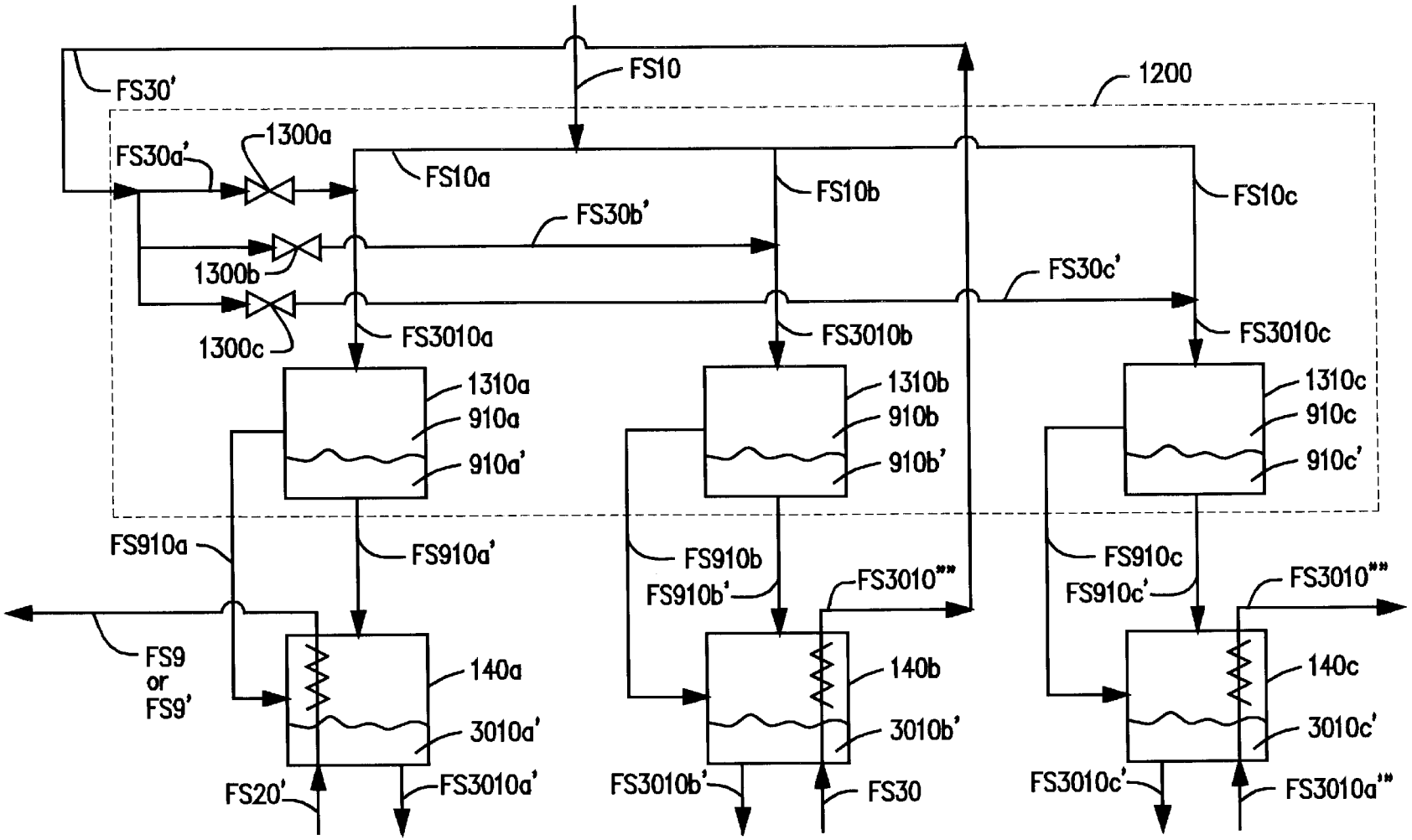
FIG. 13A details certain aspects of a first configuration of the RHE of FIG. 12.
Figure 13B:
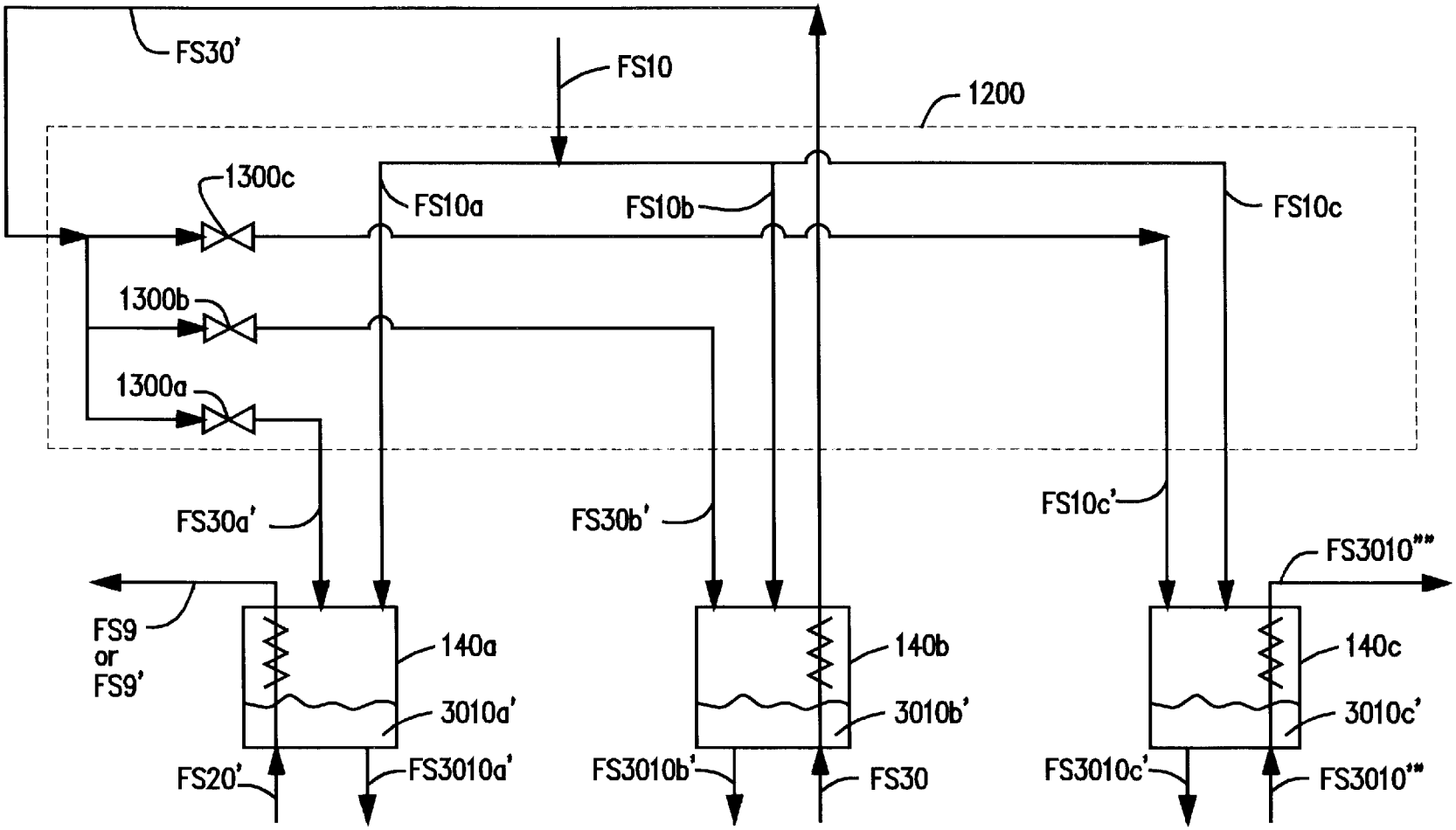
FIG. 13B details certain aspects of a second configuration of the RHE of FIG. 12.
Figure 13C:
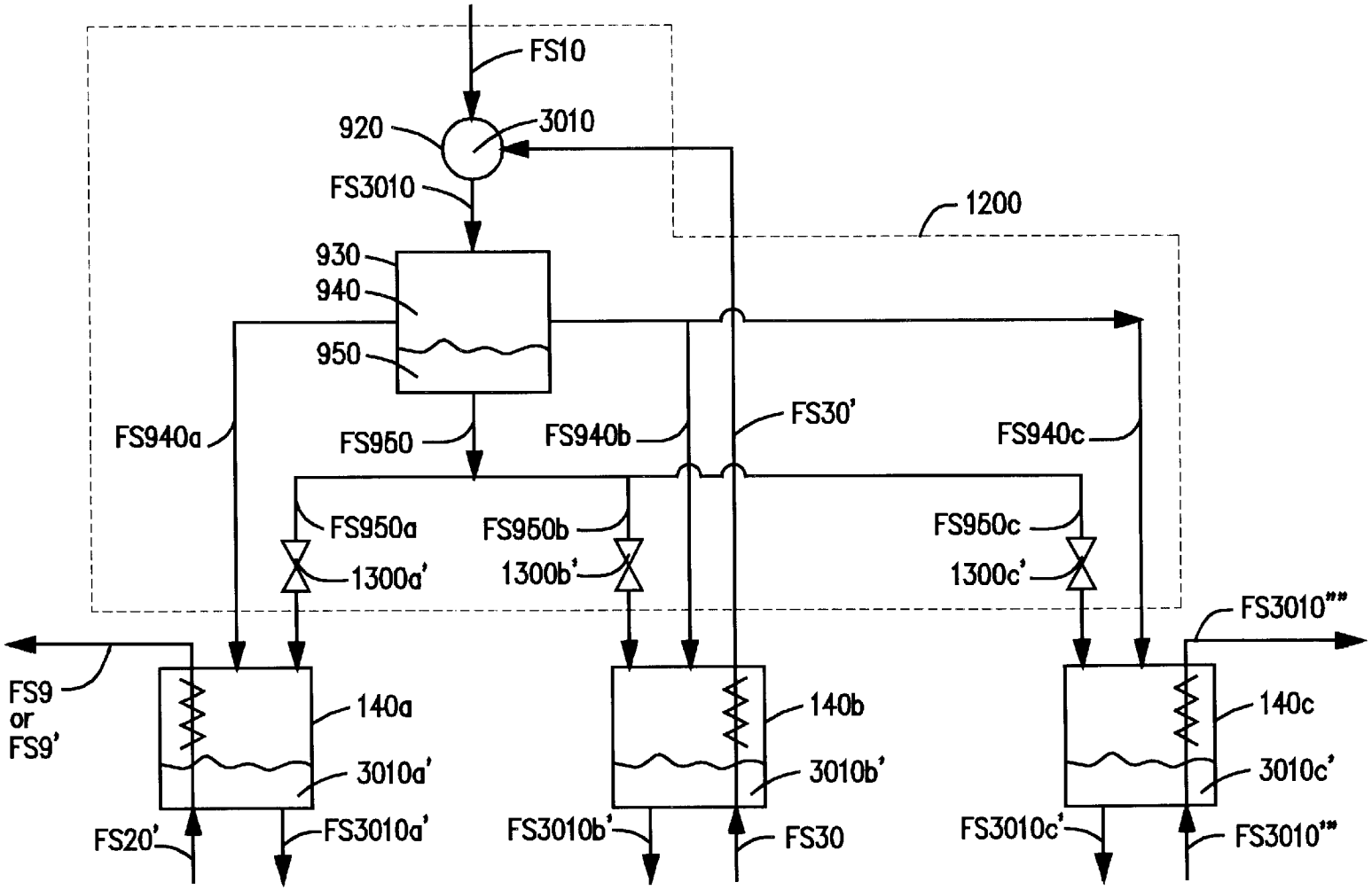
FIG. 13C details certain aspects of a third configuration of the RHE of FIG. 12.

FIGS. 13A–13C illustrate exemplary flow splits for the hot lean working fluids performed in concentration adjuster 1200 of FIG. 12. In FIG. 13A, the proportional flow rates of portions of the hot lean working fluid stream FS 30', which corresponds to hot lean working fluid stream FS 30 from the DCSS 100, are controlled to change the concentrations of the hot lean working fluid streams FS 3010*a*, 3010*b* and 3010*c* entering the respective heat exchangers 140*a*–140*c* as shown in FIG. 12.

More particularly, working fluid stream FS 30' is divided into working fluid streams FS 30*a*', FS 30*b*' and FS 30*c*'. The flow rate of the stream FS 30*a*' is regulated by the valve 1300*a*. The flow rate of the stream FS 30*b*' is regulated by valve 1300*b*. While the flow rate of stream FS 30*c*' is regulated by the valve 1300*c*. Each of the valves 1300*a*–1300*c* regulates the flow rate in accordance with control signals received from the controller 1250, as described above with reference to FIG. 12.

The flow hot working fluid flow from the TGSS 130, i.e., working fluid stream FS 10, is divided into respective steams FS 10*a*, FS 10*b*, and 10*c*. Each of the divided working fluid streams FS 10*a*–FS 10*c* is directed to one of the condensing heat exchangers, the working fluid stream FS 10*a* being directed to the heat exchanger 140*a*, the working fluid stream FS 10*b* being directed to the heat exchanger 140*b*, and the working fluid stream FS 10*c* being directed to the heat exchanger 140*c*. Prior to reaching the applicable heat exchanger, each of the divided working fluid streams FS 10*a*–FS 10*c* from the TGSS 130 is combined with a respective one of the controlled divided working fluid streams FS 30*a*'–FS 30*c*'. Specifically, working fluid stream FS 10*a* is combined with working fluid stream FS 30*a*' to form working fluid stream is 3010*a*. Because the combination of the streams may, in practice, occur only a short distance from the heat exchanger 140*a*, it is possible that the remaining distance will be insufficient for a thorough mixing of the streams before entering the exchanger.

Accordingly, the combined stream FS 3010*a* is first directed to a mixing chamber 1310*a* where the vapor portion 910*a* and the liquid portion 910*a*' which form the input stream FS 3010*a* are separated and separately mixed. The mixed vapor portion 910*a* is directed as vapor stream FS 910*a* to the heat exchanger 140*a* and mixed liquid portion 910*a*' is separately directed as liquid stream FS 910*a*' to the heat exchanger 140*a*. It should be noted that the streams FS 910*a* and FS 910*a*' together form the stream FS 3010*a* shown in FIG. 12 as input to the exchanger 140*a*. The combined stream FS 3010*b* is first directed to a mixing chamber 1310*b* where the vapor portion 910*b* and the liquid portion 910*b*' which form the input stream FS 3010*b* are separated and separately mixed. The mixed vapor portion 910*b* is directed as vapor stream FS 910*b* to the heat exchanger 140*b* and mixed liquid portion 910*b*' is separately directed as liquid stream FS 910*b*' to the heat exchanger 140*b*. The streams FS 910*b* and FS 910*b*' together form the stream FS 3010*b* shown in FIG. 12 as input to the exchanger 140*b*. The combined stream FS 3010*c* is first directed to a mixing chamber 1310*c* where the vapor portion 910*c* and the liquid portion 910*c*' which form the input stream FS 3010*c* are separated and separately mixed. The mixed vapor portion 910*c* is directed as vapor stream FS 910*c* to the heat exchanger 140*c* and mixed liquid portion 910*c*' is separately directed as liquid streamed FS 910*c*' to the heat exchanger 140*c*. Here again, the streams FS 910*c* and FS 910*c*' together form the stream FS 3010*c* shown in FIG. 12 as input to the exchanger 140*c*.

FIG. 13B is similar to FIG. 13A, except, however, the mixing chamber is eliminated and the streams from the TGSS 130 and DCSS 100 are separately directed to the heat exchangers. In the FIG. 13B configuration, the proportional flow rates of portions of the hot lean working fluid stream FS 30' are controlled, similar to as in the FIG. 13A configuration, to change the concentrations of the hot lean working fluid streams FS 3010*a*, 3010*b* and 3010*c* entering the respective heat exchangers 140*a*–140*c* as shown in FIG. 12.

More particularly, working fluid stream FS 30' is divided into working fluid streams FS 30*a*', FS 30*b*' and FS 30*c*'. The flow rate of the stream FS 30*a*' is regulated by the valve 1300*a*. The flow rate of the stream FS 30*b*' is regulated by valve 1300*b*. While the flow rate of stream FS 30*c*' is regulated by the valve 1300*c*. Each of the valves 1300*a*–1300*c* regulates the flow rate in accordance with control signals received from the controller 1250 as described above with reference to FIG. 12. Each of the divided working fluid streams FS 30*a*'–FS 30*c*' directly enters into one of the condensing heat exchangers, the working fluid stream FS 30*a*' being directed to the heat exchanger 140*a*, the working fluid stream FS 30*b*' being directed to the heat exchanger 140*b*, and the working fluid stream FS 30*c*' being directed to the heat exchanger 140*c*.

The hot working fluid flow from the TGSS 130, i.e., working fluid stream FS 10, is divided into respective streams FS 10*a*, FS 10*b* and FS 10*c*. Each of the divided working fluid streams FS 10*a*–FS 10*c* directly enters into one of the condensing heat exchangers, the working fluid stream FS 10*a* being directed to the heat exchanger 140*a*, the working fluid stream FS 10*b* being directed to the heat exchanger 140*b*, and the working fluid stream FS 10*c* being directed to the heat exchanger 140*c*. The respective input streams are mixed in the chamber of heat exchanger 140*a*–140*c*. It should be noted that the streams FS 30*a*' and FS 10*a* together form the stream FS 3010*a* shown in FIG. 12 as input to the exchanger 140*a*, the streams FS 30*b*' and FS 10*b* together form the stream FS 3010*b* shown in FIG. 12 as input to the exchanger 140*b*, and the streams, FS 30*c*' and FS 10*c* together form the stream FS 3010*c* shown in FIG. 12 as input to the exchanger 140*c*.

FIG. 13C is similar to FIG. 13A, except, however, a single mixing valve and a separator, rather than multiple mixing chambers, are provided and portions of the combined streams from the TGSS 130 and DCSS 100 are separately directed to the heat exchangers. In FIG. 13C, the proportional flow rates of portions of the hot lean liquid working fluid stream separated from stream FS 3010, are adjusted to change the concentrations of the hot lean working fluid streams FS 3010*a*, FS 3010*b* and FS 3010*c* entering the respective heat exchangers 140*a*–140*c*, as shown in FIG. 12.

More particularly, working fluid streams FS 30' and FS 10 are mixed in the mixing valve 920 to form hot lean working fluid FS 3010. The mixed working fluid stream FS 3010 is directed to the separator 930, where the vapor portion 940 of the working fluid stream 3010 is separated from the liquid portion 950 of the stream 3010. The liquid working fluid stream FS 950 is divided into working fluid streams FS 950*a*, FS 950*b* and FS 950*c*. The flow rate of the stream FS 950*a* is regulated by the valve 1300*a*'. The flow rate of the stream FS 950*b* is regulated by valve 1300*b*'. While the flow rate of stream FS 950*c* is regulated by the valve 1300*c*'. Each of the valves 1300*a*–1300*c*' regulate the flow rate in accordance with control signals received from the controller 1250 as described above with reference to FIG. 12.

The hot vapor working fluid 940, is divided into respective steams FS 940*a*, FS 940*b* and FS 940*c*. Each of the divided working fluid streams FS 940*a*–FS 940*c* is directed to one of the condensing heat exchangers, the working fluid stream FS 940*a* being directed to the heat exchanger 140*a*, the working fluid stream FS 940*b* being directed to the heat exchanger 140*b*, and the working fluid stream FS 940*c* being directed to the heat exchanger 140*c*.

In the heat exchanger 140*a*, the vapor from stream FS 940*a* is mixed with the liquid from stream FS 950*a*, which is separately directed to the heat exchanger 140*a*.

It should be noted that the streams FS 940*a* and FS 950*a* together form the stream FS 3010*a* shown in FIG. 12 as input to the exchanger 140*a*. In the heat exchanger 140*b*, the vapor from stream FS 940*b* is mixed with the liquid from stream FS 950*b*, which is separately directed to the heat exchanger 140*b*. The streams FS 940*b* and FS 950*b* together form the stream FS 3010*b* shown in FIG. 12 as input to the exchanger 140*b*. In the heat exchanger 140*c*, the vapor from stream FS 940*c* is mixed with the liquid from stream FS 950*c*, which is separately directed to the heat exchanger 140*c*. Here again, the streams FS 940*c* and FS 950*c* together form the stream FS 3010*c* shown in FIG. 12 as input to the exchanger 140*c*.

Using the controls described above with reference to FIGS. 11, 12 and 13A–13C satisfactory heat balances can be maintained under various operating and environmental conditions, including the system operation in a "sliding pressure mode". The heat exchanges in the exchangers 140*a*–140*c* can be controlled such that the proper amount of heat is transferred to the applicable streams of working fluid and the stream FS 5 is provided to the boiler -n the desired state.

As discussed with reference to FIG. 7B, the drum level, i.e., the level of liquid in the drum, must be monitored and the feed flow accordingly regulated to ensure sufficient feed fluid to the fluid wall tubes. The drum level may need to be adjusted, for example, to compensate for changing vapor outflow conditions and shrink/swell effects as the heat released by the process heat or the heat absorbed by the working fluid in the furnace varies. The drum level may be controlled using a simple level control loop with single element control. Perhaps more customarily, however, is the use of a three element control which relies on not only the drum level but also a sensed flow of the feed working fluid 105 stream FS 57 of FIG. 7B and a sensed or estimated flow of the vapor from the drum 142*b* in output vapor stream FS 8.

Figure 14:
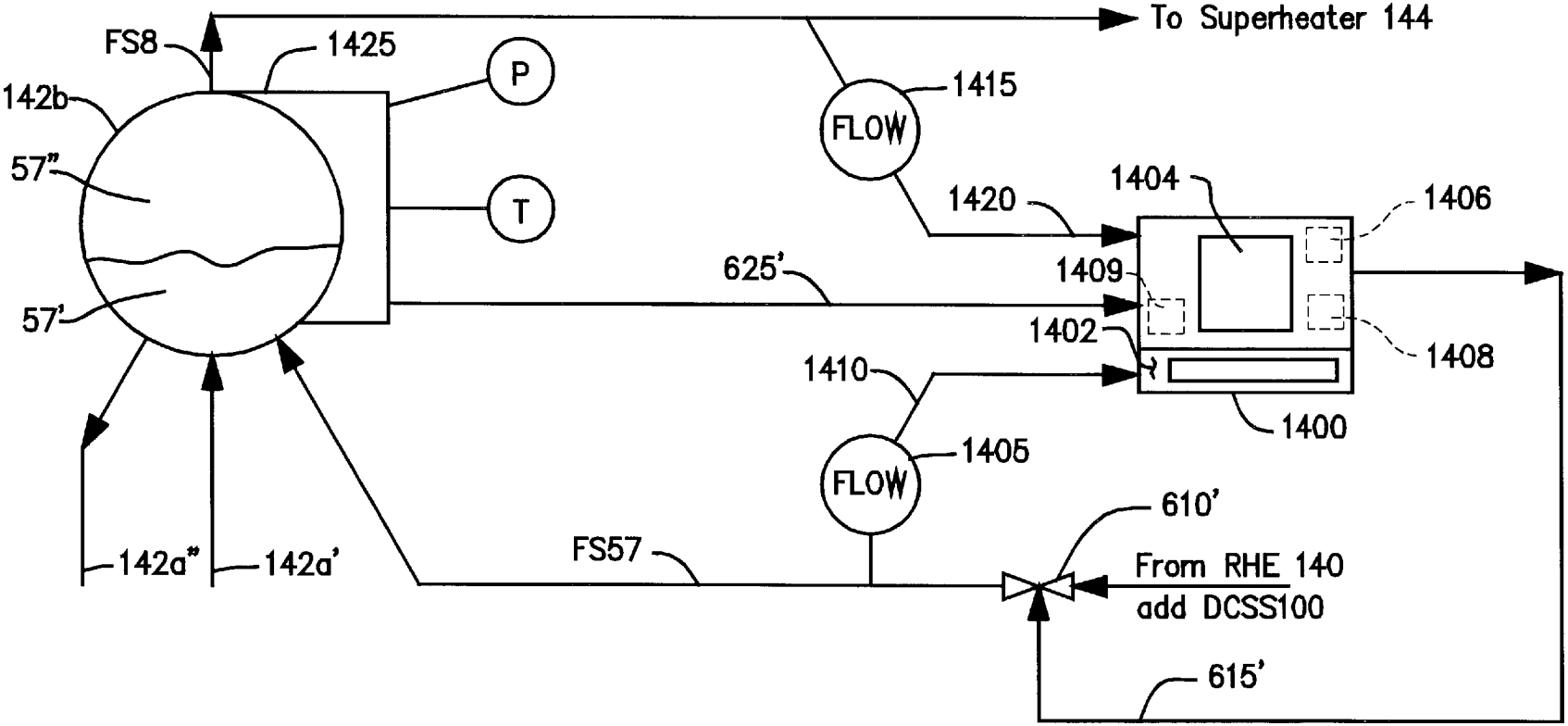
FIG. 14 depicts a drum level control system for the drum of FIG. 7B in accordance with the present invention.

An electromechanical fluid level sensor 620' was described with reference to FIG. 7B for monitoring the drum level. FIG. 14 depicts an electrical sensor 1425 (drawn much larger than scale) which can be used in lieu of the sensor 620' of FIG. 7B to provide the necessary information to facilitate proper control of the drum level in a drum type Kalina cycle power generation system.

As shown in FIG. 14, the boiler drum 142*b* receives feed fluid FS 57 from the RHE 140 and DCSS 100. The flow rate of stream FS 57 is controlled by the valve 610' based upon signals from a controller 1400, which is a modified version of the controller 630' of FIG. 7B, received via the line 615', as has been previously described with reference to FIG. 7B. Vapor working fluid 57" from the boiler tubes 142*a*, and liquid working fluid 57' from the feed liquid stream FS 57 and any wet fluid received from the boiler riser tubes 142*a*', are collected in the drum 142*b*. The vapor 57" comprises an output in the form of vapor stream FS 8 to the superheater 144. The liquid 57' comprises an output in the form of feed fluid to the boiler tubes 142*a*". To maintain the drum level, the inlet flow FS 57 to the drum 142*b* should match the outlet flow FS 8.

The flow of the feed working fluid stream FS 57 is monitored downstream of the valve 610' by a flow sensor 1405. The flow sensor 1405 detects the rate of flow of the stream FS 57 and sends signals via line 1410 to the controller 1400 representing the current rate of flow of the stream FS 57. The flow of the vapor output stream FS 8 is monitored upstream of the superheater 144 by a flow sensor 1415. The flow sensor 1415 detects the rate of flow of the stream FS 8 and sends signals via line 1420 to the controller 1400 representing the current rate of flow of the stream FS 8. The liquid level in the drum 142*b* is monitored by sensor 1425 which sends signals via line 625' to the controller 1400. Using the received information, the controller 1400 generates signals, if appropriate, and directs the transmission of these signals to the valve 610'. Responsive to the received signals, the valve 610' automatically adjusts the rate of flow of the feed working fluid stream FS 57. Hence control is accomplished using a three element, i.e., sensors 1425, 1405 and 1415, drum level control.

In conventional single component working fluid systems, like a conventional steam Rankine cycle system, the change in pressure, actual pressure and the fact that the vapor within the drum is known to be saturated can, as is well known in the art, be used to compute the level of fluid within the drum. Knowing this level and the input and output flows, the input flow can be adjusted to raise or lower the drum level as appropriate. However, in a multi-component system, such as a Kalina cycle power generation system, the concentration of the fluids within the drum may vary. This adds a level of complexity not previously experienced in vapor generation systems. Because of this additional degree of freedom, the conventional techniques of determining the drum level are no longer valid, since concentration variations will result in the density of the fluids within the drum changing from time to time.

Accordingly, unlike the conventional drum level sensors which sense and provide information to the controller representing only a pressure P within the drum, the sensor 1425 in addition to detecting the drum pressure P also detects the temperature within the drum. More particularly, the sensor 1425, which could be multiple separate sensors if desired, detects both the current pressure and current temperature of the fluid within the drum 142*b*. The sensor 1425 also generates signals representing the detected temperature and pressure and outputs these signals which are transmitted via communication line 625' to the controller 1400.

The controller 1400 includes a keyboard 1402 for receiving user inputted information and a monitor 1404 for displaying information to the user. As previously discussed with reference to controllers 630 of FIG. 7A and 630' of FIG. 7B, other types of input and output devices could be used if so desired. The controller 1400 also includes stored logic 1406 which, as discussed above with reference to controllers 630 and 630', may be hardware logic or software stored on a medium such as memory 1409. It should be noted that the logic could include the logic discussed above with reference to controllers 630 and 630' as desired. If so the logic could be stored on memory 1409.

The controller 1400 also includes processor 1408 for processing, in accordance with the logic 1406, information received from the sensors 1405, 1415 and 1425 via communications lines 1410, 1420 and 625', respectively. The processor 1408, in accordance with the logic 1406, also generates and directs the transmission of control signals to the valve 610' via communications lines 615', responsive to which the motorized valve 610' operates to increase or decrease the amount of flow in fluid stream FS 57 to increase or decrease the drum level. As noted above, the processor may also, if desired, process information and generate control signals as discussed above with reference to other controllers. The logic 1406 includes an algorithm and/or an access instruction to a look-up table having a thermodynamic index for determining the density of the fluid within the drum and/or other data stored on a memory 1409 of controller 1400 which can be used to determine the drum level and the amount of valve adjustment required for flow balancing based upon the computed drum fluid level.

In operation, the sensor 1425 monitors the current pressure and temperature of the working fluid in the drum 142*b*, and generates and transmits signals to the controller 1400 representing this information. The sensor 1405 monitors the current flow rate of the feed working fluid in stream FS 57, i.e., the input flow to the drum 142*b*, and generates signals, which are transmitted to the controller 1400 via line 615', representing the detected information. The sensor 1415 monitors the current flow rate of the vapor stream FS 8, i.e., the output flow from the drum 142*b*, and generates and transmits signals to the controller 1400 representing the vapor flow rate. As discussed above, this sensor could, if desired, be eliminated and the output flow estimated as is well known to those skilled in the art.

The controller 1400 processes the received information in accordance with the logic 1406. In this regard, the processor 1408, in accordance with the logic instructions 1406, retrieves from memory 1409, previously received and stored pressure information to obtain most recent prior drum pressure. From the retrieved prior pressure information and the received current pressure information, the processor 1408 computes a delta-pressure ($\Delta P$). Using the current pressure, current temperature and the fact that it is know that the vapor 57" is saturated, the processor 1408 preferably accesses a look-up table having a thermodynamic index from which the density of the working fluid within the drum can be determined. As noted above, an algorithm could alternatively be included in the logic 1406 and used by the processor 1408 to compute the density based upon the aforementioned data. Using the $\Delta P$, current pressure and density, the processor 1408 can compute or access another look-up table to determine the drum level, as will be well understood by those skilled in the art.

If the processor 1408 determines, for example by comparing the current drum level to a prior drum level or to a predefined set point or to some other desired drum level, that a change in the level of the collected drum liquid 57' is required, the controller 1408 generates and transmits, in accordance with the logic 1406, a signal to the motorized valve 610' to either increase or decrease the amount of flow to the drum 142*b* in stream FS 57.

Figure 5C:
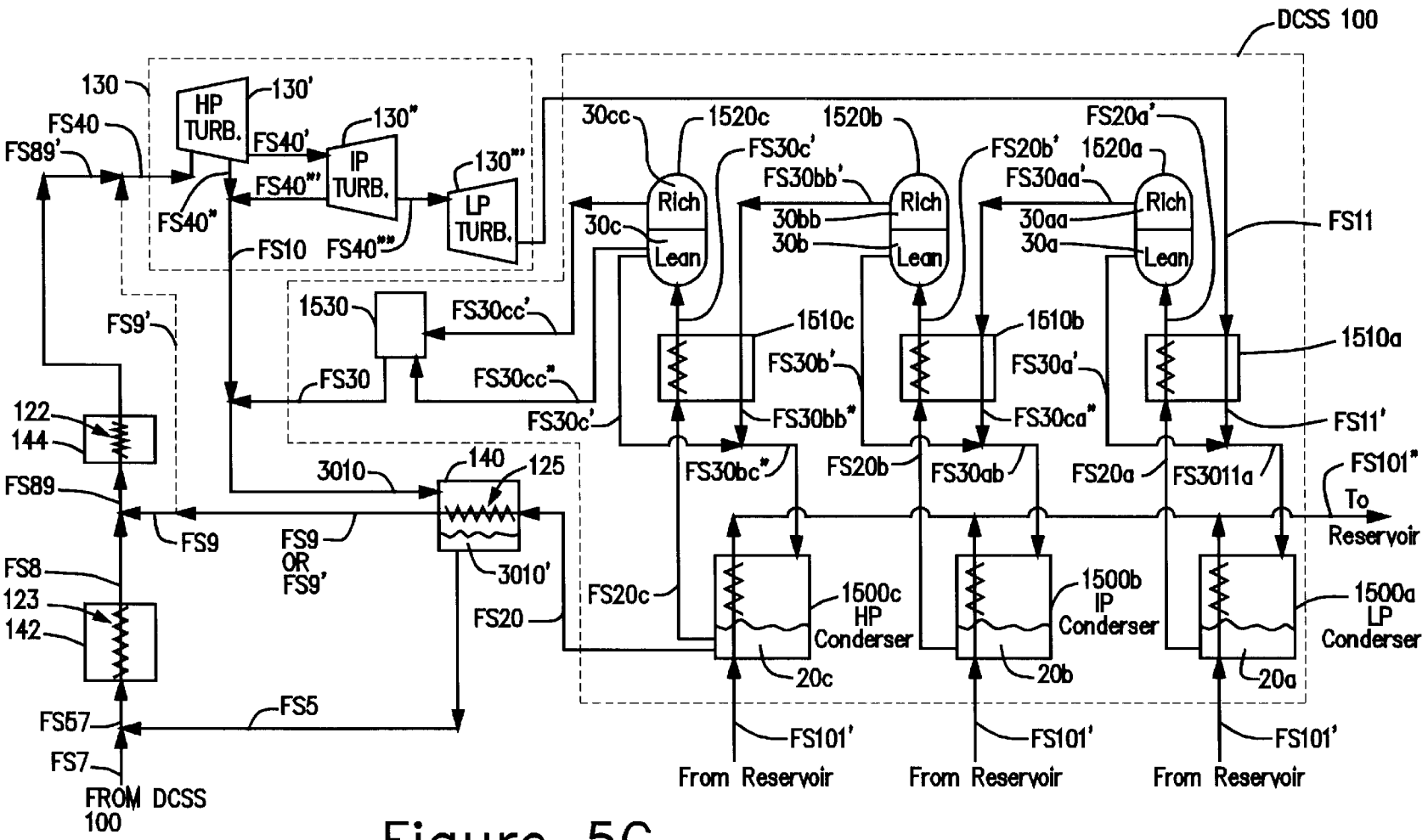
Figure 5C (PRIOR ART)
FIG. 5C depicts the conventional Kalina cycle power generation system of FIG. 5A with a somewhat more detailed representation of the DCSS.
Figure 15A:
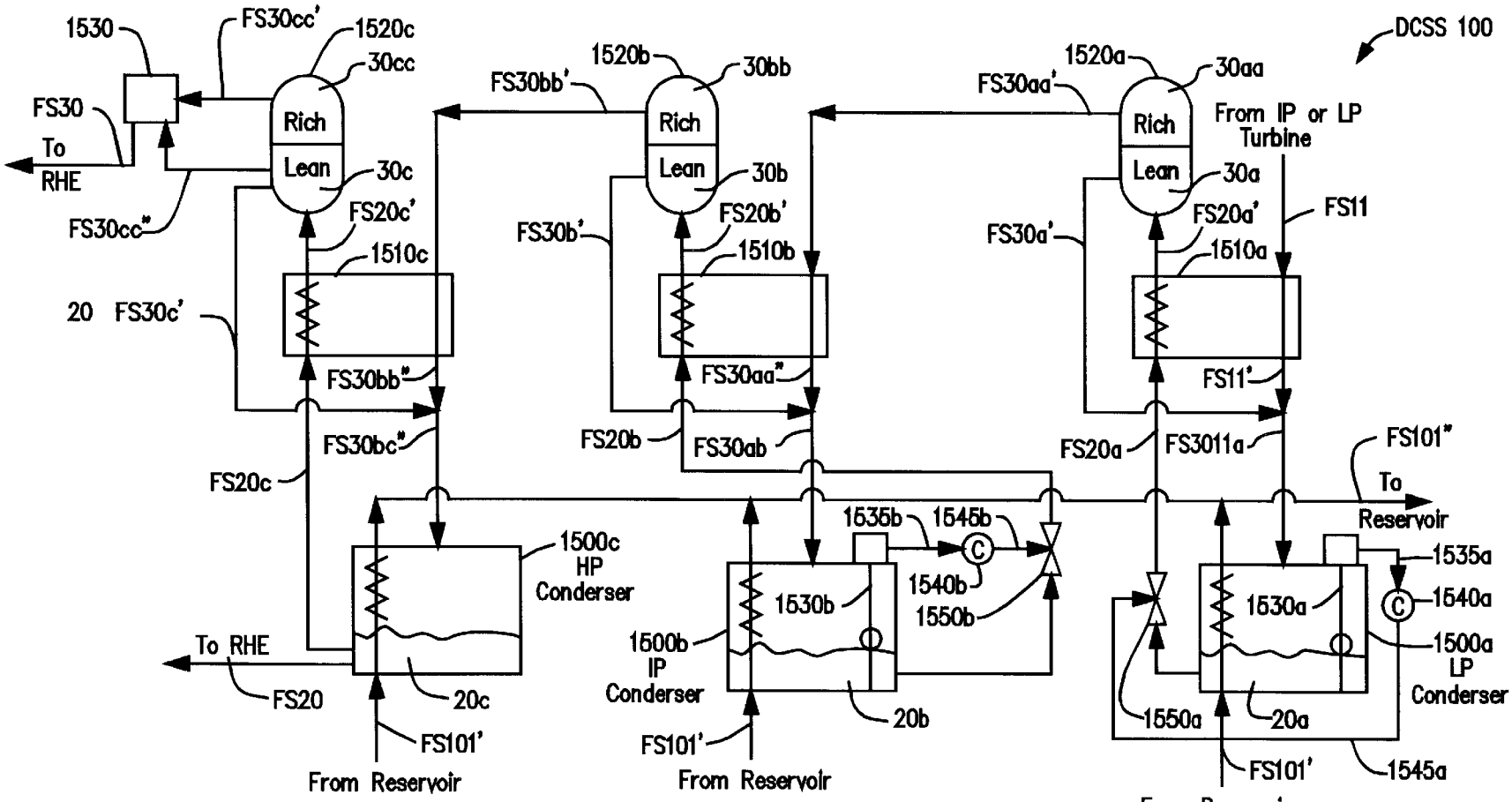
FIG. 15A depicts a first embodiment of a condensation level control system suitable for use in the DCSS of FIGS. 7A–7C in accordance with the present invention.

FIG. 15A details certain components of DCSS 100 suitable for use in the power generation systems of FIGS. 7A–7C and 8. As shown in FIG. 15A the DCSS 100 includes a cascading series of condensers, heat exchangers and separators as have been described above with reference to FIG. 5C, similar components and flows being identified with identical reference numerals. It should however be noted that the FIG. 15A configuration includes level detectors, local controllers and valves which are not present in the conventional Kalina cycle power generation system of FIG. 5C.

More particularly, during variations in operating conditions, the amount of vapor exhaust from the IP or LP turbine may increase or decrease. As discussed above, in commercially operated systems such changes may be difficult, if not impossible, to predict. These changes could result in one or more of the condensers of the conventional Kalina cycle power generation system DCSS shown in FIG. 5C either becoming drained or flooded. Accordingly, as shown in FIG. 15A, condensate level sensor 1530*a* detects the level of condensate 20*a* in the LP condensers 1500*a*. A condensation level sensor 1530*b* is also provided to detect the level of condensate 20*b* collected in the collection chamber of IP condenser 1500*b*. Each of the sensors 1530*a* and 1530*b* generate respective signals representing the detected level or amount of condensed working fluid and transmit the signals via lines 1535*a* or 1535*b* to a local controller 1540*a* or 1540*b*, respectively. It should be noted that the main system controller shown in FIGS. 7A–7C and 8 could be configured to perform the functions of local controllers 1540*a* and 1540*b*, if so desired. Each of the controllers, in accordance with its incorporated or programmed logic, generates signals to valve 1550*a* or 1550*b* via line 1545*a* or 1545*b*, respectively. The valves 1550*a* and 1550*b* are beneficially motorized valves which responsive to the signals received from its respective local controller each operate to regulate the flow of condensate from its associated condenser.

In this regard, variations in operating conditions which result in an increase in exhaust from the IP or LP turbine and hence an increase in the flow of stream FS 11 will result in an increase in the amount of condensate 20*a*, and hence the level of condensate, in the LP condenser 1500*a*. Such a change in operating conditions will also increase the demand for the rich working fluid provided to the RHE by liquid stream FS 20. Should no action be taken and such modified conditions continue over some period of time, there is a significant risk that the LP condenser 1500*a* could become flooded due to the increased flow in stream FS 11 and HP condenser 1500*c* could become drained due to the increased demand for condensate 20*c* forming the rich liquid stream FS 20. Accordingly, the local controller 1540*a*, upon receiving a signal from the sensor 1530*a* indicating an increase in the condensate level, will direct the valve 1550*a* to operate so as to increase the flow of stream FS 20*a* to maintain the condensate 20*a* at a predetermined desired level. Preferably the desired level is fixed, accordingly the controller 1540*a* immediately directs the valve 1550*a* to increase the flow of FS20*a* as soon as any increase in the level of condensate 20*a* is detected by sensor 1530*a*. By increasing the flow of stream FS 20*a*, the amount of rich vapor 30*aa* is increased in the separator 1520*a*. And a greater flow of rich vapor 30*aa* is provided to the IP condenser 1500*b*.

Because of the increased flow of stream FS 30*aa*', the amount of condensate 20*b* will subsequently increase. Sensor 1530*b* detects the increase in the condensate level and generates a signal to the controller 1540*b*. In response, the controller 1540*b* directs a signal to valve 1550*b* which opens to increase the flow of liquid stream FS 20*b* to the separator 1520*b*. Here again, the condensate level in IP condenser 1500*b* is preferably maintained at a fixed level and accordingly any increase in the amount of condensate 20*b* is immediately addressed by opening or closing the valve 1550*b* to increase or decrease the rate of flow of stream FS 20*b*. Due to the increased flow of stream FS 20*b*, the amount of rich vapor 30*bb* in separator 1520*b* is also increased and accordingly the stream FS 30*bb*' to the HP condenser 1500*c* is also increased. The flow of condensate from the HP condenser 1500*c* to the separator 1520*c* and to the RHE 140 are left unregulated. Accordingly, the level of condensate 20*c* collected in the chamber of the HP condenser 1500*c* is allowed to fluctuate to some extent. This in turn allows the flow of stream FS 20 to be determined solely at the RHE without the need to coordinate a regulation on the flow of the condensate 20*c* at the DCSS.

It will be recognized that should the variation and the operating condition result in less flow in stream FS 11, the reduction in the levels of condensate 20*a* and 20*b* will be detected by the sensors 1530*a* and 1530*b* and the controllers 1540*a* and 1540*b* will direct the operation of the valves 1550*a* and 1550*b*, respectively, to reduce the respective flows of streams FS 20*a* and FS 20*b* to thereby avoid possible draining of LP condenser 1500*a* and flooding of HP condenser 1500*c*. It will also be noted that during startup operations, the valve 1550*a* can be controlled by the controller 1540*a* to reduce the flow of stream FS 20*a* until a sufficient level a of condensate has been established in the LP condenser 1500*a*. Similarly the controller 1540*b* can control the operation of valve 1550*b* to limit the flow of stream FS 20*b* until a sufficient level of condensate has been established in the IP condenser 1500*b*. Only after the desired condensate level in the LP and IP condensers 1500*a* and 1500*b*, respectively, have been established, is an operational flow of stream FS 30*bb*' provided to the HP condenser 1500*c*.

Accordingly, using a simple control configuration requiring relatively small and inexpensive valves to control the flow from only certain of a cascading series of condensers within the DCSS, condenser flooding and draining can be avoided during periods of increased or decreased load or other modified operating conditions. Further, the flow of the rich liquid stream FS 20 to the RHE 140 is completely controlled based upon the demands of the VSS 110, without the need to coordinate with controls within the DCSS 100. Accordingly, conflicts between the VSS 110 controls and the DCSS 100 controls are avoided.

Figure 15B:
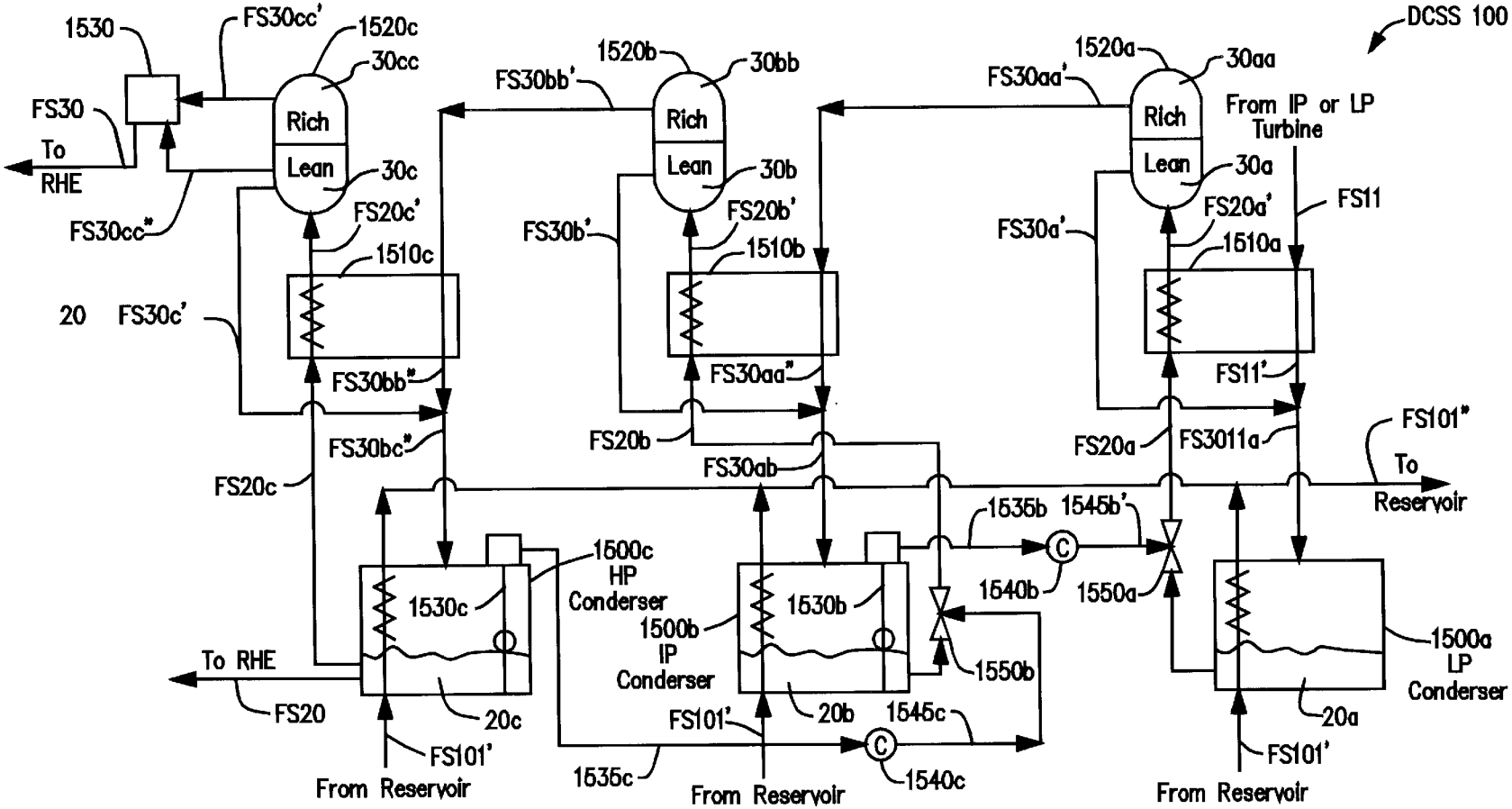
FIG. 15B depicts a second embodiment of a condensation level control system suitable for use in the DCSS of FIGS. 7A–7C in accordance with the present invention.

Referring now to FIG. 15B, an alternative control configuration is shown. As indicated, sensor 1530*a* of FIG. 15A has been eliminated and a new sensor 1530*c* for monitoring the condensate level in the HP condenser 1500*c* has been added. The control configuration of FIG. 15B may be preferable under certain circumstances to the configuration shown in FIG. 15A. For example, this might be the case if a fast response to operational condition changes, e.g., load changes, is particularly desirable. As shown, as the demand for the rich liquid condensate which flows to the RHE via stream FS 20 increases or decreases, the level of condensate 20*c* in the HP condenser 1500*c* correspondingly increases or decreases. The sensor 1530*c* detects this change in the condensate level and generates a signal which is transmitted via line 1535*c* to the controller 1540*c*. Responsive to the receipt of the signal from the sensor 1530*c*, the controller generates and transmits a signal via line 1545*c* to the valve 1550*b*. The valve 1550*b* regulates the flow of the condensate 20*b* from the IP condenser 1500*b* to increase the flow FS 20*b* to the separator 1520*b*, thereby increasing the rich vapor 30*bb* which is directed to the HP converter 1500*c* via stream FS 30*bb*'. Accordingly, an increased or decreased amount of working fluid is made available at the HP converter 1500*c*, which will either increase or decrease, as applicable, the amount of working fluid being added to the condensate 20*c* at the condenser chamber. This increase or decrease in turn allows the condensate to be balanced with the increased or decreased demand for working fluid in stream FS 20.

The adjusted flow of stream FS 20 from the IP condenser 1500*b* will result in the sensor 1530*d* detecting an increase or decrease in the level of the condensate 20*b* in the condenser chamber. The sensor 1530*b* generates a signal, which is transmitted via line 1535*b* to the local controller 1540*b*, representing the current level of condensate 20*b*. The local controller 1540*b* processes the received signal and generates a signal which is transmitted, via the line 1545*b*', to the valve 1550*a*. This signal corresponds to the condensate level or level change in the IP condenser chamber. The valve 1550*a* operates in accordance with the received signal to either increase or decrease the flow in stream FS 20*a*, to thereby increase or decrease the amount of working fluid directed to the separator 1520*a*. This will either increase or decrease the availability of rich vapor 30*aa* which can flow, via stream FS 30*aa*', to the IP condenser 1500*b*. Accordingly, an increased or decreased amount of condensate 20*b* can be formed and collected in the IP condenser 1500*b*.

As in the FIG. 15A configuration, preferably the threshold levels of condensate 20*b* and condensate 20*c* are fixed, and accordingly any deviation from the preset fixed level will result in the operation of the valves to increase or decrease flow to the condensers. Because the level of condensate 20*c* is monitored, virtually immediate response to operational changes which affect the demand for superheated vapor to the turbine and/or feed fluid to the fluid walls is provided. However, the flow from the HP condenser 1500*c* in stream FS 20 is left unregulated and therefore no conflict occurs with the flow controls within the VSS 110. In summary, the control configuration shown in FIG. 15A provides a reactive or push control which monitors the turbine exhaust and pushes working fluid from the LP condenser to the HP condenser. On the other hand, the configuration of FIG. 15B reacts to increased demand from the VSS 110 and provides a pull-type system in which responsive to the monitoring of the level of condensate 20*c* the flows from the IP and LP condensers are adjusted.

It may be beneficial under certain conditions to combine the control components of the FIG. 15A and FIG. 15B configurations to provide dual-mode control of the DCSS condensate levels. In this regard, each of the condensate levels within condensers 1500*a*–1500*c* would be monitored by sensors 1530*a*–1530*c*. However, the valves 1550*a* and 1550*b* would be operated in a first mode based only upon the detected condensate levels within the LP condenser 1500*a* and IP condenser 1500*b* and, in a second mode of operation, based only upon the detected condensate levels and the IP condenser 1500*b* and HP condenser 1500*c*. In this way, the DCSS condensate levels can be controlled in response to a change in the turbine exhaust or RHE demand as may be appropriate. It will be recognized by those skilled in the art that each of the heat exchangers shown in FIGS. 7A–15B could be replaced by multiple parallel heat exchangers with each receiving a portion of a hot fluid from which heat is transferred to vaporize in whole or in part, a cold fluid. As described above, the hot fluid often has a smaller concentration of ammonia, i.e., the low boiling point component, of the ammonia/water working fluid as compared to the cold fluid. This is typically the case in the heat exchanges of the RHE 140 and DCSS 100.

Figure 16:
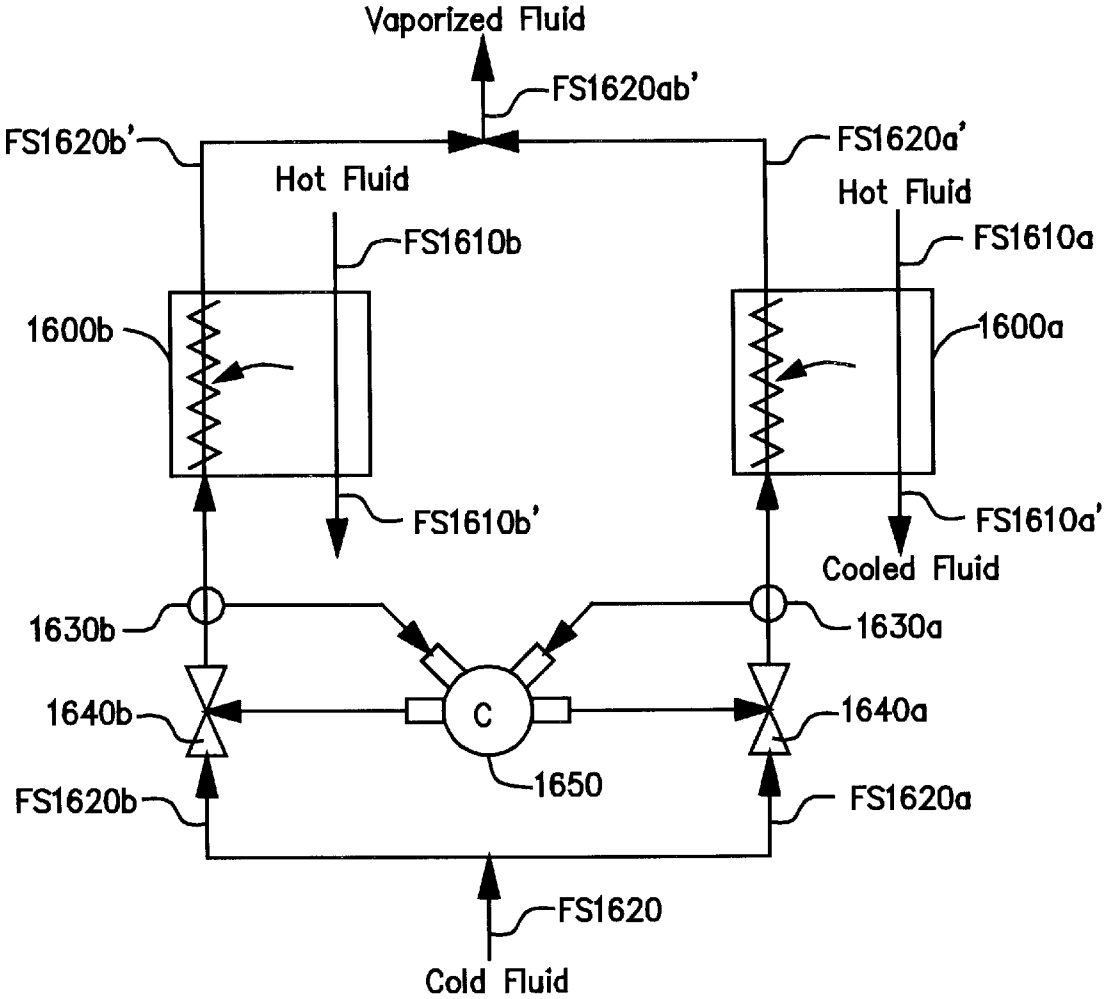
FIG. 16 depicts a control system for parallel heat exchangers suitable for use in the RHE and DCSS of FIGS. 7A–7C in accordance with the present invention.

FIG. 16 depicts an arrangement of parallel heat exchangers 1600*a* and 1600*b*. A flow of hot fluid, which could be the hot lean flow FS 3010 to the RHE 140, the expanded vapor exhaust flow FS 11 to the DCSS 100 or some other hot flow within the VSS 110 or DCSS 100, is split and directed as a flow FS 1610*a* and FS 1610*b* to the respective heat exchangers 1600*a* and 1600*b*. A cold fluid flow 1620, which could be the cold rich stream FS 20 to the RHE 140 or the cold stream FS 20*a*, FS 20*b* or FS 20*c* to the heat exchangers of the DCSS 100 or some other relatively cold flow within the VSS or DCSS, is split into respective flows FS 1620*a* and 1620*b* to the heat exchangers 1600*a* and 1600*b*. Heat is transferred from the flow 1610*a* to the flow 1620*a* resulting in cold fluid flows FS 1610*a*' and FS 1610*b*' and fully or partially vaporized flows FS 1620*a*' and FS 1620*b*' from the exchangers. As noted above, boiling duty is performed in each of the parallel heat exchangers 1600*a* and 1600*b*, such that the flows FS 1620*a* and 1620*b* are at least partially vaporized to form flows FS 1620*a*' and FS 1620*b*' . Flows FS 1620*a*' and FS 1620*b*' are combined to form the at least partially vaporized fluid flow FS 1620*ab*'. Assuming the flows FS 1610*a* and FS 1610*b* are initially equal and the flows FS 1620*a* and FS 1620*b* are initially equal, if a small perturbation or anomaly occurs during system operation, a greater amount of boiling may begin to occur in one of the parallel heat exchangers, for example, heat exchanger 1600*a*. This will result in a greater amount of vapor being formed in exchanger 1600*a*, thereby increasing the flow FS 1620*a*'. The greater the amount of boiling duty performed in the exchanger 1600*a*, the greater will be the pressure drop through the exchanger experienced by the flow FS 1620*a*.

Accordingly, the resistance to the flow FS 1620*a* will increase. As this occurs, a greater portion of the cold fluid flow FS 1620 will be diverted as flow FS 1620*b* to the exchanger 1600*b*. Under such circumstances, a reduced amount of flow FS 1620*a* will be directed to the exchanger 1600*a* while approximately the same amount of flow FS 1610*a* is directed to the exchanger 1600*a*. This in turn will result in an even greater amount of heat being transferred to the flow FS 1620*a*, and hence even greater boiling duty being performed in the exchanger 1600*a*, thereby causing further increases in the pressure drop and in even more of the flow FS 1620 being diverted to the exchanger 1600*b*.

If this is allowed to continue, the exchanger 1600*a* could ultimately become dry, at which point the pressure drop in exchanger 1600*a* will begin to decrease resulting in further fluctuations in the flows FS 1620*a* and 1620*b*. Additionally because of the increased flow to the exchanger 1600*b*, the transformed fluid in flow FS 1620*b*' may be wetter than desired until the pressure drop in exchanger 1600*a* is sufficiently reduced such that the flow FS 1620*b* is decreased to the point where the transformed fluid in flow FS 1620*b*' is within specification. The flows FS 1620*a* and FS 1620*b* are likely to continue to change during operation until a steady state condition is reached over an extended period of time. Unless and until a steady state condition is reached, the characteristics of the vaporized fluid in flow FS 1620*ab*' will continue to vary.

To address this potentially serious operational problem, as shown in FIG. 16, sensors 1630*a* and 1630*b* are provided in the flow paths of streams FS 1620*a* and FS 1620*b*. The sensors 1630*a* and 1630*b*, respectively, measure the rate of flow of the streams FS 1620*a* and FS 1620*b*. The detected flow information is transmitted from the respective sensors 1630*a* and 1630*b* to a local controller 1650. It will be recognized by those skilled in the art that the information could alternatively be fed to a centralized system controller of the type previously described.

The controller 1650 processes the received information and generates signals to valves 1640*a* and 1640*b*, which regulate the respective flows in accordance with the received signals from the controller 1650. Because of the speed at which the pressure drops within the respective heat exchangers 1600*a* and 1600*b* can change due to perturbations or anomalies, the valves 1640*a* and 1640*b* preferably have a relatively high speed motor drive actuator. This facilitates relatively fast adjustment in the respective flows responsive to the signals received from the controller 1650. The required speed of adjustment can be determined based on the time scales of the volume of flow and the amount of heat transfer within the respective heat exchangers, as will be understood by those skilled in the art. Accordingly, by actively regulating the flows of the cooler fluid to the parallel heat exchangers, the parallel heat exchangers can be maintained in a balanced state and the characteristics of the vaporized fluid output can be easily maintained within the desired specification.

As will be understood by those skilled in the art, in modern power generation systems, it is important to closely control the temperature of the superheated steam in flow FS 40 to the TGSS 130, and more particularly to the HP turbine 130'. To accomplish this control, a cooling spray is conventionally, introduced in Rankine cycle systems upstream of the final superheater to modulate the temperature of the vapor leaving the superheater. The spray is introduced upstream of the superheater to ensure that no droplets of the spray enter the HP turbine and, perhaps more importantly, to avoid exceeding the maximum temperature of the materials within the superheater, which is usually about the same as the maximum temperature of the materials within the HP turbine, e.g., about 1,000° F. A spray may also be introduced upstream of the reheater to modulate the temperature of the superheated vapor entering the lower pressure turbines, e.g., the IP turbine and/or LP turbine.

Figure 17:
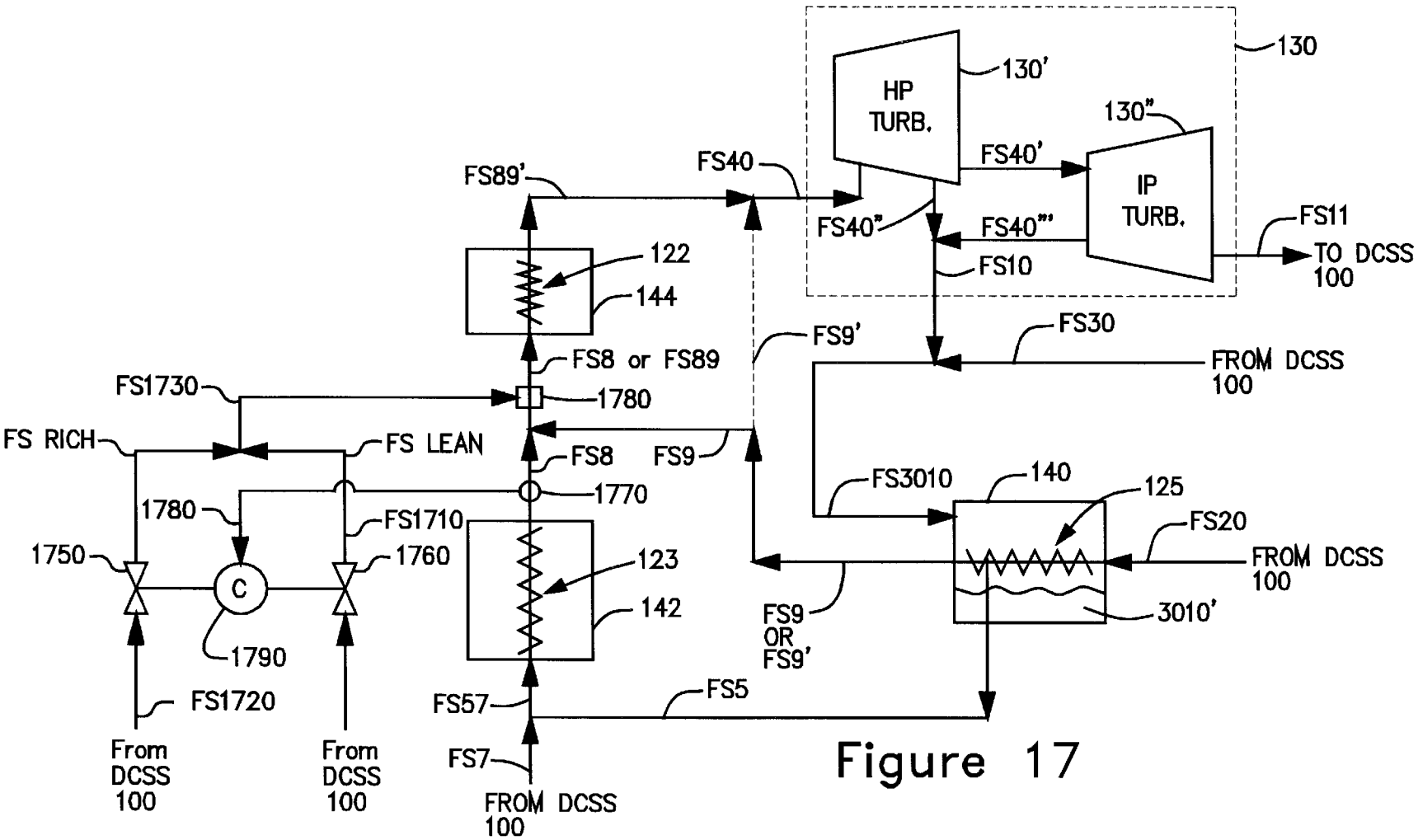
FIG. 17 depicts a control system for controlling the temperature of superheated multicomponent working fluid in the power generation system of FIGS. 7A–7C in accordance with the present invention.

FIG. 17 depicts a system similar to the system of 5A but with a mechanism for modulating the temperature of the superheated vapor FS 40 to the HP turbine 130'. As shown, a sprayer 1740 is provided upstream of the superheater 144 to introduce a spray into the vapor stream FS 8 or FS 89. However, unlike in conventional Rankine cycle systems, the fluid stream FS 8 or FS 89 has multiple components which can vary in concentration. Accordingly, in order to provide a spray without introducing concentration fluctuations in the stream FS 8 or stream FS 89 or which can be used to adjust the concentration of the fluid in stream FS 8 or stream FS 89 along with the temperature, the spray is formed of regulated lean and rich streams of working fluid.

More particularly, as shown in FIG. 17, a rich stream FS 1720 and lean stream FS 1710 are provided from the DCSS 100 and combined to form stream FS 1730 to the sprayer 1740. The streams FS 1720 and FS 1710 are regulated by valves 1750 and 1760, respectively. For example, the stream FS 1720 could be formed by diverting a portion of FS 7 of FIG. 7A and stream FS 1710 could be formed by diverting a portion of stream of FS 30 from the DCSS. However, other sources of the lean and rich fluid streams FS 1710 and FS 1720 could alternatively be used as may be desirable under the particular circumstances.

A local controller 1790 is provided for controlling valves 1750 and 1760 to regulate the flows of rich stream FS 1720 and lean stream FS 1710 to ensure a proper concentration of the stream FS 1730 to the sprayer 1740. Here again, a centralized controller could be used in lieu of the local controller. A sensor 1770 may optionally be provided to detect the concentration of the working fluid in stream FS 8 or FS 89 and transmit a signal over the link 1780 to the controller 1790 representing the detected concentration. Alternatively, the controller can be set based upon the anticipated concentration of the working fluid in the stream FS 8 or FS 89. In either case the controller 1790 can be configured to generate and transmit signals to the valves 1750 and 1760 to control the operation of valves 1750 and 1760 and thereby regulate the flows FS 1710 and FS 1720 and hence the concentration of the flow FS 1730 to the sprayer 1740.

As previously discussed, the concentration may be regulated so as to ensure that the concentration of the various working fluid components in stream FS 1730 match the concentration of the working fluid components in the vapor stream FS 8 or FS 89 upstream of the sprayer 1740. Alternatively, the controller may control the operation of the valves 1750 and 1760 such that the concentrations of the respective working fluid components forming stream FS 1730 vary by some desired amount from the concentrations of the working fluid components forming streams FS 8 or FS 89 upstream of the sprayer 1740 to thereby change the concentration of the vaporized working fluid entering the superheater.

Figure 18:
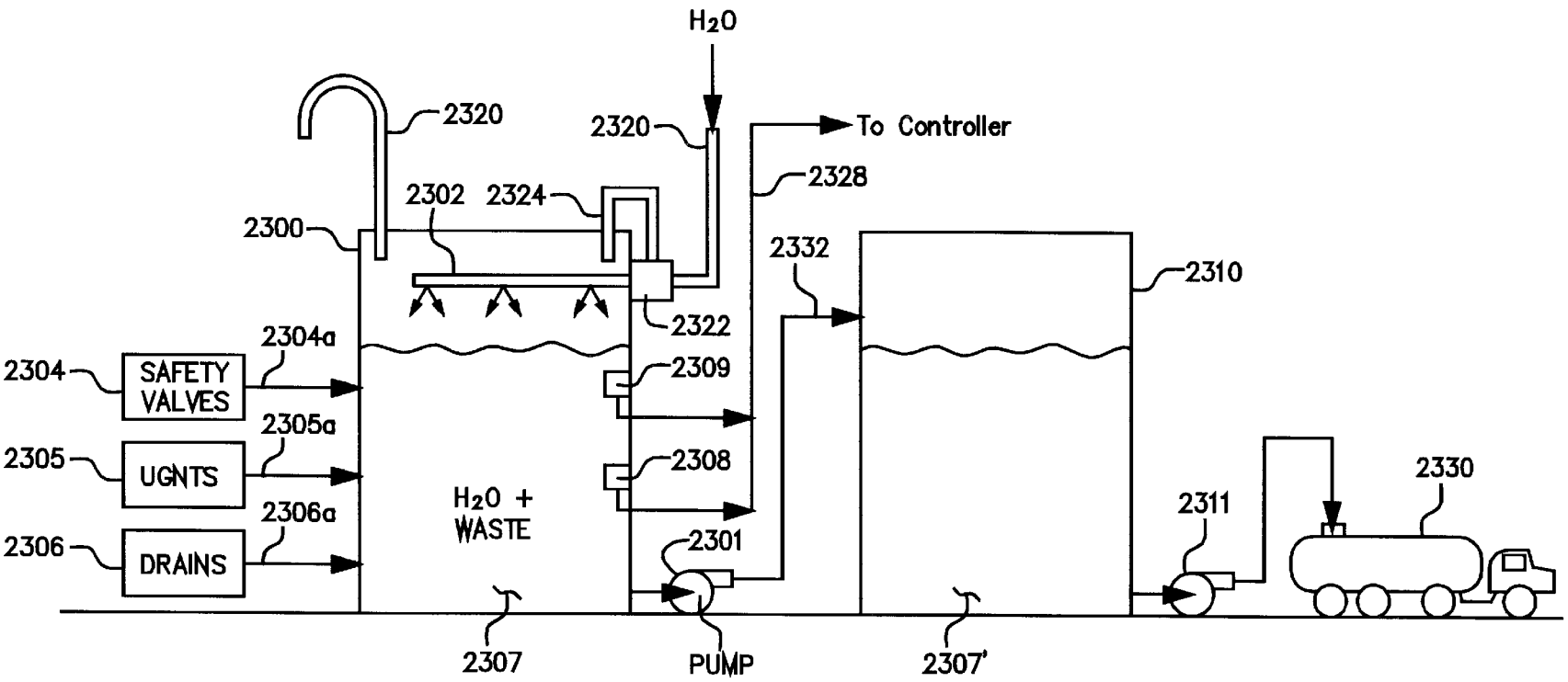
FIG. 18 illustrates a discharge recovery system in accordance with the present invention.

In order to adequately handle the hazardous ammonia waste vapor or liquid working fluid from the Kalina cycle power generation system described above, a capture, storage and transport system is provided as shown in FIG. 18. The blowdown recovery system recovers discharged working fluid from various points, e.g., safety valves 2304, vent valves 2305, and waste drains 2306. Discharged working fluid is captured from these sources before it flows into the atmosphere or water, thereby reducing, if not eliminating altogether the hazard to the environment.

Discharged vapor or liquid working fluid is directed to a primary holding tank by discharge lines 2304*a*, 2305*a* and 2306*a*. The discharge lines will typically be flow tubes. The tank 2300 contains sufficient water to absorb all the ammonia in the discharged working fluid such that the ammonia is not released into the environment, particularly into the atmosphere or ground water. A sensor 2308 monitors the concentration of ammonia in the ammonia-water mixture 2307 within the tank 2300. Once a threshold concentration is reached, the pump 2301 is operated to transfer the mixture, now 2307', to a secondary holding tank 2310. The high ammonia content mixture 2307' is transferred via outlet flow line 2332, using the pump 2311, from the secondary holding tank 2310 to a tank truck 2330 to be hauled to an appropriate disposal facility.

After transferring a high ammonia content mixture 2307' from the primary holding tank 2300, the primary holding tank is refilled with fresh water from supply line 2320 which connects to a multivalve assembly which controls the water flow to the refill flow line 2324. The primary holding tank 2300 may be only partially drained before adding more water to dilute the remaining mixture, or drained and filled concurrently, and hence will be always available for accepting new discharge. The discharge lines 2304*a*, 2305*a* and 2306*a* which direct the discharges to the primary holding tank 2300 are sized so that there is no back pressure created on the safety or vent valves or other system components. Spray nozzles 2302 are provided and connected to the fresh water supply line 2320 by valve assembly 2322. The spray nozzles 2302 provide additional protection in the event any ammonia vapor comes out of solution in the mixture 2307. Should this occur, it is detected by sensor 2309 and the spray nozzles are automatically activated to spray a fine mist to capture the escaping ammonia vapor in the water spray and return it to the mixture 2307. A vent 2320 is provided to vent any non-condensable gases which may be captured in the tank 2300.

The output signals from each of the sensors 2308 and 2309 are transmitted via communications lines 2328 to a system or local controller of the type previously described. The valve assembly 2322 and pump 2301 may also, if desired, be connected to the applicable controller and automatically operated to perform their respective functions based upon the information received from the sensors 2308 and 2309.

The above described multicomponent working fluid vapor generation system, which could be a Kalina cycle power generation system, is capable of proper operation under conditions which vary from normal operating conditions. The system is also capable of proper operation under varying load demands and in a sliding pressure mode. The system is also environmentally safe to operate.

It will also be recognized by those skilled in the art that, while the invention has been described above in terms of one or more preferred embodiments, it is not limited thereto. Various features and aspects of the above described invention may be used individually or jointly. Further, although the invention has been described in the context of its implementation in a particular environment and for particular purposes, e.g., Kalina cycle power generation, those skilled in the art will recognize that its usefulness is not limited thereto and that the present invention can be beneficially utilized in any number of environments and implementations. Accordingly, the claims set forth below should be construed in view of the full breath and spirit of the invention as disclosed herein.

What is claimed is:

1. A method of operating a power generation system having a turbine for receiving a stream of working fluid and expanding the working fluid to produce power, a regenerative heat exchanger having a plurality of condensing heat exchangers for transferring heat from the expanded working fluid to condense the expanded working fluid, and a vapor generator for vaporizing the condensed portions of working fluid to form the stream of working fluid, comprising the steps of:

directing a respective portion of the expanded working fluid to each of the plurality of condensing heat exchangers; and regulating an amount of condensed working fluid at least one of the plurality of condensing heat exchangers.

2. A method according to claim 1, wherein the regulating includes regulating a flow of the condensed working fluid from the at least one of the plurality of condensing heat exchangers.

3. A method according to claim 2, wherein the regulating individually regulates a rate of the flow of condensed working fluid from each of the at least one of the plurality of condensing heat exchangers.

4. A method according to claim 2, wherein:

the at least one of the plurality of condensing heat exchangers is all but one of the plurality of condensing heat exchangers.

5. A method according to claim 2, wherein:

the regulating includes regulating a rate of the flow of condensed working fluid from each of the at least one of the plurality of condensing heat exchangers to regulate an amount of the condensed first working fluid at each of the at least one of the plurality of condensing heat exchangers.

6. A method according to claim 2, wherein the working fluid is formed of multiple components.

7. A method according to claim 2, further comprising the steps of:

receiving information representing an amount of condensed working fluid in each of the at least one of the plurality of condensing heat exchangers; and regulating the flow of condensed working fluid from each of the at least one of the plurality of condensing heat exchangers based upon the received information.

8. A method according to claim 1, wherein:

the working fluid includes a first component and a second component having a low boiling point as compared to the first component; and the regulating of the amount of condensed working fluid includes regulating the concentration of the second component in the portion of expanded working fluid directed to the at least one of the plurality of condensing heat exchangers.

9. A method according to claim 1, wherein the regulating includes regulating a flow of the portion of expanded working fluid directed to each of the at least one of the plurality of condensing heat exchangers.

10. A method according to claim 9, wherein:

the working fluid includes a first component and a second component having a low boiling point as compared to the first component;

the portion of expanded working fluid directed to each of the at least one of the plurality of condensing heat exchangers is formed of a first stream of working fluid and a second stream of working fluid; and the regulating includes regulating a rate of flow of the first stream forming the portion of expanded working fluid directed to each of the at least one of the plurality of condensing heat exchangers.

11. A method according to claim 10, wherein:

the regulating of the rate of flow regulates the concentration of the second component in the portion of expanded working fluid directed to each of the at least one of the plurality of condensing heat exchangers.

12. A method according to claim 9, wherein:

the at least one of the plurality of condensing heat exchangers is all but one of the plurality of condensing heat exchangers.

13. A method according to claim 9, wherein:

the regulating includes regulating a rate of flow of the portion of expanded working fluid directed to each of the at least one of the plurality of condensing heat exchangers to regulate an amount of the condensed first working fluid at each of the at least one of the plurality of condensing heat exchangers.

14. A method according to claim 9, further comprising the steps of:

receiving information corresponding to a pressure within the system; and regulating the flow of the portion of expanded working fluid directed to each of the at least one of the plurality of condensing heat exchangers based upon the received information.

15. A power generation system, comprising:

a turbine configured to receive a stream of working fluid and expand the working fluid to produce power:

a plurality of condensing heat exchangers configured to transfer heat from the expanded working fluid and thereby condense the expanded working fluid;

a mechanism configured to regulate an amount of condensed working fluid at least one of the plurality of condensing heat exchangers; and a vapor generator configured to vaporize the condensed working fluid to form the stream of working fluid.

16. A system according to claim 15, wherein the mechanism includes:

flow paths configured to direct a respective portion of the expanded working fluid to each of the plurality of condensing heat exchangers; and at least one valve configured to regulate a flow of the condensed working fluid from at least one of the plurality of condensing heat exchangers.

17. A system according to claim 16, wherein each of the at least one valves is configured to individually regulate a rate of flow of the condensed working fluid from an associated condensing heat exchanger.

18. A system according to claim 16, wherein:

the at least one valve is associated with all but one of the plurality of condensing heat exchangers.

19. A system according to claim 16, wherein:

each of the at least one valves regulate a rate of flow of the condensed working fluid from a respective one of the at least one of the plurality of condensing heat exchangers to regulate an amount of the condensed working fluid at the respective condensing heat exchanger.

20. A system according to claim 16, wherein the working fluid is formed of multiple components.

21. A system according to claim 16, further comprising:

at least one sensor, each configured to detect an amount of condensed working fluid in a respective one of the at least one of the plurality of condensing heat exchangers; and a controller configured to receive information corresponding to each detected amount and to generate a signal based on the received information;

wherein each of the at least one valves is associated with a respective one of the at least one sensors and operates to regulate in accordance with the signal based on information corresponding to the amount detected by its associated sensor, the flow of condensed working fluid from the applicable respective condensing heat exchanger.

22. A system according to claim 15, wherein:

the working fluid includes a first component and a second component having a low boiling point as compared to the first component; and the mechanism is configured to regulate the amount of condensed working fluid by regulating a concentration of the second component in the expanded working fluid at the at least one of the plurality of condensing heat exchangers.

23. A system according to claim 15, wherein the mechanism includes:

at least one flow path, each configured to direct a flow, of a respective portion of the expanded working fluid to a respective one of the at least one of the plurality of condensing heat exchangers; and at least one valve, each being associated with a respective one of the at least one flow path and being operable to regulate the flow of the portion of the expanded working fluid directed by its associated flow path to the respective condensing heat exchanger.

24. A system according to claim 23, wherein the regulating further regulates a concentration of the portion of expanded working fluid directed by its associated flow path to the respective condensing heat exchanger.

25. A system according to claim 23, wherein:

the working fluid includes a first component and a second component having a lower boiling point than the first component;

the respective portion of expanded working fluid directed to each of the respective condensing heat exchangers is formed of a first working fluid and a second working fluid, the second working fluid having a different concentration of the second component than the first working fluid; and each of the at least one valves is operable to regulate the flow of the first working fluid directed by its associated flow path.

26. A system according to claim 25, wherein:

each of the at least one valves is operable to regulate a rate of flow of the first working fluid directed by its associated flow path to the respective condensing heat exchanger to regulate the concentration of the second component in the portion of expanded working fluid at the respective condensing heat exchanger.

27. A system according to claim 23, wherein:

the at least one of the plurality of condensing heat exchangers is all of the plurality of condensing heat exchangers.

28. A system according to claim 23, further comprising:

a controller configured to receive information corresponding to a pressure change and to generate signals to the at least one valves, responsive to which the at least one valves operate to adjust the flow of the portion of the expanded working fluid directed by its associated flow path.

29. A regenerative heat exchanger, comprising:

a plurality of condensing heat exchange elements, each configured to receive a respective portion of a working fluid and transfer heat from the received portion of working fluid to thereby condense the received portion of working fluid;

a plurality of chambers, each associated with a respective one of the condensing heat exchange elements and configured to collect the portion of the working fluid condensed by its associated condensing heat exchange element; and a plurality of valves, each associated with a respective one of the condensing heat exchange elements and operable to regulate an amount of the condensed working fluid collected in the chamber of its associated condensing heat exchange elements.

30. A regenerative heat exchanger according to claim 29, wherein:

each of the plurality of valves is operable to regulate a flow of the condensed working fluid collected in the chamber of its associated condensing heat exchange element.

31. A regenerative heat exchanger according to claim 30, wherein each of the plurality of valves is operable to individually regulate a rate of flow of the condensed working fluid from the chamber associated with its associated condensing heat exchanger.

32. A regenerative heat exchanger according to claim 30, wherein the plurality of valves are associated with all but one of the plurality of condensing heat exchange elements.

33. A regenerative heat exchanger according to claim 30, wherein the working fluid is formed of multiple components.

34. A regenerative heat exchanger according to claim 30, further comprising:

a plurality of sensors, each associated with a respective one of the plurality of chambers having an associated valve and configured to detect the amount of condensed working fluid collected in its associated chamber; and a controller configured to receive information representing the detected amount from one of the plurality of sensors and to generate a control signal corresponding to the information received from the one sensor;

wherein the associated valve operates to regulate the flow in accordance with the control signal.

35. A regenerative heat exchanger according to claim 29, wherein:

the working fluid includes a first component and a second component having a lower boiling point than the first component; and each of the plurality of valves is operable to regulate the amount of the condensed working fluid collected by regulating a concentration of the second component in the portion of working fluid received by its associated condensing heat exchange element.

36. A regenerative heat exchanger according to claim 29, wherein the working fluid includes a first component and a second component having a lower boiling point than the first component, and the portion of working fluid received by each of the plurality of condensing heat exchange elements is formed of a first working fluid and a second working fluid, the first working fluid having a different concentration of the second component than the second working fluid, and further comprising:

a plurality of flow paths, each associated with a respective condensing heat exchange element and configured to direct a flow of the first working fluid forming the portion of working fluid received by its associated condensing heat exchange element;

wherein each of the plurality of valves is operable to regulate the flow of the first working fluid directed by the flow path associated with its associated condensing heat exchange element.

37. A method according to claim 1, wherein the regulating includes regulating an amount of working fluid to the condensing heat exchanger, such that the working fluid flows at other than a maximum flow rate and minimum flow rate.

38. A system according to claim 15, wherein the mechanism includes:

at least one valve is configured to regulate an amount of working fluid to at least one of the plurality of condensing heat exchangers, such that the working fluid flows at other than a maximum flow rate and minimum flow rate.

39. A regenerative heat exchanger according to claim 29, wherein:

at least one of the plurality of valves is configured to regulate an amount of working fluid to at least one of the plurality of condensing heat exchangers, such that the working fluid flows at other than a maximum flow rate and minimum flow rate.

* * * * *